US012723206B2

(12) United States Patent
Ruddy et al.

(10) Patent No.: US 12,723,206 B2
(45) Date of Patent: Sep. 1, 2026

(54) DEHYDROGENATIVE COUPLING OF LOW-VALUE LIGHT ALKANES TO SUSTAINABLE AVIATION FUEL

(71) Applicant: Alliance for Energy Innovation, LLC, Golden, CO (US)

(72) Inventors: Daniel Ruddy, Arvada, CO (US); Nicole Libretto, Chicago, IL (US); Anh The To, Commerce City, CO (US); Susan E. Habas, Arvada, CO (US); Alexander James Hill, Lakewood, CO (US)

(73) Assignee: Alliance for Energy Innovation, LLC, Golden, CO (US)

( * ) Notice: Subject to any disclaimer, the term of this patent is extended or adjusted under 35 U.S.C. 154(b) by 85 days.

(21) Appl. No.: 18/619,542

(22) Filed: Mar. 28, 2024

(65) Prior Publication Data

US 2024/0327730 A1 Oct. 3, 2024

Related U.S. Application Data

(60) Provisional application No. 63/492,666, filed on Mar. 28, 2023.

(51) Int. Cl.
*C10G 50/00* (2006.01)

(52) U.S. Cl.
CPC ..... *C10G 50/00* (2013.01); *C10G 2300/1081* (2013.01); *C10G 2300/4006* (2013.01); *C10G 2300/4012* (2013.01); *C10G 2300/42* (2013.01); *C10G 2300/70* (2013.01)

(58) Field of Classification Search
CPC ..... C10G 50/00; C10G 2300/1081; C10G 2300/4006; C10G 2300/4012; C10G 2300/42; C10G 2300/70
See application file for complete search history.

(56) References Cited

U.S. PATENT DOCUMENTS

RE34,189 E * 3/1993 Harandi ..... C07C 2/00 208/65
2015/0157998 A1* 6/2015 Luebke ..... B01D 3/143 422/187
2016/0237004 A1* 8/2016 Wang ..... B01J 29/22
(Continued)

FOREIGN PATENT DOCUMENTS

CN 105283243 A * 1/2016 ..... B01J 8/008
IT 201600105178 A1 * 4/2018 ..... C07C 29/60

OTHER PUBLICATIONS

CN 105283243 English translation (Year: 2016).*
(Continued)

*Primary Examiner* — Prem C Singh
*Assistant Examiner* — Juan C Valencia
(74) *Attorney, Agent, or Firm* — Alexandra M. Hall

(57) ABSTRACT

A dehydrogenative coupling process to convert alkanes to longer chain olefins in a single process step is described. The approach described combats the thermodynamics of traditional dehydrogenation by consuming the products as they form. This dehydrogenative coupling reaction may be performed in a single reactor which could enable increased per-pass yield of desirable $C_{8+}$ olefins compared to a traditional two reactors in a series.

16 Claims, 51 Drawing Sheets

(56) References Cited

U.S. PATENT DOCUMENTS

2022/0048834 A1 2/2022 Ruddy et al.
2022/0234031 A1* 7/2022 Li ..... B01J 21/08

OTHER PUBLICATIONS

IT 201600105178 English translation (Year: 2018).*
Chang et al., "Dehydroaromatization Pathway of Propane on PtZn/SiO2+ZSM-5 Bifunctional Catalyst", ACS Sustainable Chemistry & Engineering, 2022, vol. 10, No. 1, pp. 394-409.
Cortright et al., "Selective dehydrogenation of isobutane over supported Pt/Sn catalysts", Catalysis Today, 2000, vol. 55, No. 3, pp. 213-223.
Docherty et al., "Heterogeneous alkane dehydrogenation catalysts investigated via a surface organometallic chemistry approach", Chemical Society Reviews, 2021, vol. 50, pp. 5806-5822.
Dutta et al., "A separations and purification process for improving yields and meeting fuel contaminant specifications for high-octane gasoline produced from dimethyl-ether over a Cu/BEA catalyst", Biofuels, Bioproducts, and Biorefining, 2022, vol. 16, No. 6, pp. 1469-1477.
Farberow et al., "Exploring Low-Temperature Dehydrogenation at Ionic Cu Sites in Beta Zeolite To Enable Alkane Recycle in Dimethyl Ether Homologation", ACS Catalysis, 2017, vol. 7, No. 5, pp. 3662-3667.
Farberow et al., "Connecting cation site location to alkane dehydrogenation activity in Ni/BEA catalysts", Journal of Catalysis, 2022, vol. 413, pp. 264-273.
Haibach et al., "Alkane Metathesis by Tandem Alkane-Dehydrogenation-Olefin-Metathesis Catalysis and Related Chemistry", Acc. Chem. Res., 2012, 45, 6, pp. 947-958.
Karadaghi et al., "Activating Molybdenum Carbide Nanoparticle Catalysts under Mild Conditions Using Thermally Labile Ligands", Chemistry of Materials, 2022, vol. 34, No. 19, pp. 8849-8857.
Karadaghi et al., "Throughput Optimization of Molybdenum Carbide Nanoparticle Catalysts in a Continuous Flow Reactor Using Design of Experiments", ACS Applied Nano Materials, 2022, vol. 5 No. 2, pp. 1966-1975.
Labinger et al., "Upgrading Light Hydrocarbons: A Tandem Catalytic System for Alkane/Alkene Coupling", Topics Catalysis, 2015, vol. 58, pp. 494-501.
Labinger et al.,"Upgrading light hydrocarbons: A tandem catalytic system for alkane/alkene coupling", Abstract—247th National Meeting (2014) available at https://www.morressier.com/o/event/5fc6334e03137aa5254ffe1e/article/5fc6341b9e0a135cbeca46a8, accessed Apr. 21, 2022, pp. 1-2.
Leitch et al., "Upgrading Light Hydrocarbons via Tandem Catalysis: A Dual Homogeneous Ta/Ir System for Alkane/Alkene Coupling", Journal of the American Chemical Society, 2013, vol. 135, pp. 10302-10305.
Liao et al., "New Approach for bio-jet fuels production by hydrodeoxygenation of higher alcohols derived from C—C coupling of bio-ethanol", Applied Energy, 2022, vol. 324, 119843 pp. 1-11.
Mukarakate et al., "Upgrading biomass pyrolysis vapors over β-zeolites: role of silica-to-alumina ratio", Green Chemistry, 2014, vol. 16, No. 12, pp. 4891-4905.
Nadolny et al. "Experimental and theoretical investigation of heterogeneous catalyzed oligomerization of a mixed C4 stream over modified amorphous aluminosilicates", Journal of Catalysis, 2018, vol. 367, pp. 81-94.
Nash et al., "Catalyst design to direct high-octane gasoline fuel properties for improved engine efficiency", Applied Catalysis B: Environmental, 2022, vol. 301, 120801, pp. 1-11.
Nicholas, "Applications of light olefin oligomerization to the production of fuels and chemicals", Applied Catalysis A: General, 2017, vol. 543, pp. 82-97.
Nimlos et al., "Process Intensification for Direct Conversion of Biomass-Based Syngas to High Octane Gasoline", 2021 AIChE Annual Meeting—Breakthroughs in C1 to Chemicals and Processing Engineering, Nov. 16, 2021, pp. 1-54.
Nimlos et al., "Direct Conversion of Renewable CO2-Rich Syngas to High-Octane Hydrocarbons in a Single Reactor", ACS Catalysis, 2022, vol. 12, No. 15, pp. 9270-9280.
Ruddy, "Developing new processes for the conversion of methanol to advantaged biofuels within a market- responsive biorefinery concept enabled by catalysis", Pacifichem Conference, Dec. 19, 2021, pp. 1-19.
Ruddy, "Developing new processes for the conversion of methanol to advantaged biofuels within a market-responsive biorefinery concept enabled by catalysis", ACS National Meeting, San Diego, CA. Mar. 20, 2022, pp. 1-21.
Ruddy, "New processes for the conversion of renewable methanol to advantaged biofuels within a market-responsive biorefinery concept enabled by catalysis", Green Chemistry and Engineering Conference, Reston, VA, Jun. 8, 2022, pp. 1-20.
Ruddy, "Upgrading of C1 Building Blocks (2.3.1.305)", BETO 2023 Project Peer Review, Catalytic Upgrading, ChemCatBio, Apr. 2023, pp. 1-28.
Saito et al., "Catalytic Conversion of Ethane to Valuable Products Through Non-oxidative Dehydrogenation and Dehydroaromatization", RSC Advances, 2020, vol. 10, No. 36, p. 21427-21453.
Srinivasan et al., "Benchmarking Cu/BEA and HBEA catalysts for high-octane gasoline synthesis", Applied Catalysis A: General, 2022, vol. 643, 118799, pp. 1-10.
Tanigawa et al., "High-quality synthesis of a nanosized CHA zeolite by a combination of a starting FAU zeolite and aluminum sources", Dalton Transactions, 2020, vol. 49, No. 29, pp. 9972-9982.
To et al., "Direct synthesis of branched hydrocarbons from CO2 over composite catalysts in a single reactor", Journal of CO2 Utilization, 2022, vol. 66, 102261, pp. 1-9.
To et al., "Roles of Cu in coke oxidation during regeneration of spent Cu/BEA catalyst from renewable high octane hydrocarbon synthesis", 96th ACS Colloid & Surface Science Symposium, Golden, CO, Jul. 11-13, 2022, pp. 1-17.
Unocic et al., "Revealing the Reaction Behavior of Co0.86Mn0.14O under H2 using in situ Closed-Cell Gas Reaction S/TEM", Microscopy and Microanalysis, 2022, 28 (Suppl 1), pp. 1884-1886.
Wasilke et al., "Concurrent Tandem Catalysis", Chemical Reviews, 2005, vol. 105, No. 3, pp. 1001-1020.
Wu et al., "Spectroscopic insight into carbon speciation and removal on a Cu/BEA catalyst during renewable high-octane hydrocarbon synthesis", Applied Catalysis B: Environmental, 2021, vol. 287, 119925, pp. 1-9.
Yarusov et al., "Propane dehydrogenation over Pt—Sn catalysts", Catalysis Today, 1992, vol. 13, No. 4, pp. 655-658.
Yoon et al., "Trimerization of isobutene over a zeolite beta catalyst", Journal of Catalysis, 2007, vol. 245, No. 1, pp. 253-256.

* cited by examiner

DEHYDROGENATIVE COUPLING OF LOW-VALUE LIGHT ALKANES TO SUSTAINABLE AVIATION FUEL

CROSS-REFERENCE TO RELATED APPLICATIONS

This application claims priority to U.S. Provisional Patent Application No. 63/492,666 filed on Mar. 28, 2023, the contents of which are incorporated herein by reference in their entirety.

CONTRACTUAL ORIGIN

This invention was made with United States government support under Contract No. DE-AC36-08GO28308 awarded by the U.S. Department of Energy. The United States government has certain rights in this invention.

BACKGROUND

Traditional processes for converting alkanes to olefins or to oligomerize olefins involve complicated, multistep processes. Dehydrogenation typically occurs at very high reaction temperatures (for example, in the range of approximately 400-500° C.) and approximately atmospheric pressure while oligomerization occurs at low reaction temperatures (for example, less than approximately 200° C.) and high pressure (for example, up to approximately 1000 psig). Expensive chemical co-activators are also used to facilitate reactions over homogenous oligomerization catalysts. Thus, there remains a need for a less complicated dehydrogenation process.

SUMMARY

An aspect of the present disclosure is a method including forming a mixed bed comprising a dehydrogenation catalyst and a coupling catalyst, and applying a feed stream to the mixed bed, in which the applying results in a molecular weight hydrocarbon. In some embodiments, the dehydrogenation catalyst includes at least one of Pt—Sn/$Al_2O_3$ or a zeolite material, in which the Pt—Sn/$Al_2O_3$ or the zeolite material is modified with at least one of vanadium (V), zinc (Zn), copper (Cu), gallium (Ga), nickel (Ni), or platinum (Pt). In some embodiments, the dehydrogenation catalyst includes an amorphous silica-alumina material modified with at least one of V, Zn, Cu, Ga, Ni, or Pt. In some embodiments, the coupling catalyst includes a BEA zeolite. In some embodiments, the BEA zeolite has a silica-alumina ratio (SAR) in the range of 10 to 300. In some embodiments, the BEA zeolite has a silicoaluminophosphate zeotype (SAPO). In some embodiments, the BEA zeolite includes a mixed oxide of at least one of $WO_3$—$ZrO_2$, $SiO_2$—$AlO_3$, or phosphated—$SiO_2$—$AlO_3$. In some embodiments, the coupling catalyst includes a faujasite (FAU) zeolite. In some embodiments, the FAU zeolite has a silica-alumina ratio (SAR) in the range of 10 to 300. In some embodiments, the FAU zeolite has a silicoaluminophosphate zeotype (SAPO). In some embodiments, In some embodiments, the FAU zeolite includes a mixed oxide of at least one of $WO_3$—$ZrO_2$, $SiO_2$—$AlO_3$, or phosphated—$SiO_2$—$AlO_3$. In some embodiments, the feed stream includes at least one C4-C8 branched hydrocarbon. In some embodiments, the feed stream includes isobutane, argon, and nitrogen. In some embodiments, the feed stream includes a hydrogen gas ($H_2$). In some embodiments, the applying is performed at a temperature greater than approximately 300° C. In some embodiments, the applying is performed at a temperature in the range of approximately 300° C. to approximately 500° C. In some embodiments, the applying is performed at a pressure in the range from about 1 psig to about 150 psig. In some embodiments, the applying is performed at a pressure of greater than about 50 psig. In some embodiments, the higher molecular weight hydrocarbon comprises a $C_{8+}$ hydrocarbon. In some embodiments, the $C_{8+}$ hydrocarbon is at least one of octane, nonane, decane, undecane, dodecane, octene, nonene, decene, undecene, dodecene, octyne, nonyne, decyne, undecyne, dodecyne, cyclooctane, cyclononane, cyclodecane, cycloundecane, cyclododecane, octadiene, nonadiene, decadiene, undecadiene, or dodecadiene.

BRIEF DESCRIPTION OF THE DRAWINGS

Some embodiments of the present disclosure are illustrated in the referenced figures of the drawings. It is intended that the embodiments and figures disclosed herein are to be considered illustrative rather than limiting.

FIG. 3A: Pt—Sn/$Al_2O_3$+ HBEA (SAR 150), FIG. 3B: Pt—Sn/$Al_2O_3$+$SiO_2$—$Al_2O_3$, FIG. 3C: Pt—Sn/$Al_2O_3$+$WO_3$—$ZrO_2$, FIG. 3D: Zn/BEA (SAR 27), FIG. 3E: Zn/BEA (SAR 150), and FIG. 3F: Zn/$SiO_2$—$Al_2O_3$, according to some aspects of the present disclosure.

FIG. 4A illustrates conversion, FIG. 4B illustrates $C_{4-}$ free $C_{3-}$ selectivity, FIG. 4C illustrates $C_{4-}$ free $C_{5+}$ selectivity, and FIG. 4D illustrates $C_{4-}$ free $C_{8+}$ selectivity compared over a range of reactor pressures, according to some aspects of the present disclosure.

FIG. 5A illustrates conversion, FIG. 5B illustrates $C_{4-}$ free $C_{3-}$ selectivity, FIG. 5C illustrates $C_{4-}$ free $C_{5+}$ selectivity, and FIG. 5D illustrates $C_{4-}$ free $C_{8+}$ selectivity compared over a range of reactor temperatures at approximately 50 psig, according to some aspects of the present disclosure.

FIG. 6A illustrates conversion, FIG. 6B illustrates $C_{4-}$ free $C_{3-}$ selectivity, FIG. 6C illustrates $C_{4-}$ free $C_{5+}$ selectivity, and FIG. 6D illustrates $C_{4-}$ free $C_{8+}$ selectivity compared over a range of reactor pressures, according to some aspects of the present disclosure.

FIG. 7A illustrates conversion, FIG. 7B illustrates $C_{4-}$ free $C_{3-}$ selectivity, FIG. 7C illustrates $C_{4-}$ free $C_{5+}$ selectivity, and FIG. 7D illustrates $C_{4-}$ free $C_{8+}$ selectivity was compared over a range of reactor pressures, according to some aspects of the present disclosure.

FIG. 8A illustrates conversion, FIG. 8B illustrates $C_{4-}$ free $C_{3-}$ selectivity, FIG. 8C illustrates $C_{4-}$ free $C_{5+}$ selectivity, and FIG. 8D illustrates $C_{4-}$ free $C_{8+}$ selectivity compared over a range of reactor pressures, according to some aspects of the present disclosure.

DETAILED DESCRIPTION

Figure 1:
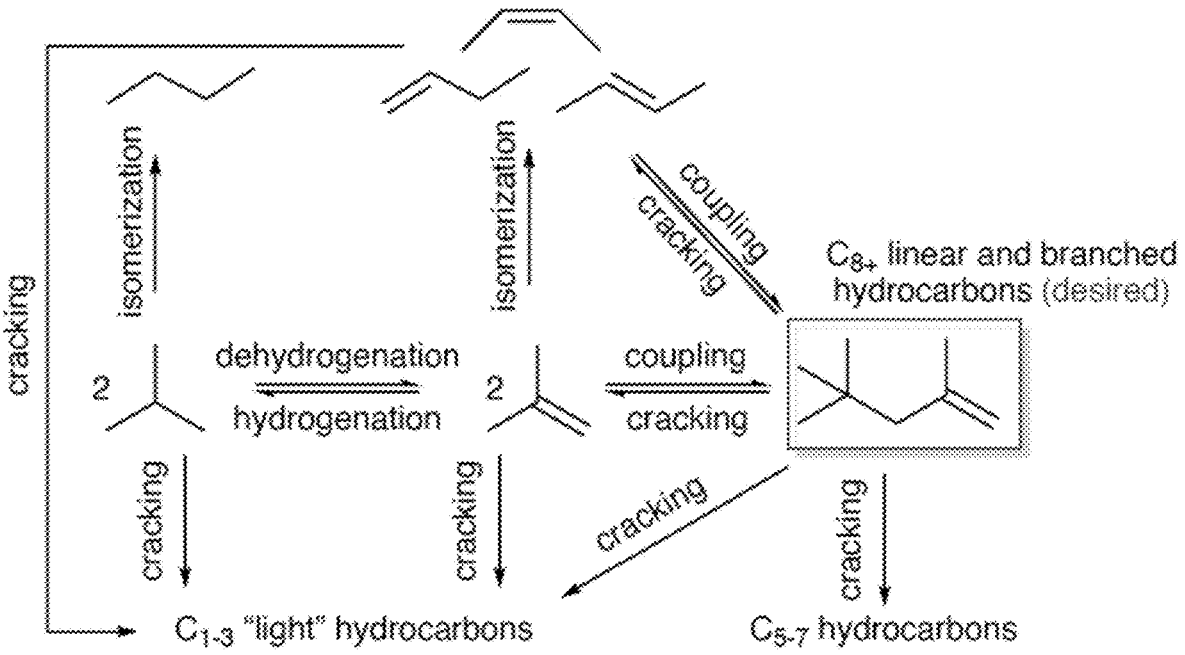
FIG. 1 illustrates reaction pathways of isobutane conversion via isomerization, dehydrogenation, and cracking reactions, according to some aspects of the present disclosure.

The embodiments described herein should not necessarily be construed as limited to addressing any of the particular problems or deficiencies discussed herein. References in the specification to "one embodiment", "an embodiment", "an example embodiment", "some embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As used herein the term "substantially" is used to indicate that exact values are not necessarily attainable. By way of example, one of ordinary skill in the art will understand that in some chemical reactions 100% conversion of a reactant is possible, yet unlikely. Most of a reactant may be converted to a product and conversion of the reactant may asymptotically approach 100% conversion. So, although from a practical perspective 100% of the reactant is converted, from a technical perspective, a small and sometimes difficult to define amount remains. For this example of a chemical reactant, that amount may be relatively easily defined by the detection limits of the instrument used to test for it. However, in many cases, this amount may not be easily defined, hence the use of the term "substantially". In some embodiments of the present invention, the term "substantially" is defined as approaching a specific numeric value or target to within 20%, 15%, 10%, 5%, or within 1% of the value or target. In further embodiments of the present invention, the term "substantially" is defined as approaching a specific numeric value or target to within 1%, 0.9%, 0.8%, 0.7%, 0.6%, 0.5%, 0.4%, 0.3%, 0.2%, or 0.1% of the value or target.

As used herein, the term "about" is used to indicate that exact values are not necessarily attainable. Therefore, the term "about" is used to indicate this uncertainty limit. In some embodiments of the present invention, the term "about" is used to indicate an uncertainty limit of less than or equal to ±20%, ±15%, ±10%, ±5%, or ±1% of a specific numeric value or target. In some embodiments of the present invention, the term "about" is used to indicate an uncertainty limit of less than or equal to ±1%, ±0.9%, ±0.8%, ±0.7%, ±0.6%, ±0.5%, ±0.4%, ±0.3%, ±0.2%, or ±0.1% of a specific numeric value or target.

As used herein, $C_{8+}$ hydrocarbons or olefins refer to a compound having eight (8) or more carbons. The carbons may have single bonds (i.e., be alkanes), double bonds (i.e., be alkenes), triple bonds (i.e., alkynes), and/or may be aromatic (i.e., have the carbons arranged in a ring). Examples of $C_{8+}$ hydrocarbons include (but are not limited to): octane, nonane, decane, undecane, dodecane, octene, nonene, decene, undecene, dodecene, octyne, nonyne, decyne, undecyne, dodecyne, cyclooctane, cyclononane, cyclodecane, cycloundecane, cyclododecane, octadiene, nonadiene, decadiene, undecadiene, or dodecadiene.

Among other things, the present disclosure relates to a dehydrogenative coupling process to convert alkanes to longer chain olefins in a single process step. These longer chain olefins (i.e., $C_{8+}$ hydrocarbons) may utilized (either with or without further processing) for sustainable aviation fuel, jet fuel, or other fuel and/or energy operations. The approach described herein combats the thermodynamics of traditional dehydrogenation by consuming the products as they form. Also, this dehydrogenative coupling reaction in a single reactor could enable increased per-pass yield of desirable $C_{8+}$ olefins, compared to a traditional two reactors in a series, where the first reactor (where the dehydrogenation is occurring) suffers from the thermodynamic limitation. Using two reactors in series does enable control of the reaction conditions for each step (dehydrogenation and coupling) independently, but the thermodynamic equilibrium of isobutane dehydrogenation may limit the concentration of olefins available for subsequent conversion, leading to a limited per-pass yield of $C_{8+}$ hydrocarbons (HCs). The methods described herein showed initial results in forming $C_{8+}$ HCs with up to approximately 31% selectivity at approximately 20% conversion. This method of coupling cascade chemistry is distinct in its focus to (1) utilize and upgrade otherwise-wasted light paraffins (which may be used as a fuel gas in biorefinery models) and (2) develop a new 1-step process that enables the desired chemistry in a single reactor. The methods described herein may be integrated into existing processes as a route to produce valuable olefin products from waste carbon sources.

Presently, no commercial processes exist to perform dehydrogenation and subsequent coupling in a single reactor, likely due to mismatched reaction conditions for each step. For example, alkane conversion via dehydrogenation is thermodynamically limited at moderate temperatures (e.g., approximately 200° C.), and therefore, the reaction is typically performed at high temperatures (in the range of approximately 400-500° C.) and at approximately atmospheric pressure. An industrial alkane dehydrogenation catalyst, Pt—Sn/$Al_2O_3$, exhibits high isobutene selectivity during isobutane dehydrogenation. However, the subsequent coupling of isobutene to higher molecular weight olefins is usually performed on solid acid catalysts at temperatures below approximately 200° C. and at high pressure. The process intensification approach envisioned here demonstrates a dehydrogenative coupling reaction that surpasses the thermodynamically-limited dehydrogenation activity at moderate temperatures by consuming the dehydrogenated olefin product via acid-catalyzed coupling as it is produced. This process intensification approach is intended to reduce the capital and operating expenses in a biorefinery.

The conversion of alkanes to fuel-range hydrocarbons (i.e., $C_{8+}$ HCs) in one step, referred to herein as "dehydrogenative coupling", offers a process intensification approach to reduce capital and operating expenses in a biorefinery. There are no present commercial technologies to convert alkanes directly to long chain olefins in a single reactor. Existing industrial processes convert alkanes to olefins or oligomerize olefins using multiple process steps. Dehydrogenation occurs at high reaction temperatures (in the range of approximately 400-500° C.) and approximately atmospheric pressure while oligomerization occurs at low reaction temperatures (less than approximately 200° C.) and high pressure (up to approximately 1000 psig). Expensive chemical co-activators are also used to facilitate reactions over homogeneous oligomerization catalysts. Our proposed process implements heterogeneous catalysts to perform dehydrogenation and oligomerization in a single reactor with low aromatic hydrocarbon yield.

A total of 10 catalyst systems comprising dehydrogenation and coupling active components were evaluated over a range of reaction temperatures (in the range of approximately 240° C.-400° C.) and pressures (from approximately atmospheric/ambient up to approximately 150 psig) with an isobutane feed stream ranging from approximately 1% to approximately 90% isobutane (mixed with approximately 1% Ar and a balance of $N_2$). Benchmark dehydrogenation catalysts Pt—Sn/$Al_2O_3$ and Zn/BEA were evaluated for comparison. To inform the synthesis of next-generation catalysts, the acid sites responsible for coupling and cracking reactions were quantified by $NH_3$-temperature programmed desorption (TPD) and the structure of the benchmark Pt—Sn/$Al_2O_3$ catalyst was determined by X-ray absorption spectroscopy (XAS) and scanning transmission electron microscopy (STEM) with energy dispersive X-ray spectroscopy (EDS). The catalytic results demonstrated that several mixed-bed catalyst systems successfully produce $C_{8+}$ HCs at high reaction temperatures (greater than approximately 300° C.) and pressures (greater than approximately 50 psig) with conversions up to approximately 33% and $C_{8+}$ HC selectivity up to approximately 31%. The $C_{5+}$ HC selectivities of up to approximately 78% over Pt—Sn/$Al_2O_3$ catalyst systems and approximately 73% over Zn/BEA catalysts suggest that coupling chemistry initially proceeds with high selectivity; however, secondary cracking reactions of coupled products occurred, and it was found that catalysts with higher acid site density promoted these cracking reactions. Results using coupling catalysts that have been chemically modified to have lower acid site strength and density show improved $C_{8+}$ HC selectivity up to approximately 57%, which suggests that tuning acid site chemistry can improve selectivity in a dehydrogenative coupling process.

Isoalkanes, like isobutane, are produced from the syngas-to-hydrocarbons (STH) process and are a precursor to jet-range HCs through dehydrogenation and coupling. Presently, no commercial processes exist to perform alkane dehydrogenation and subsequent coupling of alkenes in a single reactor, likely due to the typical conditions for each reaction being mismatched. The results reported here successfully demonstrated the proof-of-concept and set the baseline performance for the direct dehydrogenative coupling of isobutane to higher hydrocarbons. Furthermore, although the conversion of isobutane is thermodynamically limited to approximately 18% at approximately 400° C., conversions up to approximately 33% at approximately 400° C. were observed, indicating that the equilibrium conversion of isobutane can be surpassed by consuming isobutene as it is produced. This is impactful because it indicates that a single catalyst bed under a single set of reaction conditions can promote higher conversions of isobutane and the formation of higher molecular weight HCs. The alternative approach of using 2 reactors in series would enable control of the reaction conditions for each step (dehydrogenation and coupling) independently, but the thermodynamic equilibrium of isobutane dehydrogenation would limit the concentration of isobutene available for subsequent conversion, leading to a limited per-pass yield of jet-range HCs.

The methods of the present disclosure included increased reaction pressure, higher isobutane partial pressure by utilizing liquid feed stream, increased reaction temperature, increased reaction weight hourly space velocity (WHSV) of isobutane, increased isobutane concentration, and/or tailored or modified active sites in bifunctional catalysts or dual catalyst systems. For increased reactor pressure, current reactor limitations inhibit operating pressures greater than approximately 150 psig, but the results presented herein showed that higher reaction pressures lead to higher $C_{8+}$ HC selectivity. A gas mixture containing approximately 1% isobutane was utilized allowing for an isobutane partial pressure ($P_{ic4}$) of approximately 1 psig. Reactor modification allowing for the feed stream of dilute isobutane blends at high pressure may enable higher $P_{ic4}$ leading to improved $C_{8+}$ HC selectivity. For higher isobutane partial pressure by utilizing liquid feed stream, approximately 100% isobutane is a liquid at standard temperature and pressure (STP) with a gas head space pressure of approximately 24 psig. This head space pressure was used to deliver isobutance at the various concentrations (achieved by mixing with $N_2$ gas) summarized within this disclosure. This head space limitations may be overcome by applying the liquid (that is approximately 100% isobutane) at a high pressure. Again, reactor modification may be needed to enable liquid feed stream at a high pressure, which may enable the performance of dehydrogenative coupling with both higher isobutane concentrations and higher Pica to promote increased $C_{8+}$ HC selectivity. Regarding tailored active sites in bifunctional catalysts or dual catalyst systems, the silica-to-alumina ratio (SAR of BEA zeolite is correlated to increased cracking activity, where lower SAR values (greater acid-site density) may lead to higher cracking selectivity. The data comparing two SAR values in the Zn/BEA system demonstrated that coupling selectivity may be increased with corresponding decrease in cracking selectivity by choosing a higher SAR material (and lower acid site density). Acid site modification is another method of tailoring active sites for improved $C_{8+}$ HC selectivity. Modification with a phosphoric acid ($H_3PO_4$) solution was performed on several commercially available coupling catalysts (amorphous silica-alumina SiAl, H/BEA, and H/FAU) to chemically modify acid site density and acid strength through the incorporation of phosphate ($PO_x$) groups. The data comparing the unmodified and $H_3PO_4$-modified (denoted as "$PO_x$") catalysts showed that acid modification decreases cracking activity and subsequently increases $C_{8+}$ HC selectivity.

The syngas-to-hydrocarbons (STH) process is highly effective at converting syngas and/or $CO_2$ directly to isoalkanes, which are excellent jet fuel precursors via subsequent dehydrogenation and olefin coupling. Conceptually, the direct reaction of isoalkanes in one step, termed here "dehydrogenative coupling" offers a process intensification approach to reduce capital and operating expenses in a biorefinery. Presently, no commercial process exists to perform dehydrogenation and subsequent coupling in a single reactor, likely due to mismatched reaction conditions for each step. For example, alkane conversion via dehydrogenation is thermodynamically limited at moderate temperatures (e.g., approximately 200° C.) and therefore, the reaction is typically performed at high temperatures (e.g., approximately 400-500° C.) and at approximately atmospheric pressure. An industrial alkane dehydrogenation catalyst, Pt—Sn/$Al_2O_3$, exhibits high isobutane selectivity during isobutane dehydrogenation. However, the subsequent coupling of isobutene to higher molecular weight olefins is usually performed on sold acid catalysts like tungstated zirconia ($WO_3$—$ZrO_2$), sulfated zirconia, silica-alumina, and zeolites at temperatures below approximately 200° C. and at a relatively high pressure. Among these, zeolites are acid catalysts that have exhibited exceptional olefin dimerization performance. The process intensification approach described herein may enable a dehydrogenative coupling reaction that surpasses the thermodynamically-limited dehydrogenation activity at moderate temperatures by consuming the isobutene product via acid-catalyzed coupling as it is produced. This dehydrogenative coupling reaction could enable increased per-pass yield of jet range HCs ($C_{8+}$) in a single reactor versus two reactors in a series, where the first reactor (dehydrogenation) suffers from the thermodynamic limitation. Here, we report our baseline catalytic assessment for the dehydrogenative coupling of a feed stream of isobutane to higher molecular weight HCs over a mixed bed (or a mixed catalyst bed) containing a dehydrogenation catalyst and a coupling catalyst.

In experiments, two catalysts were selected that may perform the isobutane dehydrogenation reaction: a Pt-based catalyst (Pt—Sn/$Al_2O_3$ (PSA)) and a Zn-modified BEA zeolite catalyst (Zn/BEA). To facilitate coupling in the catalyst systems studied here, four acid catalysts were selected. BEA zeolite was selected because it has a large enough pore size to accommodate the carbon-carbon coupling reaction and subsequent desorption of large molecular weight products. In zeolites, it was found that lower SAR values (i.e., higher acid site densities) lead to higher coupling activity but faster deactivation rates. Because of this, two BEA catalysts with SAR values of approximately 27 and approximately 150 were evaluated to investigated the role of acid site density on product selectivity. Two non-zeolite acid catalysts, $WO_3$—$ZrO_3$ and $SiO_2$—$Al_2O_3$, were also evaluated to compare the performance of non-porous acid catalysts to the microporous zeolite.

In some embodiments, in addition to the desired dehydrogenative coupling of isobutane to produce $C_{8+}$ HCs via an isobutene intermediate, isomerization and cracking side-reactions may occur. The reaction network is shown in FIG. 1. Isomerization of isobutane forms linear butane, and similarly, isomerization of isobutene produces three butene isomers, 1-butene, trans-2-butene, and cis-2-butene. All of the olefins may undergo acid-catalyzed coupling to form the desired $C_{8+}$ linear and branched HCs. Undesired cracking reactions may occur throughout the pathway yielding $C_{5-7}$ HCs and light HCs including methane, ethane, ethylene, propane, and propylene. A preferred dehydrogenation catalyst may favor isobutene formation without cracking to these light HCs. Similarly, a preferred coupling catalyst may favor C—C bond formation without cracking the heavier product back to smaller compounds.

Bench-scale experimentation was done for catalytic evaluation of the dehydrogenation catalyst in a microscale reactor at approximately atmospheric pressure and temperatures in the range of approximately 200° C. to approximately 450° C. using an approximately 1% isobutane, approximately 1% argon, and approximately 98% nitrogen feed stream at a weight hourly space velocity of approximately 0.20 gisobutane $g_{cat}^{-1}h^{-1}$. The reactor effluent was evaluated using gas chromatography in a gas chromatographer having 4 columns containing up to 6 carbons. The products were grouped by reaction type and the resulting data is shown in FIGS. 2A-B.

Figure 2A:
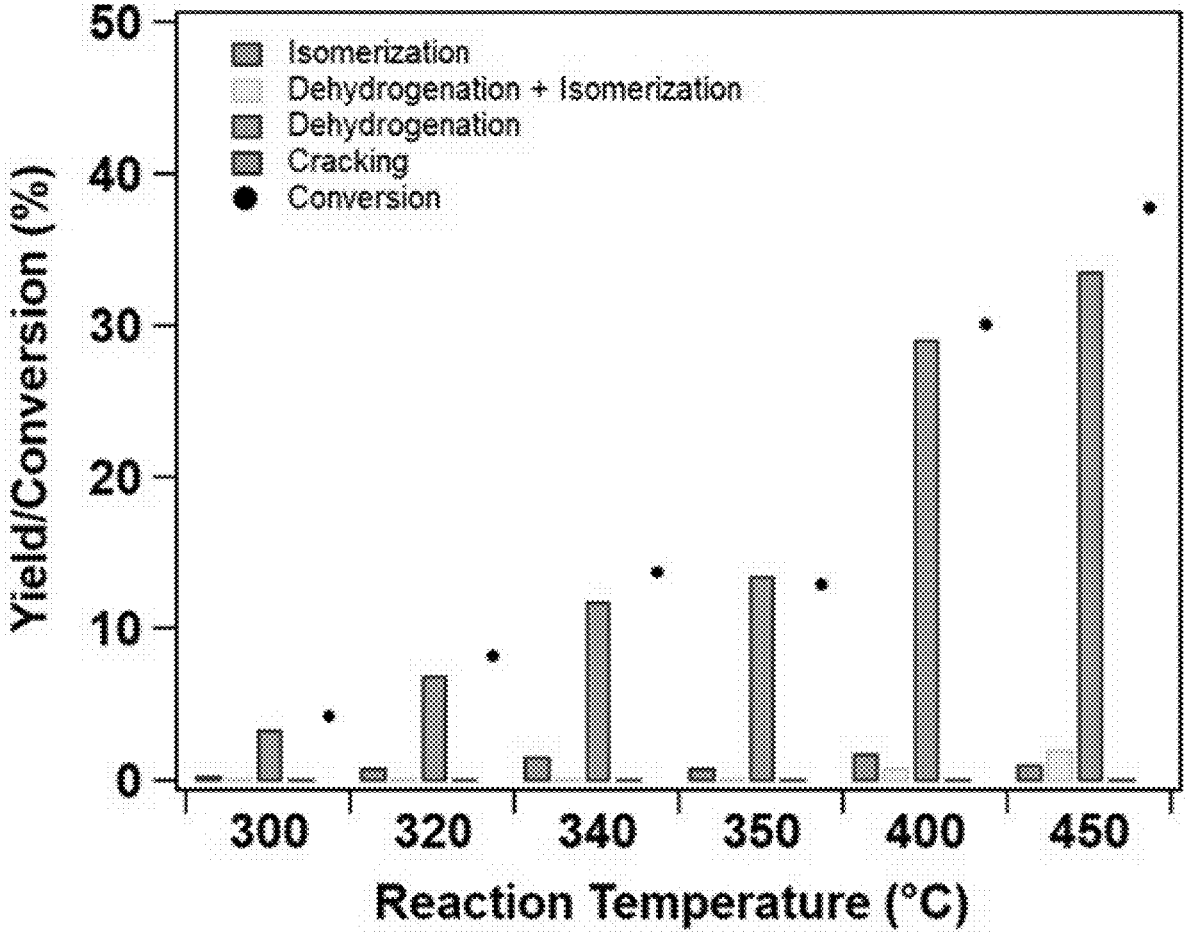
FIG. 2A illustrates conversion and product yields from the isobutane dehydrogenation reaction over 500 mg of PSA at approximately atmospheric pressure and varying reaction temperatures.
Figure 2B:
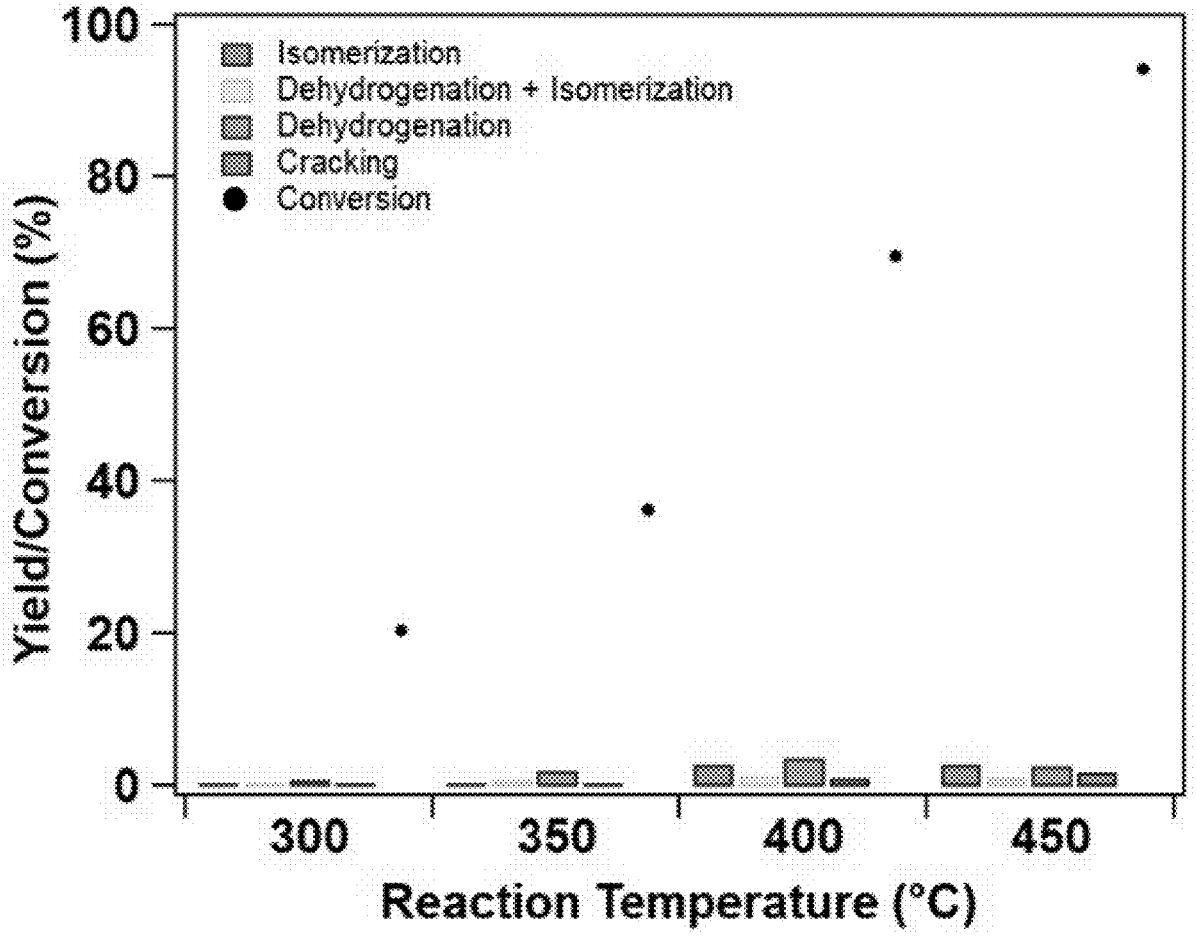
FIG. 2B illustrates conversion and product yields from the isobutane dehydrogenation reaction over 500 mg of Zn/BEA (SAR 27) at approximately atmospheric pressure and varying reaction temperatures, according to some aspects of the present disclosure.

FIGS. 2A-B illustrates conversion and product yields from the isobutane dehydrogenation reaction over 500 mg of PSA (in FIG. 2A) and Zn/BEA (SAR 27) (in FIG. 2B) at approximately atmospheric pressure and varying reaction temperatures, according to some aspects of the present disclosure. The feed stream used was approximately 6.5 sccm of approximately 1% isobutane, approximately 1% argon, and approximately 98% nitrogen. However, in some embodiments, the feed stream could include any C4-C8 branched hydrocarbon. For PSA (FIG. 2A) isobutane conversion and the total product yield increased with temperature. the total product yield was approximately equal to the conversion at all reaction temperatures, indicating that all products were detected and identified. Further, experiments performed over a range of space velocities indicated that the conversion was near the thermodynamic equilibrium limit at each reaction temperature. The equilibrium conversion values in the temperature range of interest are listed in Table 1. The PSA dehydrogenation catalyst, isobutene was favored at the majority of reaction temperatures explored here. Under these conditions, the selectivity to isobutene was above approximately 95%. Low yields (less than approximately 5%) to isomerization and cracking products were observed above approximately 300° C.). Reaction temperatures less than approximately 300° C. were also evaluated, but the conversion was less than approximately 2% and low dehydrogenation yields were observed.

TABLE 1

Equilibrium conversion values for the dehydrogenation of 1% isobutane at temperatures of interest to the reaction data presented here.

| Temperature (° C.) | Equilibrium Conversion (%) |
|---|---|
| 300 | 7 |
| 350 | 12 |
| 400 | 18 |
| 450 | 29 |

For Zn/BEA (SAR 27) at reaction temperatures between approximately 300° C. and approximately 450° C., relatively low yields (less than about 5%) to light HC products were observed with isobutene (approximately 3% yield). Compared to PSA, a lower yield of isobutene was observed from Zn/BEA at the majority of reaction conditions, and there was a great yield of isomerized $C_4$ products, likely due to the acidic nature of the BEA support. As the reaction temperature increased, the conversion approached approximately 100%, although the product yields remained below approximately 5%, indicating that most products were not detected. Undetected products may include deposited coke, especially at high temperatures, but may also include desired higher molecular weight products ($C_{6+}$) that could not be or were not detected by the microgas chromatographer.

In some embodiments, dehydrogenative coupling of isobutane to higher molecular weight HCs in a single reactor was evaluated in an approximately ½ inch diameter stainless steel reactor applying approximately 1% isobutane, approximately 1% argon, and approximately 98% nitrogen at temperatures in the range of approximately 240° C. to approximately 400° C. and pressures from approximately atmospheric to approximately 100 psig. Two types of catalysts were evaluated (see Table 2): a mixed bed containing approximately 1 g PSA with approximately 0.5 g coupling catalyst (e.g., BEA, $SiO_2$—$AlO_3$, $WO_3$—$ZrO_2$), diluted with approximately 1.5 g of SiC and 2) a mixed bed containing approximately 1 g Zn/BEA or Zn/$SiO_2$—$Al_2O_3$ diluted with approximately 2 g of SiC. Prior to each reaction, the catalyst bed was pretreated at approximately 350° C. in approximately 75 sccm of hydrogen and the reactor was allowed to cool to approximately room temperature in hydrogen before flowing the isobutane gas mixture.

TABLE 2

Dehydrogenation and coupling components evaluated in mixed bed configuration for the dehydrogenative coupling of isobutane to $C_{8+}$ HCs. Coupling catalysts in parentheses are a component of the associated dehydrogenation catalyst.

| Catalyst System | Dehydrogenation | Coupling |
|---|---|---|
| 01 | Pt—Sn/$Al_2O_3$ | (none) |
| 02 | Pt—Sn/$Al_2O_3$ | H—BEA (SAR 150) |
| 03 | Pt—Sn/$Al_2O_3$ | $SiO_2$—$Al_2O_3$ |
| 04 | Pt—Sn/$Al_2O_3$ | $WO_3$—$ZrO_2$ |
| 05 | Zn/BEA-27 | (BEA (SAR 27)) |
| 06 | Zn/BEA-150 | (BEA (SAR 150)) |
| 07 | Zn/$SiO_2$—$Al_2O_3$ | ($SiO_2$—$Al_2O_3$) |

The conversion and product selectivity observed over PSA (catalyst system 01) in these experiments were consistent with those observed in the microreactor-greater than approximately 90% selectivity to isobutene was obtained without significant evidence of coupling chemistry observed (i.e., no $C_{8+}$ products were observed). Reaction temperatures between 240° C. and 300° C. were evaluated and conversions between approximately 0.5% and approximately 6% were obtained. These data indicate that the alumina in PSA does not provide the necessary acid sites to perform coupling under these conditions and that a different coupling component may be needed. When catalyst systems 02-07 were evaluated at reaction temperatures below approximately 300° C., isobutene conversion was less than approximately 5%. Therefore, reaction temperatures of approximately 300° C. and above are the focus of this present disclosure.

Under the tested reaction conditions, the thermodynamic equilibrium limit for isobutane conversion to isobutene appeared to be approximately 7% at approximately 300° C. and approximately 18% at approximately 400° C. (see Table 1). Catalyst systems employing a coupling catalyst with the PSA catalyst resulted in conversions near or slightly exceeding the predicted thermodynamic limit (see FIGS. 3A-F). However, conversions of up to approximately 33% were observed at approximately 400° C. over Zn/BEA (SAR 27) (see FIG. 3D), indicating that the equilibrium conversion of isobutane may be surpassed due to the concurrent consumption of isobutene in the coupling reaction.

Due to the low isobutane concentration in the feed stream gas (approximately 1%), the resulting low product concentrations were challenging to detect and identify using mass spectrometry. To determine an approximate retention time for heavy products and aid product assignments, the headspace gas of several high molecular weight compounds was manually injected into the gas chromatographer. The $C_8$ compound, 1-octene, eluted from the column at approximately 9.1 min, and therefore, all products observed at higher retention times were considered as $C_8$ hydrocarbons. Products from the dehydrogenative coupling reactions were grouped as light HCs (i.e., methane, ethane, ethylene, propane, and propylene), $C_{5+}$ HCs, and $C_{8+}$ HCs (see FIGS. 3A-F). All selectivity values are $C_{4-}$ free (i.e., $C_4$ paraffins and olefins were not counted as products in the selectivity calculations) since isobutane and butene isomers were considered as intermediates in the cascade reaction to form higher HCs.

For the catalyst system containing PSA physically mixed with a coupling catalyst, higher reaction temperatures appeared to lead to increased conversion and higher reactor pressure, which appeared to lead to an increase in $C_{8+}$ selectivity. For Pt—Sn/$Al_2O_3$+ HBEA-150 (FIG. 3A), $C_{8+}$ HCs were first observed with an approximate 5% selectivity at approximately 300° C. and approximately 50 psig (leading to an approximately 3% isobutane conversion). An increase in temperature to approximately 350° C. at approximately 50 psig lead to increased conversion (i.e., approximately 6%) and $C_{8+}$ selectivity to approximately 16%. At approximately 350° C. and approximately 75 psig, approximately 20% $C_{8+}$ selectivity was obtained at approximately 7% conversion. The $C_3$ selectivity changed inversely to the $C_{8+}$ selectivity, decreasing from approximately 60% to approximately 21% with an increased reaction pressure from approximately 0 psig to approximately 50 psig at approximately 300° C., and at approximately 350° C. and approximately 75 psig, $C_3$ selectivity decreased from approximately 30% accompanying the increase in $C_{8+}$ HCs (approximately 20%). For the Pt—Sn/$Al_2O_3$+$SiO_2$—$Al_2O_3$ catalyst system (FIG. 3B), a higher reaction temperature of approximately 350° C. and approximately 50 psig was needed to observe $C_{8+}$ HC formation (approximately 13% selectivity at approximately 9% conversion). An increase in reaction pressure to approximately 95 psig nearly doubled the $C_{8+}$ selectivity to approximately 20% while increasing the conversion slightly to approximately 11%. A further increase in reaction temperature to approximately 400° C. at approximately 50 psig increased the conversion to approximately 14% and resulted in the maximum $C_{8+}$ HC selectivity observed in the Pt—Sn/$Al_2O_3$ system at approximately 31%. The catalyst system containing Pt—Sn/$Al_2O_3$+$WO_3$—$ZrO_2$ was the most difficult to activate among the catalyst systems containing Pt—Sn/$Al_2O_3$, where the first evidence of $C_{8+}$ HCs was observed at approximately 400° C. and approximately 95 psig (see FIG. 3C). At these conditions, approximately 20% conversion was obtained with approximately 17% selectivity to $C_{8+}$ HCs. For all three systems, the $C_{5+}$ selectivities reach nearly 80% suggesting that coupling occurs with high selectivity, but the higher molecular weight HCs crack to lower molecular weight HCs under these conditions. Due to reactor limitations, the influence of reaction pressures above approximately 95 psig could not be investigated in this present disclosure. However, the results from combining a coupling catalyst with Pt—Sn/$Al_2O_3$ suggest that $C_{8+}$ selectivity could be further promoted with higher reaction pressure, and importantly, with a concomitant reduction in the unwanted cracking reaction selectivity.

For the catalyst systems containing PSA as the dehydrogenation component, $C_{8+}$ HCs were successfully formed in each system, but each system required different reaction conditions. Despite comparable acid site densities, the Pt—Sn/$Al_2O_3$+ HBEA-150 formed $C_{8+}$ HCs at lower reaction temperatures than Pt—Sn/$Al_2O_3$ with Sn/$Al_2O_3$ or $WO_3$—$ZrO_2$. Thus, the number of acid sites determined by $NH_3$-TPD does not trend with their performance. The observed activity could be due to the strength of the acid sites in the coupling component. Typically, the Brønsted acid sites on BEA zeolite are considered stronger than the Brønsted and Lewis acid sites of non-zeolite materials $SiO_2$—$Al_2O_3$ and $WO_3$—$ZrO_2$, as described in some embodiments herein. The lower temperature onset for $C_{8+}$ formation over $SiO_2$—$Al_2O_3$ suggests that this material may have stronger acid sites than $WO_3$—$ZrO_2$.

The role of pressure in these catalyst systems was investigated when the reactor's temperature was held constant at approximately 400° C., where the highest conversion was observed (see FIGS. 4A-D). Increasing reactor pressure led to increasing conversion. Higher pressures also led to a slight increase in the selectivity of $C_{8+}$ HCs, accompanied by a decrease in $C_3$. HC formation. This appears to show that carbon coupling is promoted at higher reaction temperatures. To further promote coupling, catalyst system 03 (PSA+SiAl), was re-evaluated with a 1:2 mass ratio of PSA:SiAl (denoted with a star in FIGS. 4A-D). At approximately 400° C. and approximately 95 psig, the conversion was approximately 5.5% with approximately 52.7% selectivity to $C_{3-}$ HCs and approximately 47.4% selectivity to $C_{5+}$ HCs. Under these conditions, there was approximately 28.7% selectivity to $C_{8+}$ HCs. Increasing the amount of the SiAl coupling component in the reactor relative to PSA did not significantly impact the resulting product distribution, likely because the PSA activity for converting isobutane to isobutene remains unchanged. Adding more coupling component did not appear to aid the conversion of the resulting isobutene, possibly because it is present in a low concentration (approximately 0.2%).

Thus, the reactor pressure was identified as an important variable enabling increased isobutane conversion and $C_{8+}$ selectivity. To evaluate the role of the partial pressure of isobutane on catalyst performance, an approximately 20% isobutane, approximately 2% Ar in an $N_2$ tank was used to achieve isobutane concentrations of approximately 10%, approximately 15% and approximately 20%. This study was performed on the PSA+$SiO_2$—$Al_2O_3$ catalyst system, which was identified as the catalyst system (03) yielding the highest $C_{8+}$ HC selectivity. The resulting conversions and $C_{4-}$ free product distributions for experiments performed at approximately 50 psig (due to tank pressure limitations) are shown in FIGS. 5A-D. In FIGS. 5A-D, data denoted as a star was measured with a total reactor pressure of approximately 100 psig.

These results demonstrate that lower conversion is achieved with approximately 20% isobutane (approximately 5.5% and approximately 400° C.) than approximately 1% isobutane (approximately 13.8% and approximately 400° C.). This could be due to a maximum molar conversion rate per site over the catalyst. However, despite lower conversion, no change in product distribution was observed. In other words, higher concentrations of isobutane in the feed stream did not prevent cracking to $C_3$. HCs, as was predicted. Therefore, it appears that the total reactor pressure is more important than the partial pressure of isobutane for achieving high $C_{8+}$ HC selectivity.

The Zn/BEA catalyst systems demonstrated a different product distribution than those containing PSA (FIGS. 3A-F). BEA is a coupling catalyst and is capable of promote cracking at high reaction temperatures and pressures. For Zn/BEA catalysts, increasing the reaction temperature and pressure both led to increased conversion. For Zn/BEA-27 (greater acid site density), the first evidence of $C_{8+}$ HCs (approximately 6%) was observed at approximately 280° C. and approximately 95 psig. However, under these reaction conditions, there was a high fraction of $C_3$. (approximately 27%) and $C_{5-7}$ HCs (approximately 67%). The observation of high selectivity to $C_{5-7}$ HCs suggests that $C_{8+}$ HCs formed at a comparatively low temperature, but rapidly cracked to shorter HCs. At higher reaction temperature, the $C_{8+}$ selectivity increased only slightly up to approximately 11% at approximately 400° C. The increase in the desired $C_{8+}$ selectivity was accompanied by a decrease in $C_{5+}$ selectivity from approximately 67% at approximately 280° C. to approximately 43% at approximately 400° C., however, there was a substantial increase in the $C_{3-}$ selectivity (greater than approximately 60% at approximately 350° C. and approximately 400° C.), consistent with the known cracking behavior of BEA zeolite at high temperatures noted above.

Figure 3A:
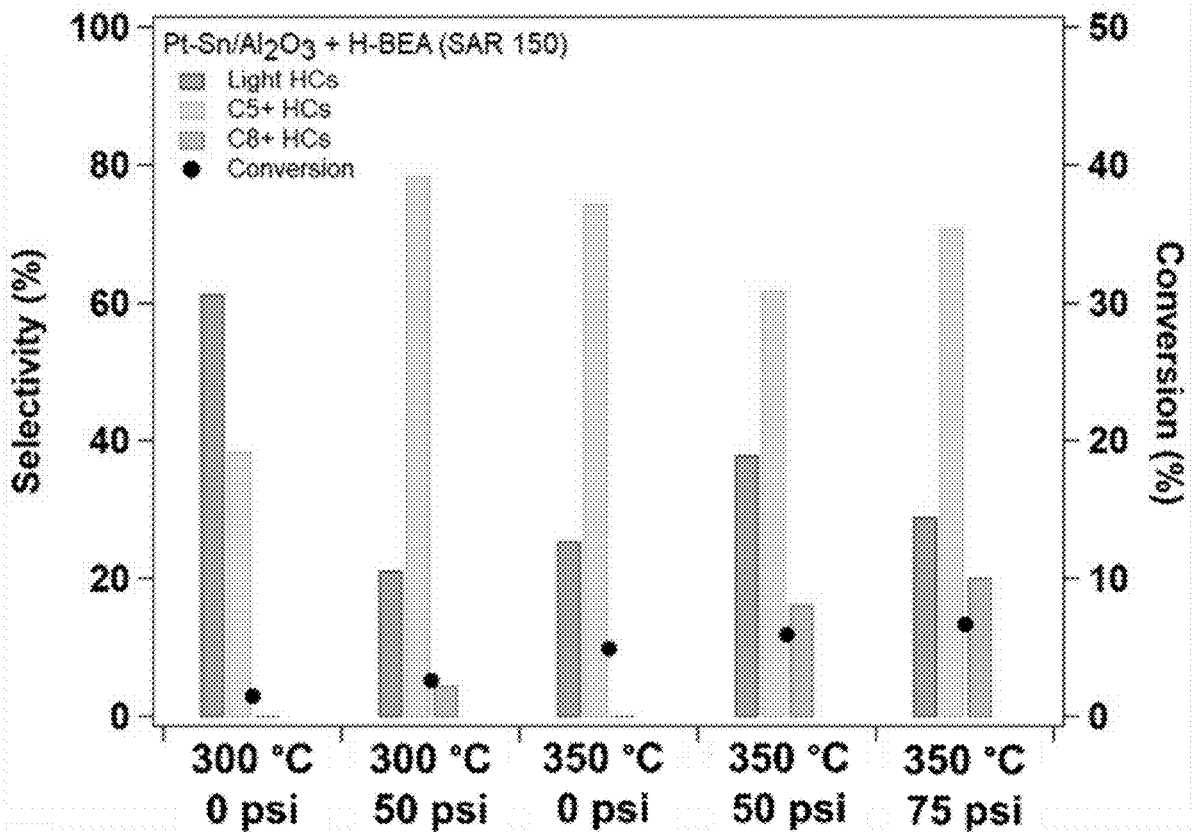
FIGS. 3A-F illustrate the evaluation of isobutane dehydrogenative coupling reactions over catalyst systems
Figure 3B:
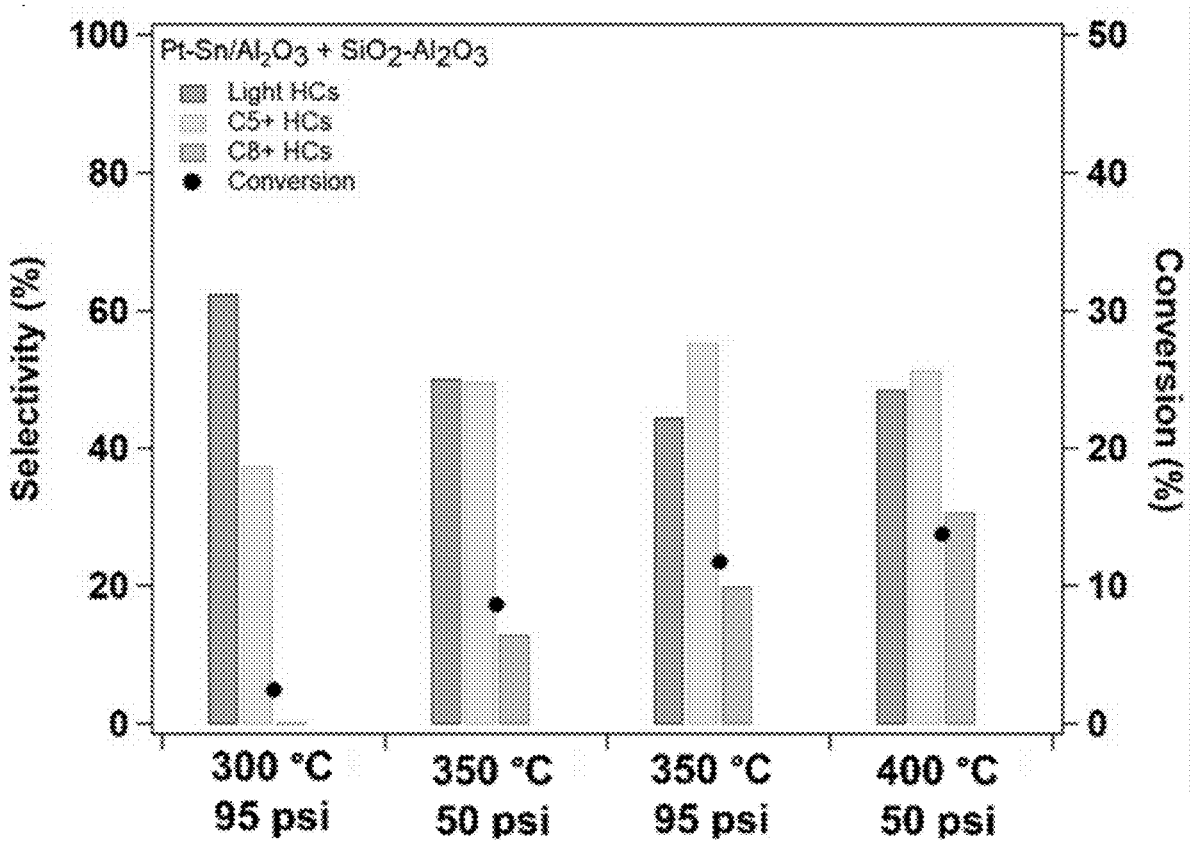
Figure 3C:
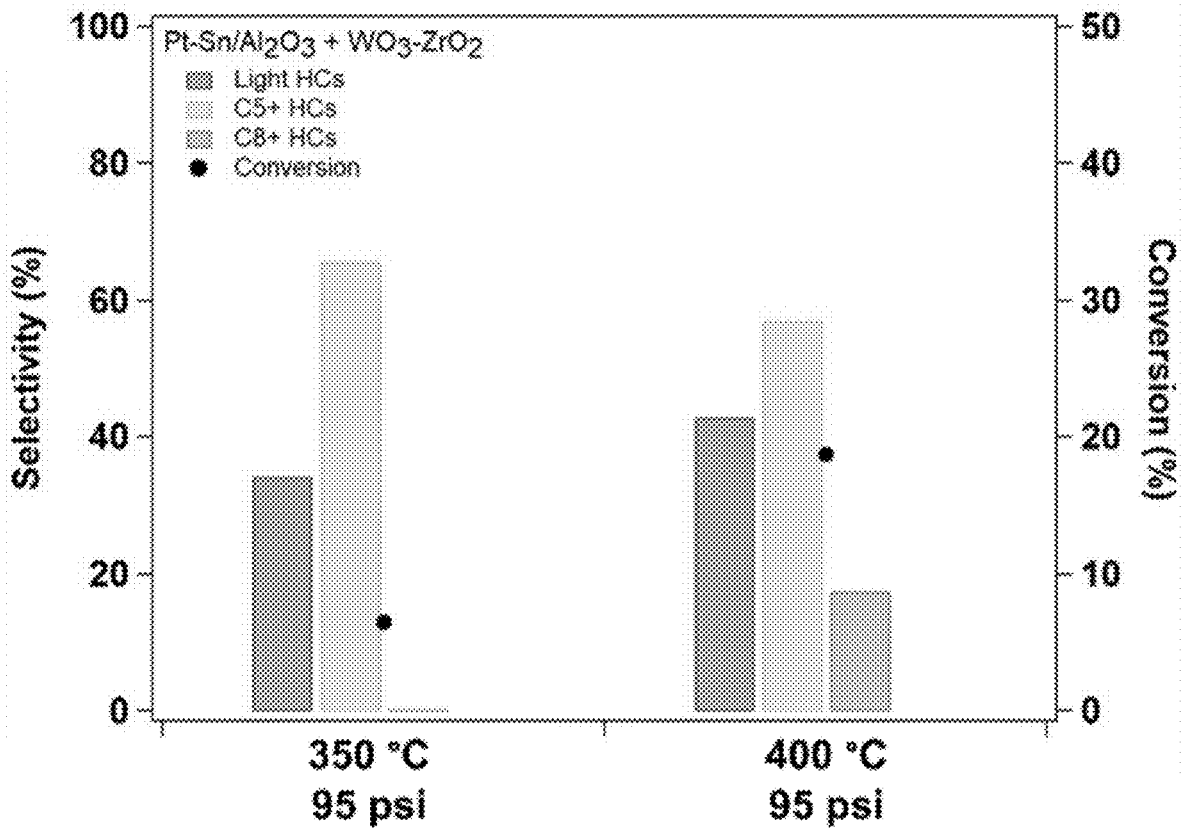
Figure 3D:
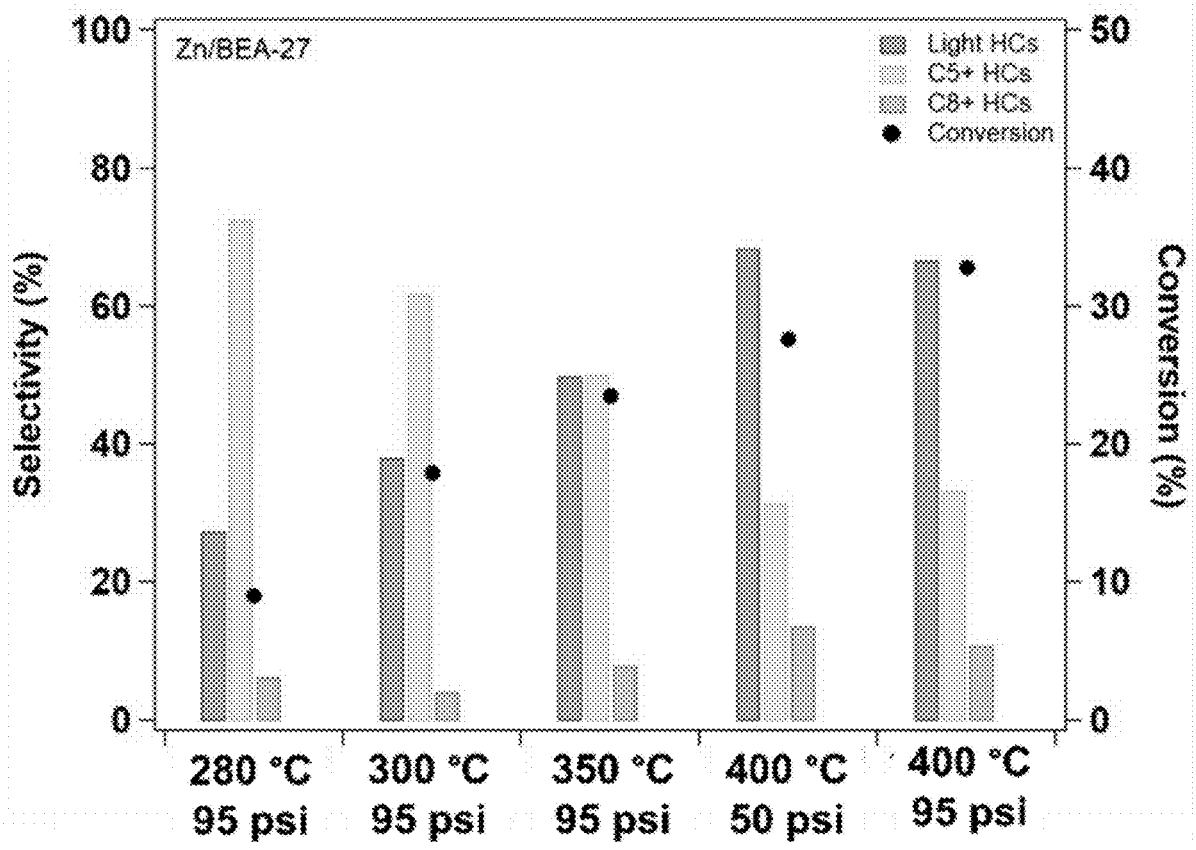
Figure 3E:
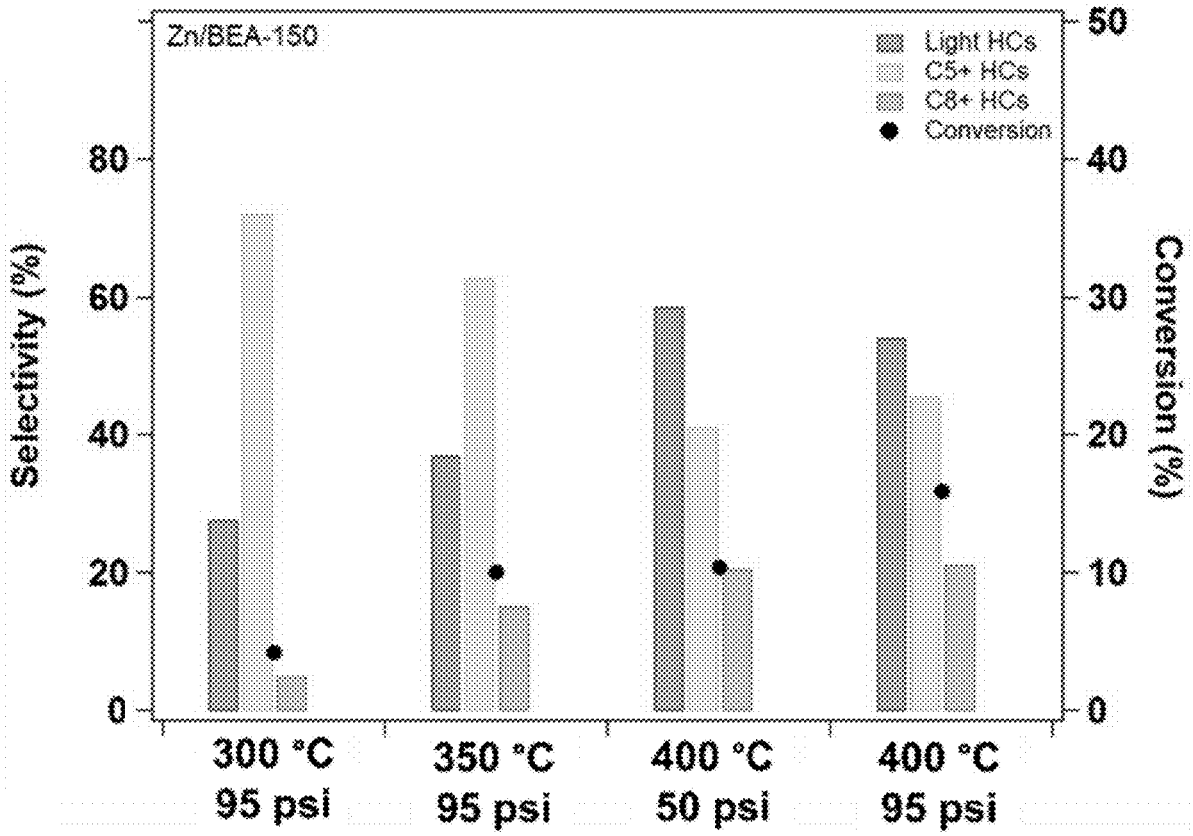
Figure 3F:
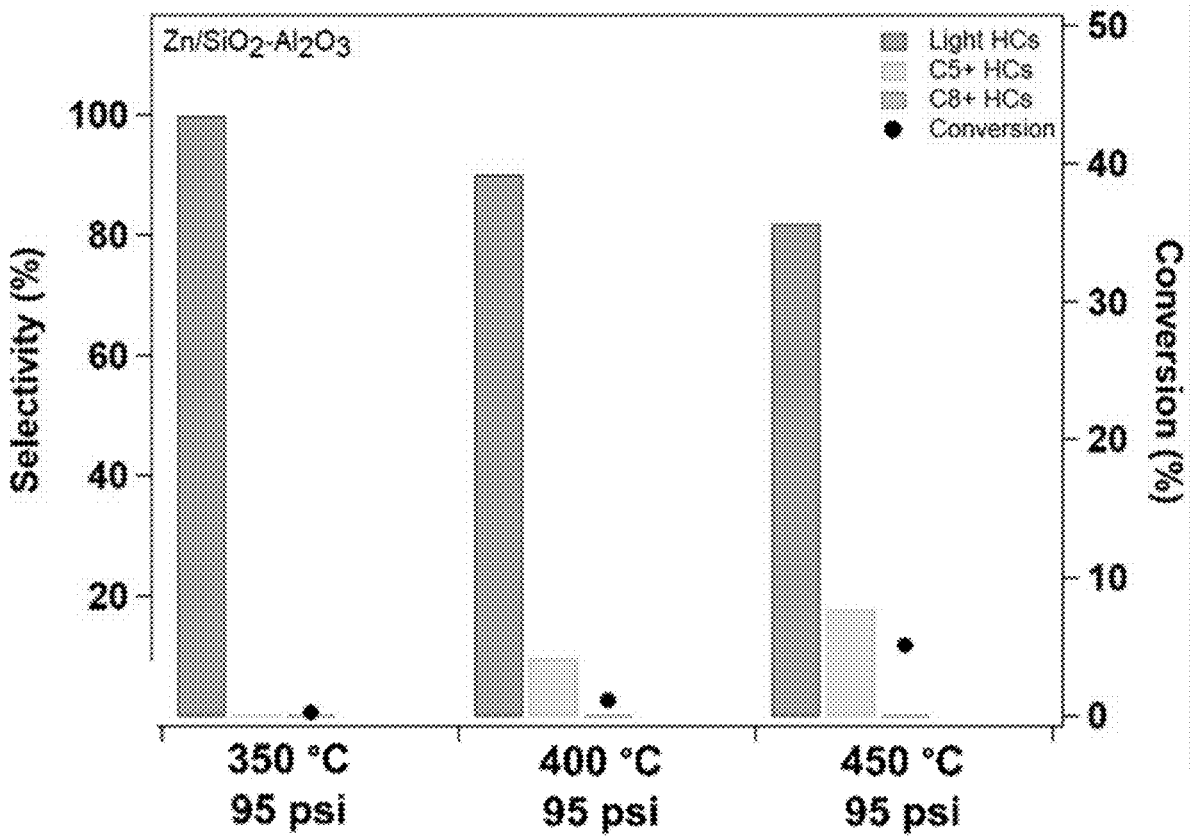
Figure 4A:
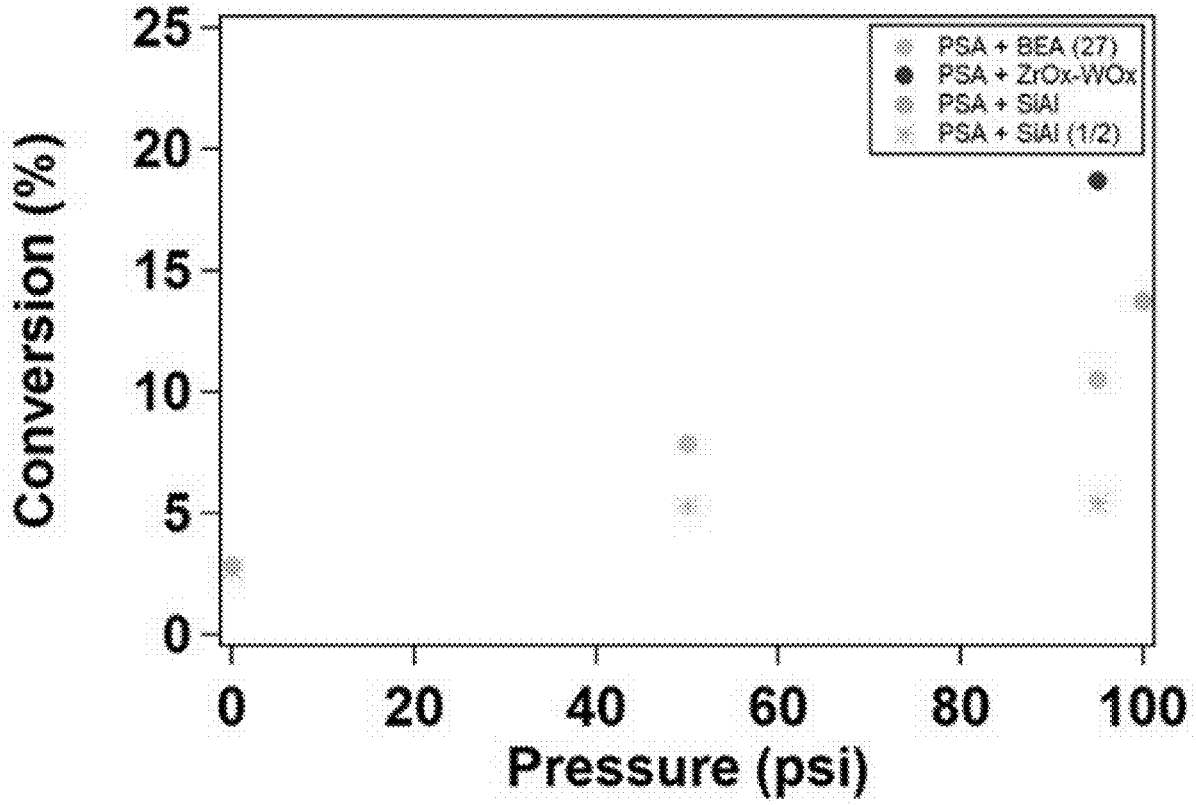
FIGS. 4A-D illustrate dehydrogenative coupling catalyst systems comprising PSA, evaluated at approximately 400° C. where
Figure 4B:
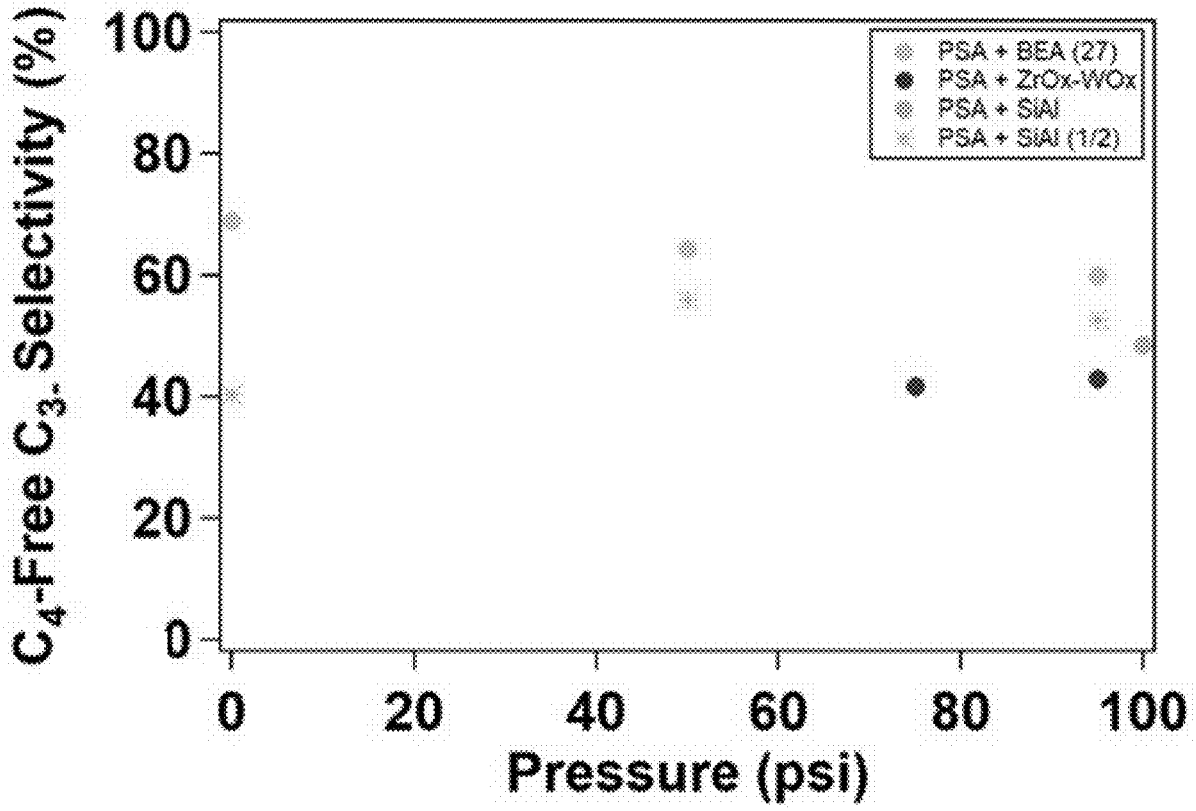
Figure 4C:
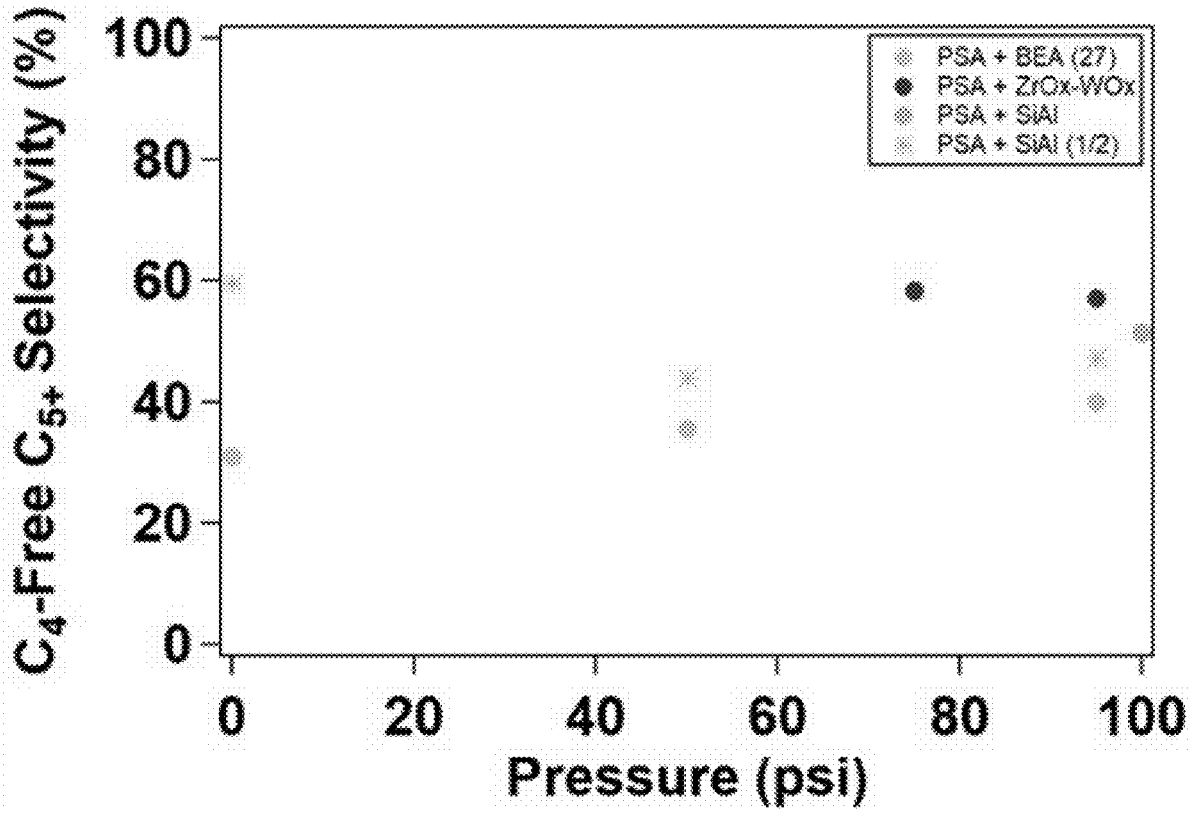
Figure 4D:
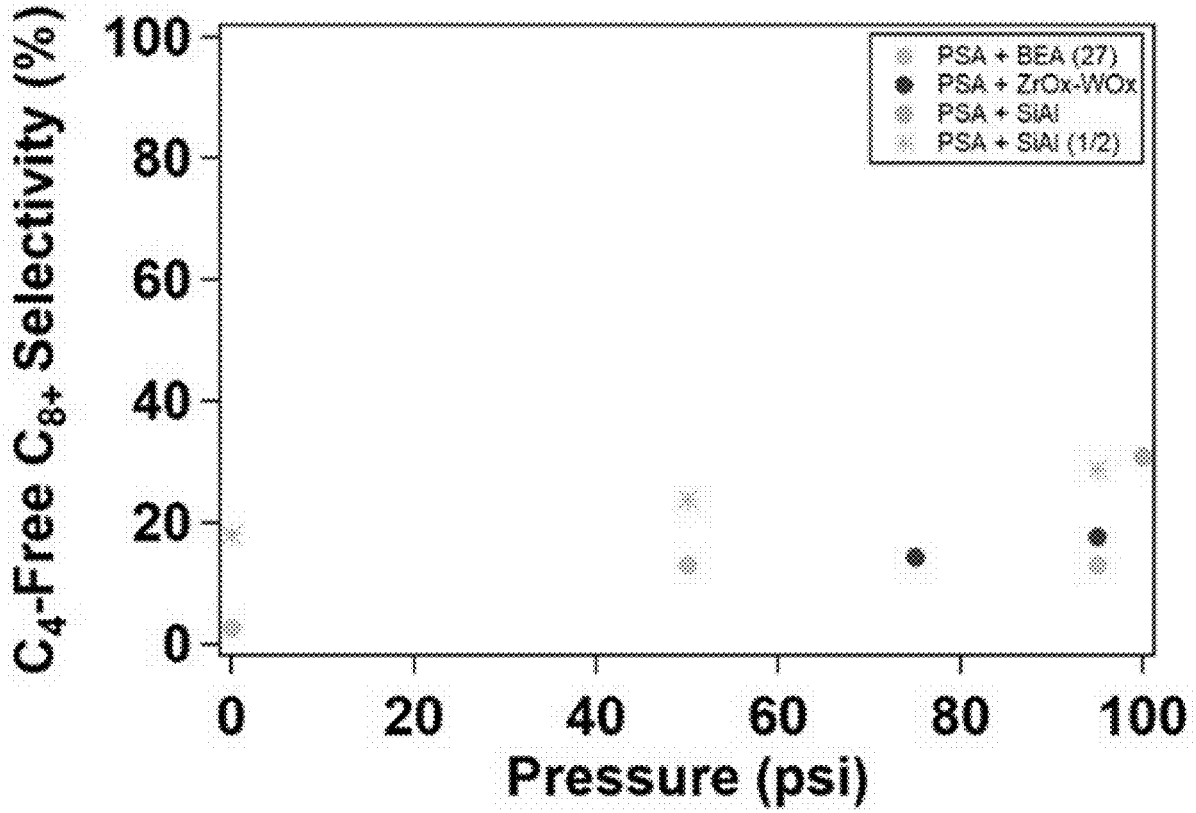
Figure 5A:
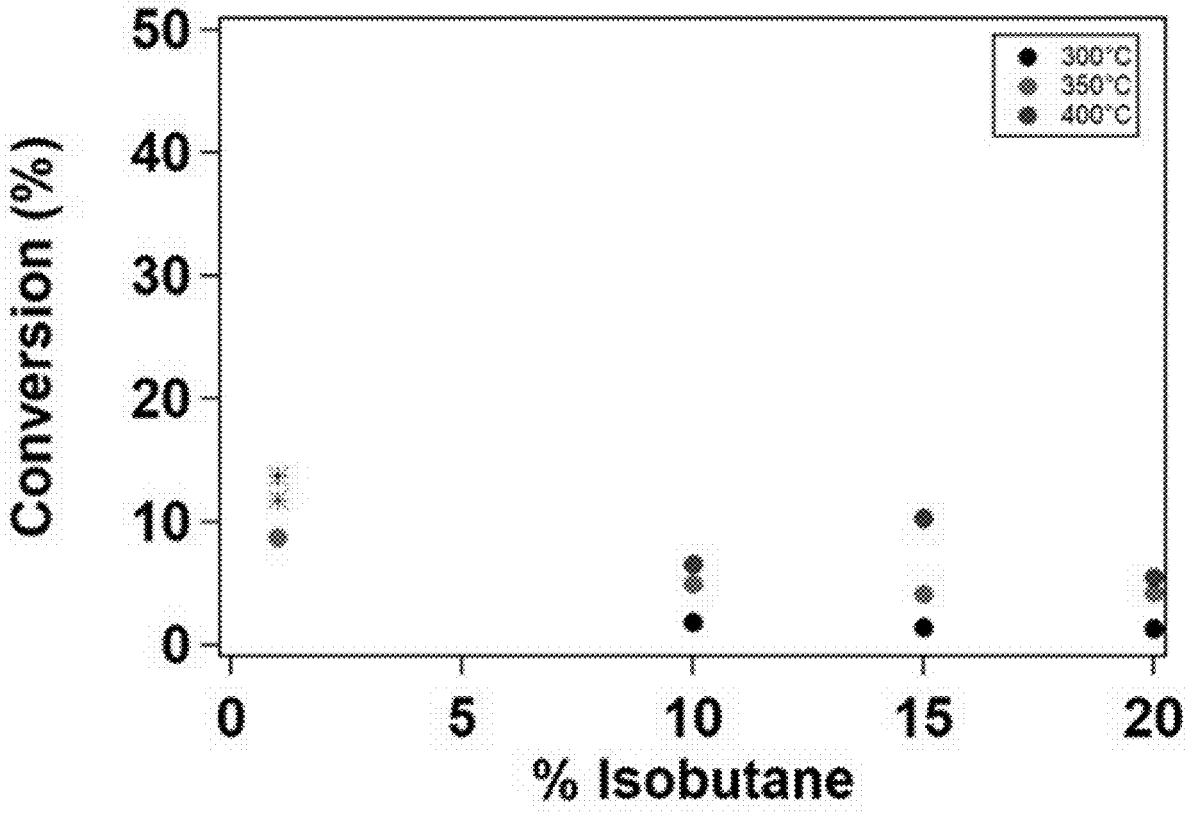
FIGS. 5A-D illustrate dehydrogenative coupling reaction performed over PSA+SiAl in approximately 10%, approximately 15%, and approximately 20% isobutane in Ar/$N_2$, where
Figure 5B:
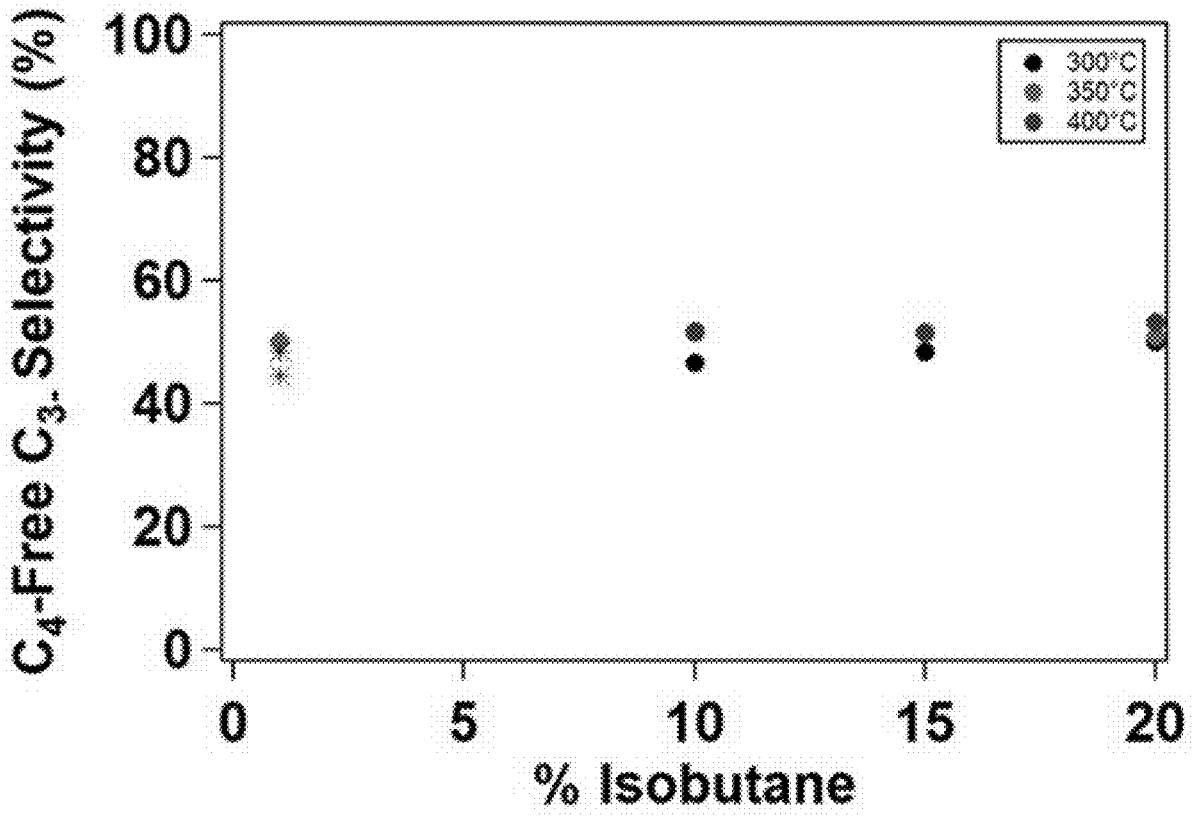
Figure 5C:
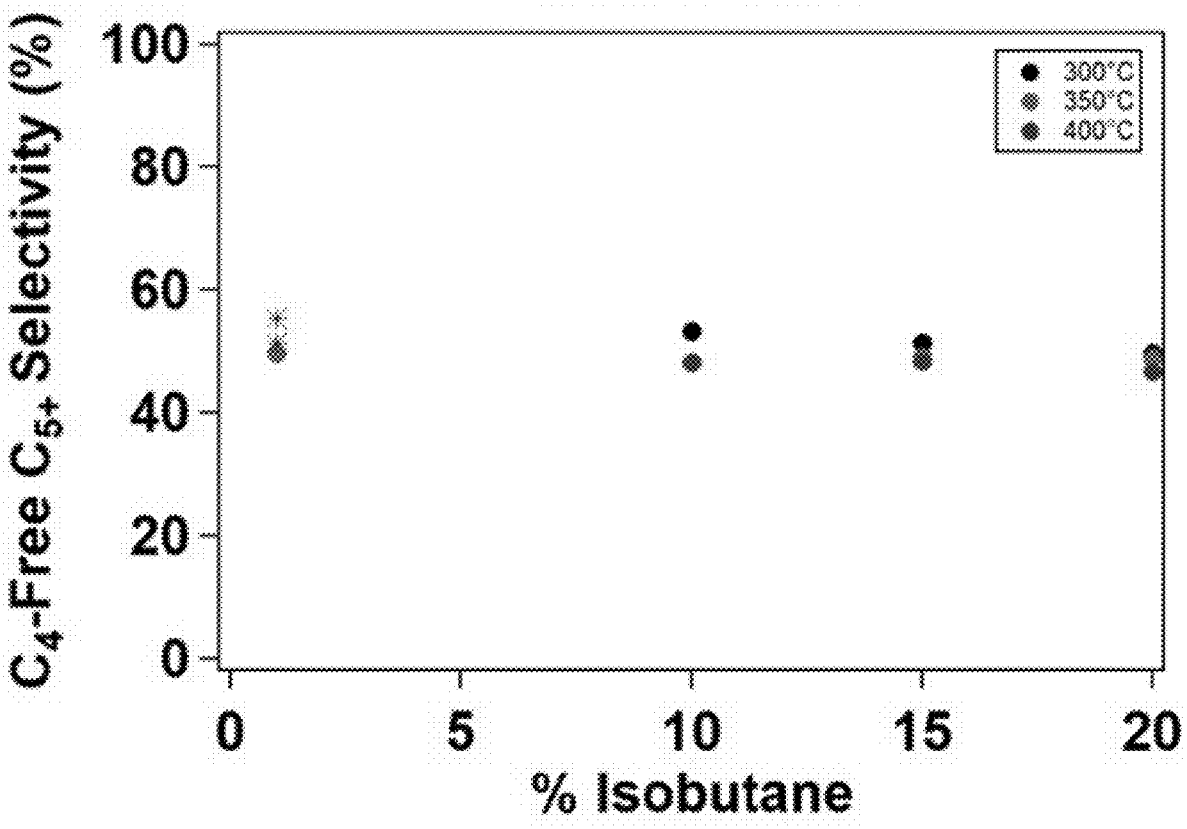
Figure 5D:
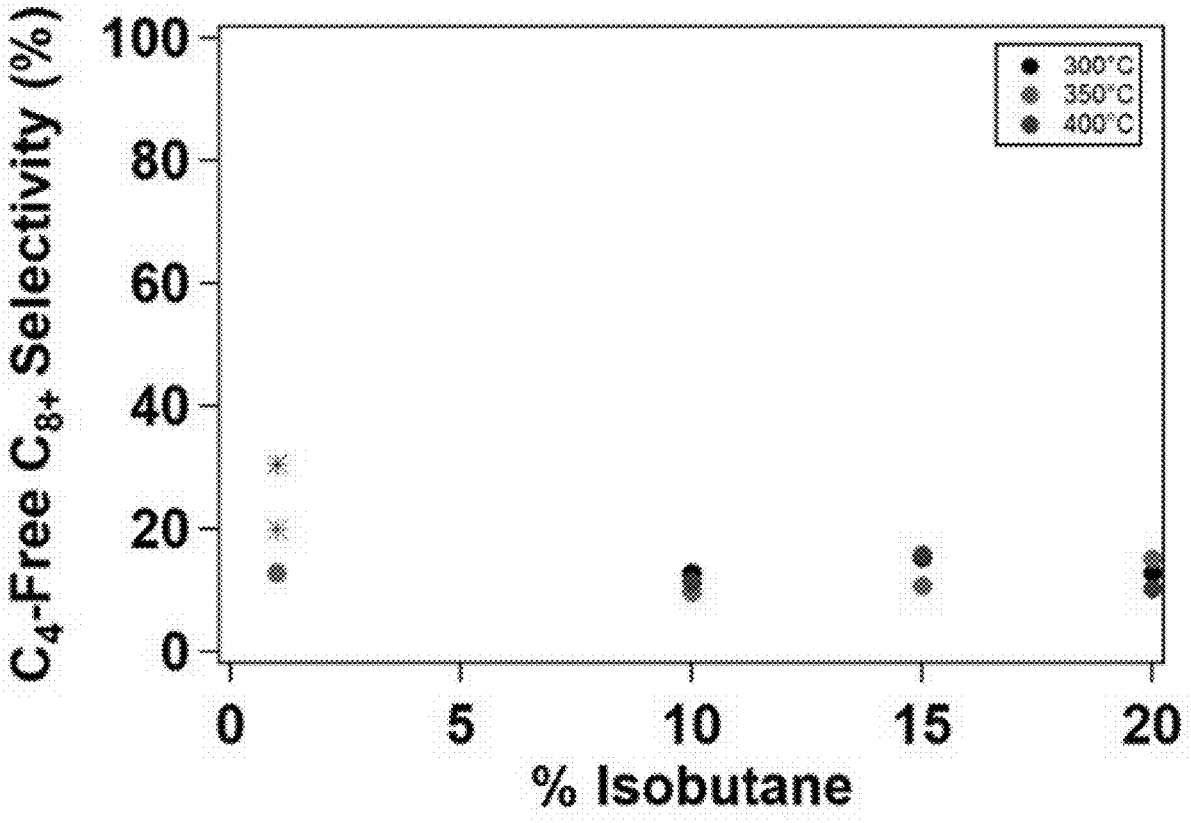
Figure 6A:
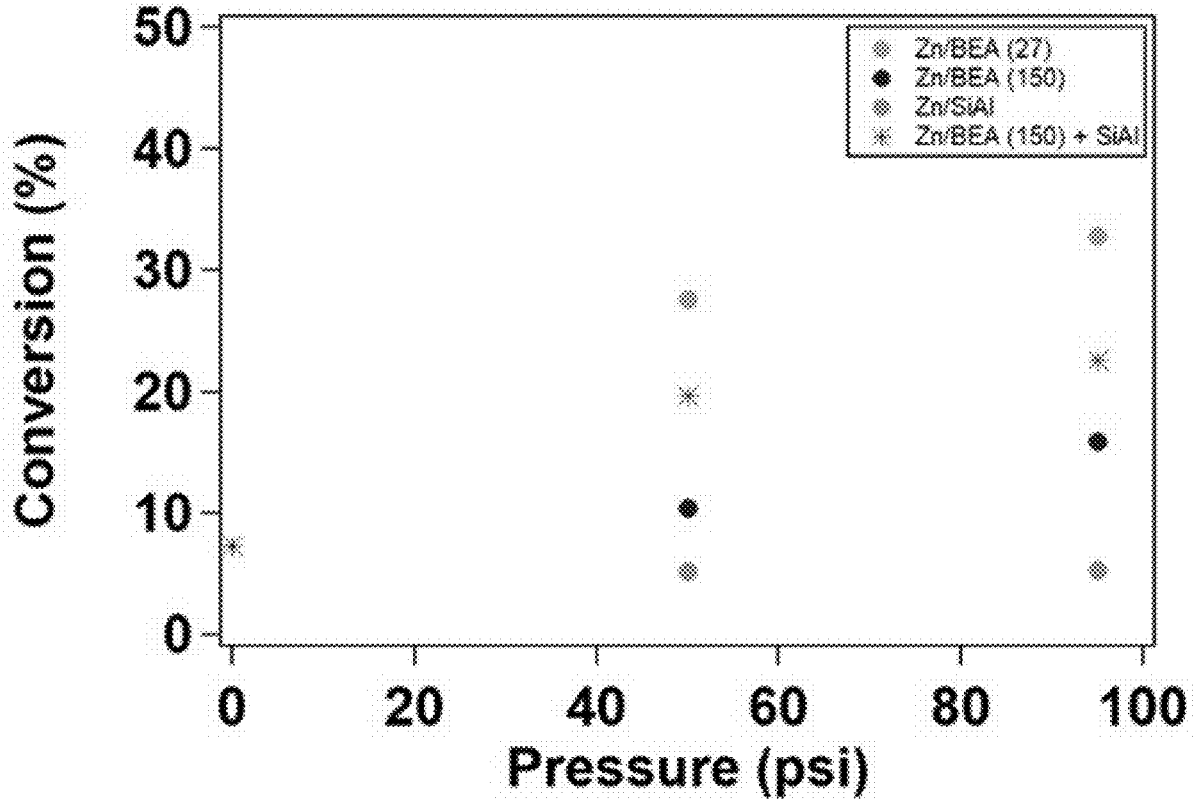
FIGS. 6A-D illustrate dehydrogenative coupling catalyst systems comprising Zn/BEA, evaluated at approximately 400° C., where
Figure 6B:
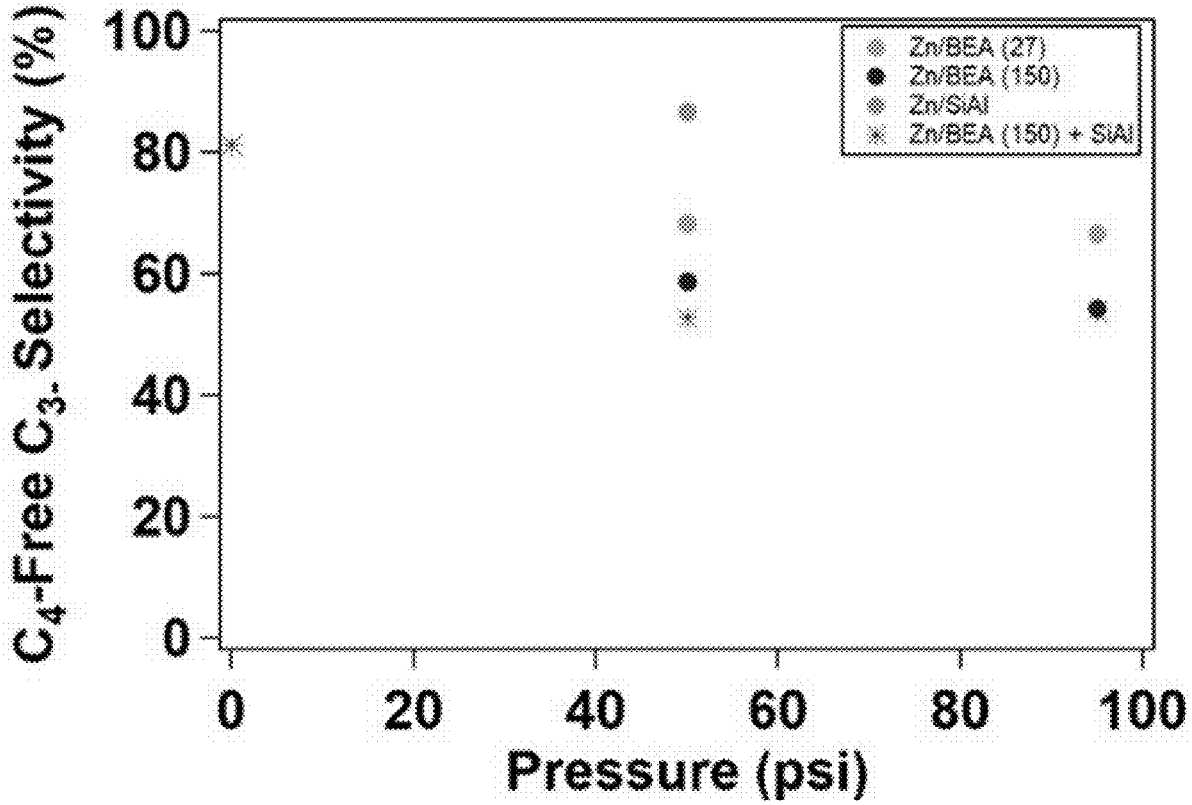
Figure 6C:
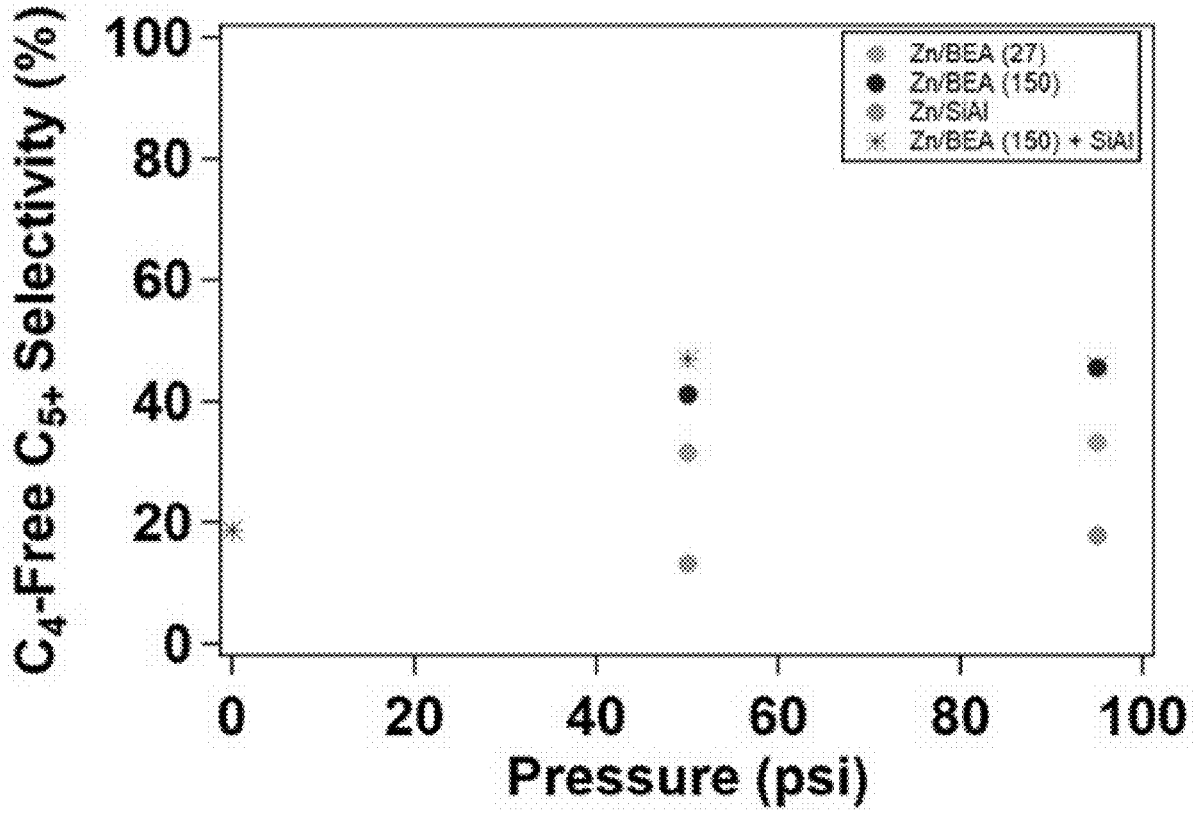
Figure 6D:
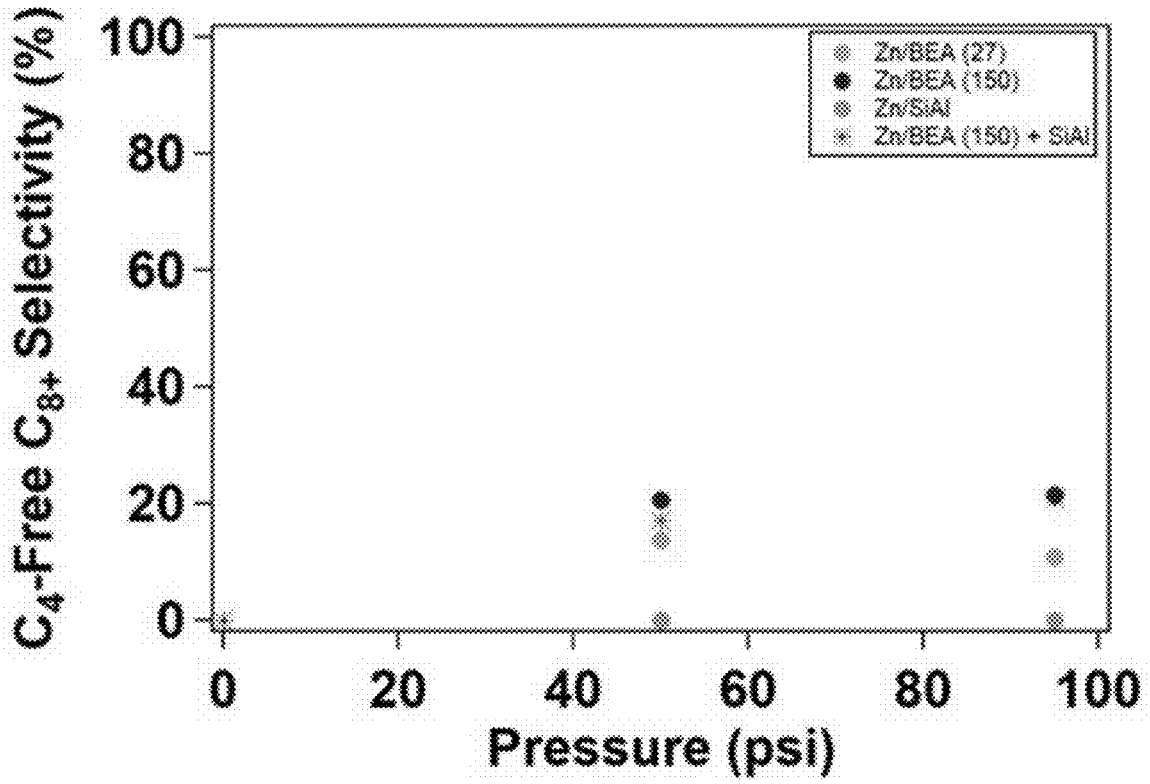
Figure 7A:
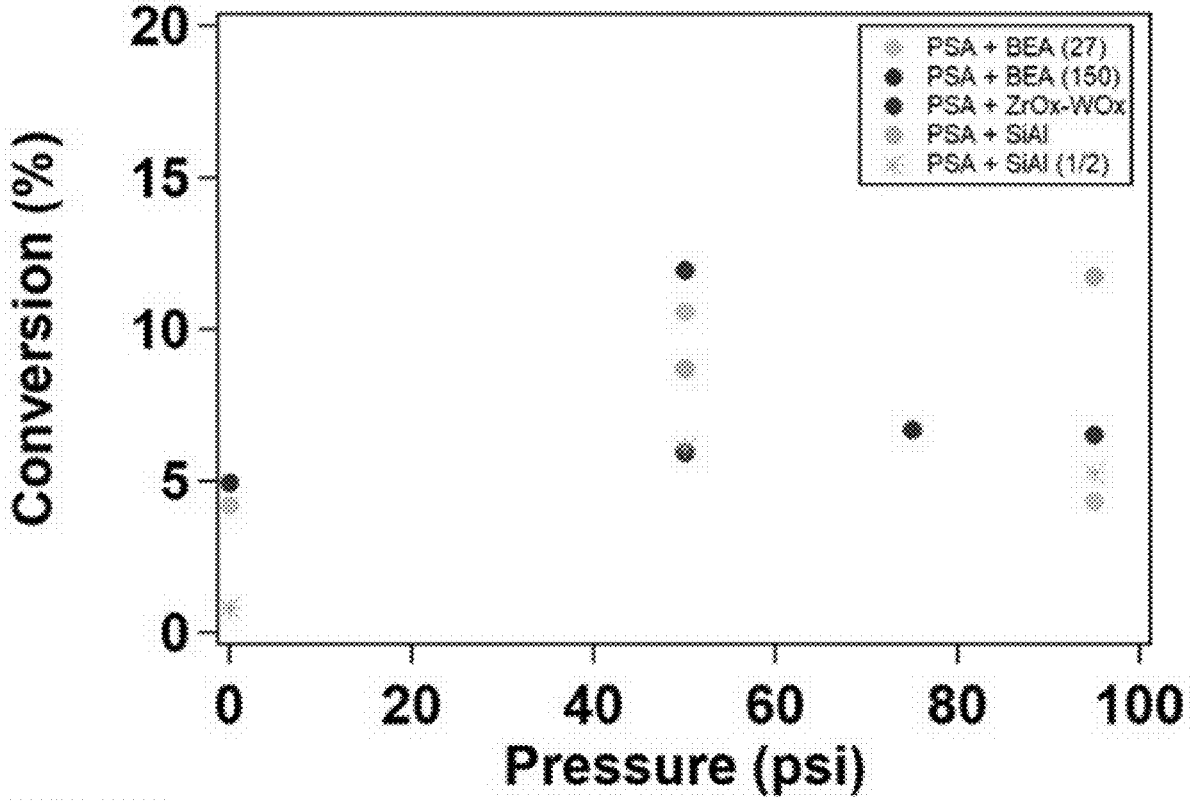
FIGS. 7A-D illustrate dehydrogenative coupling catalyst systems comprising PSA, evaluated at approximately 350° C., where
Figure 7B:
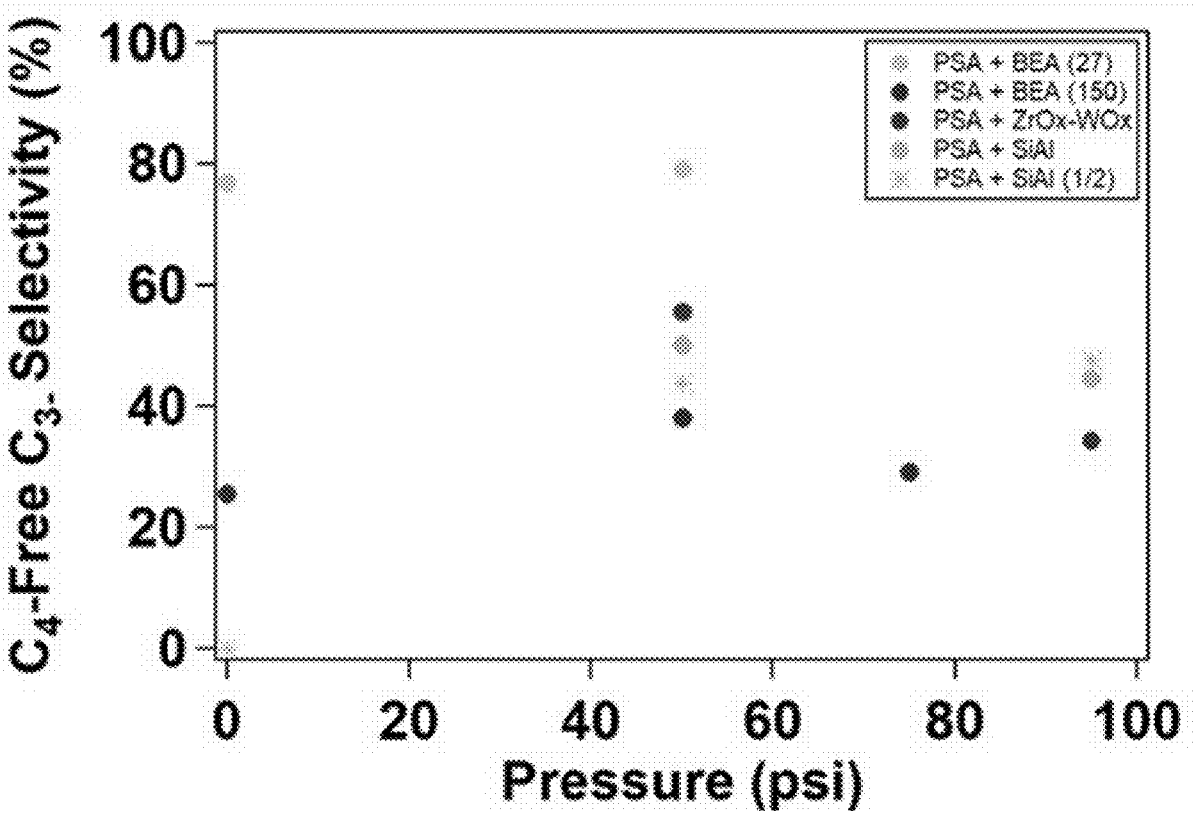
Figure 7C:
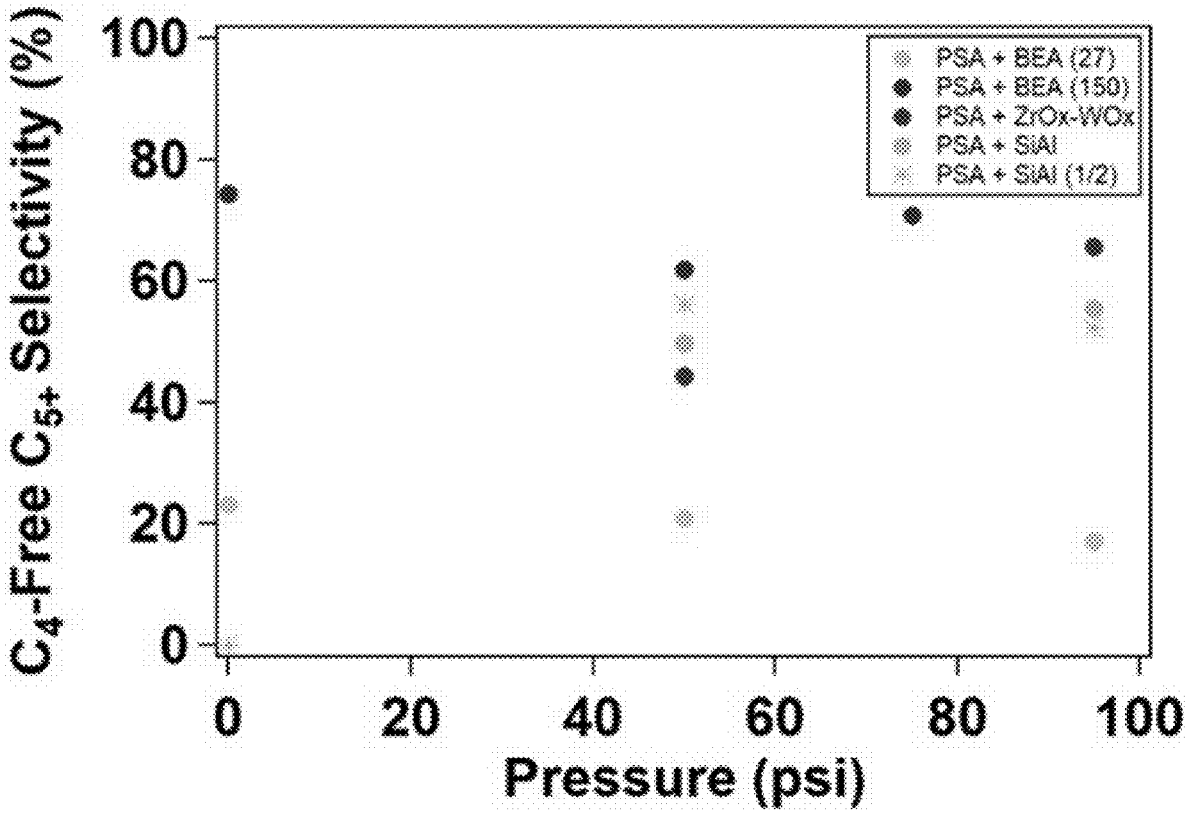
Figure 7D:
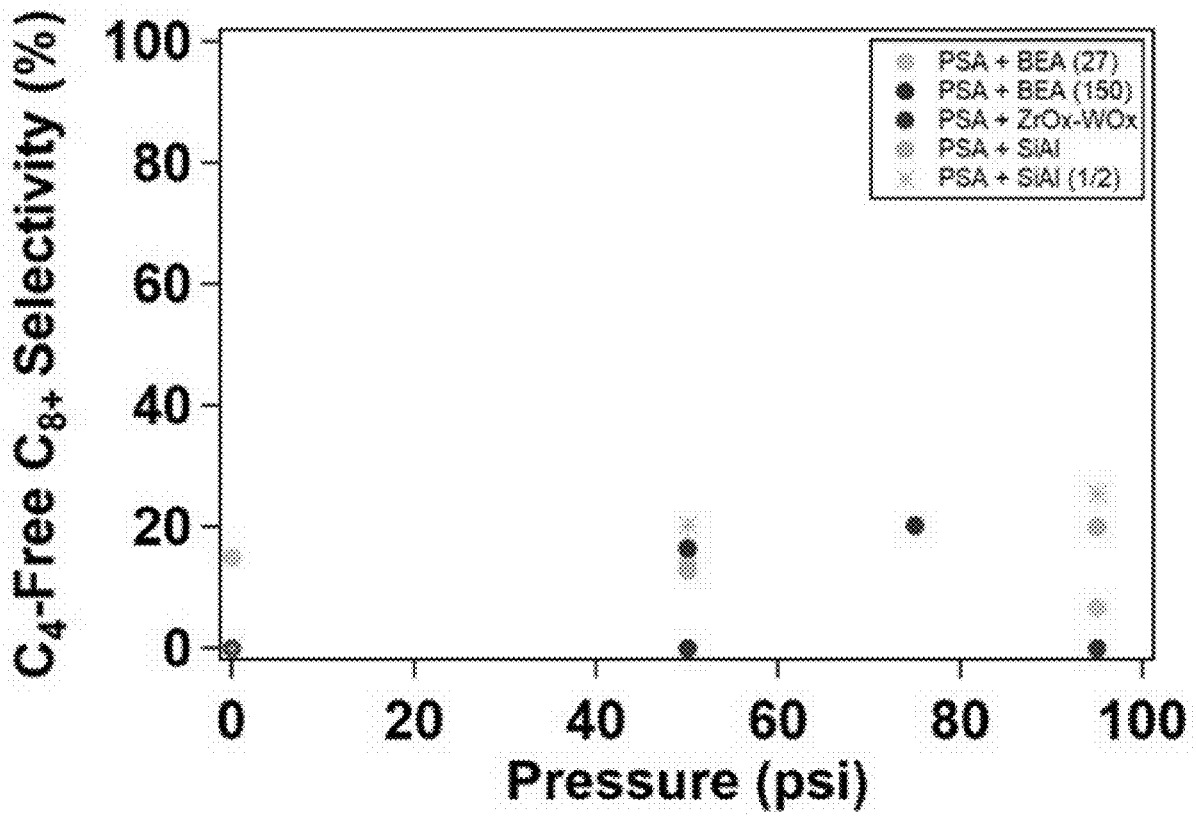
Figure 8A:
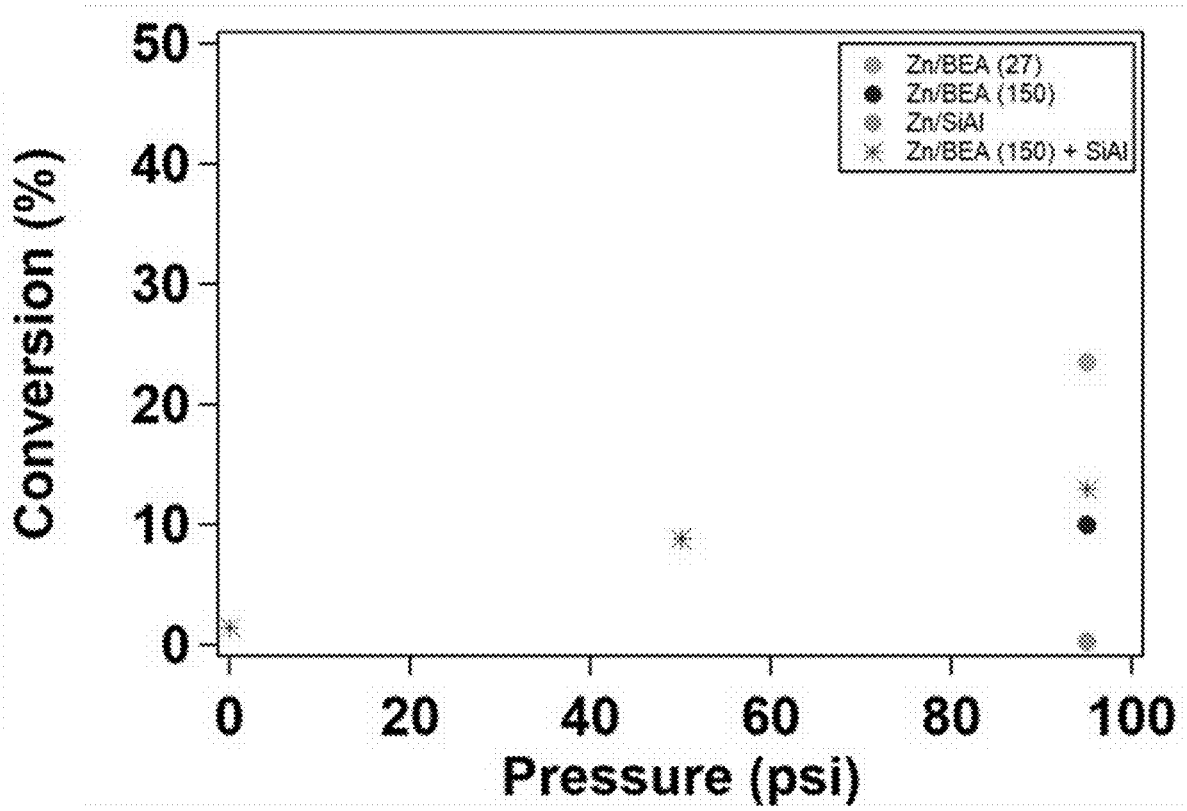
FIGS. 8A-D illustrates dehydrogenative coupling catalyst systems comprising Zn/BEA, evaluated at approximately 350° C., where
Figure 8B:
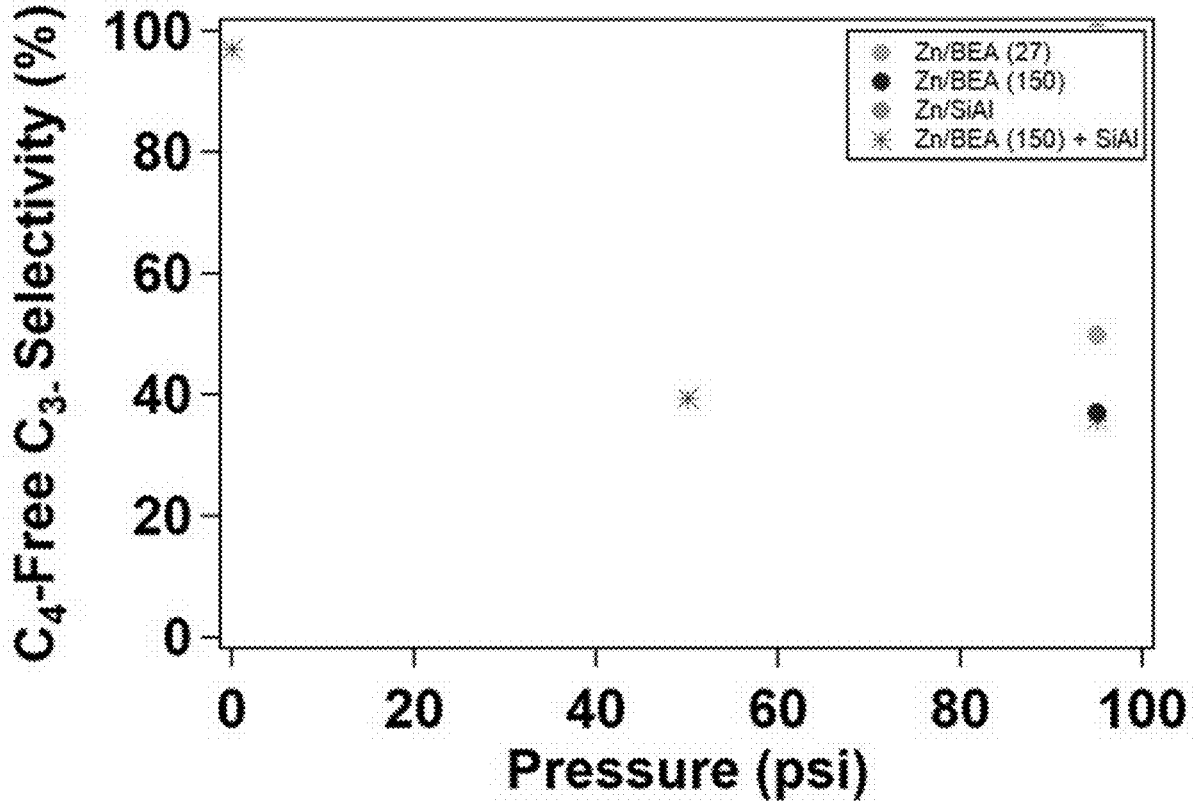
Figure 8C:
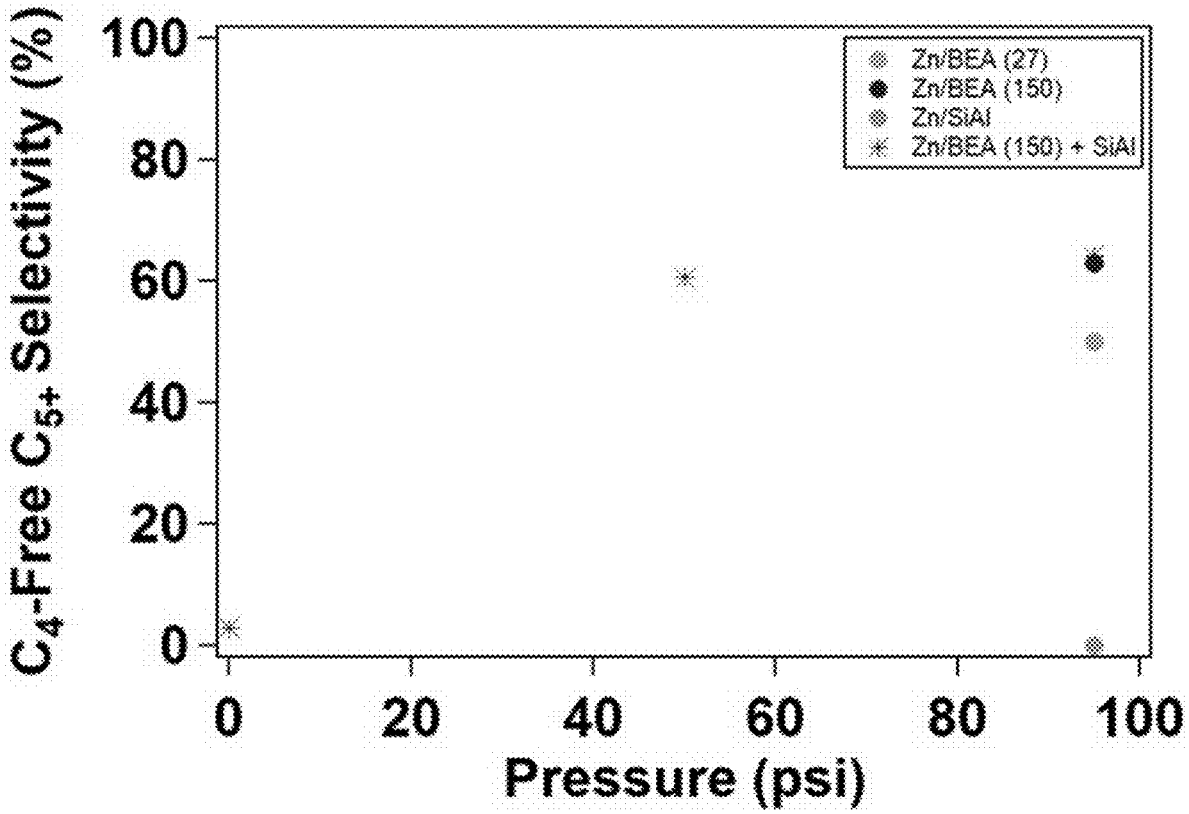
Figure 8D:
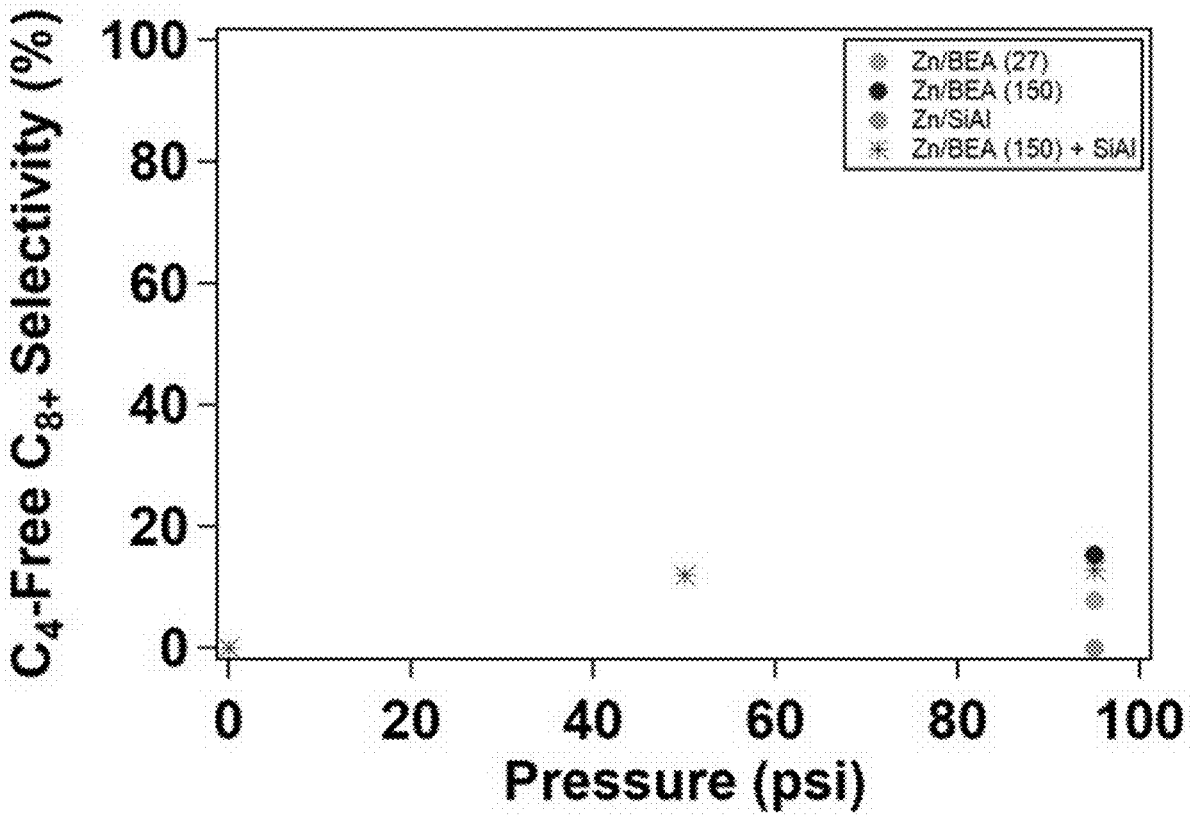
Figure 9A:
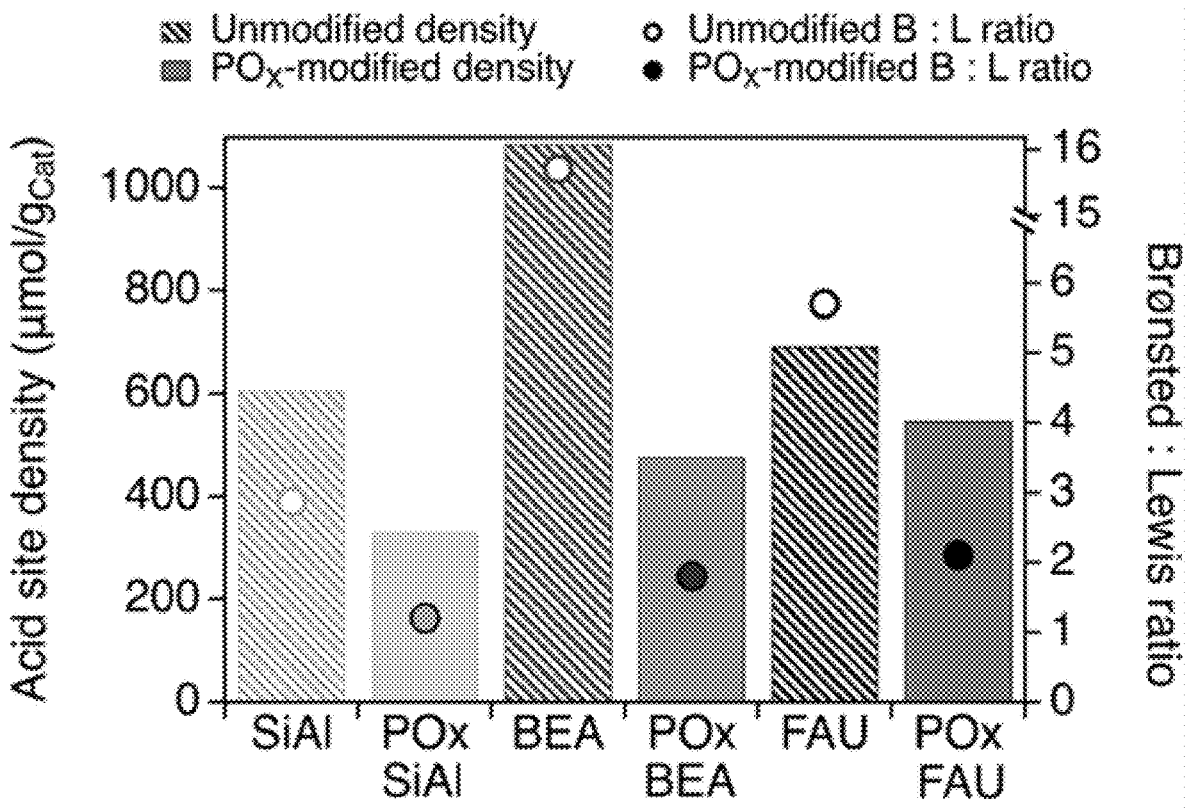
FIGS. 9A-D illustrate characterization of acid properties on unmodified and $PO_x$-modified SiAl, H/BEA, and H/FAU catalysts, to represent the effects of acid property modification on the coupling catalyst(s) that may be used in the dehydrogenative coupling reaction, according to some aspects of the present disclosure.
Figure 9B:
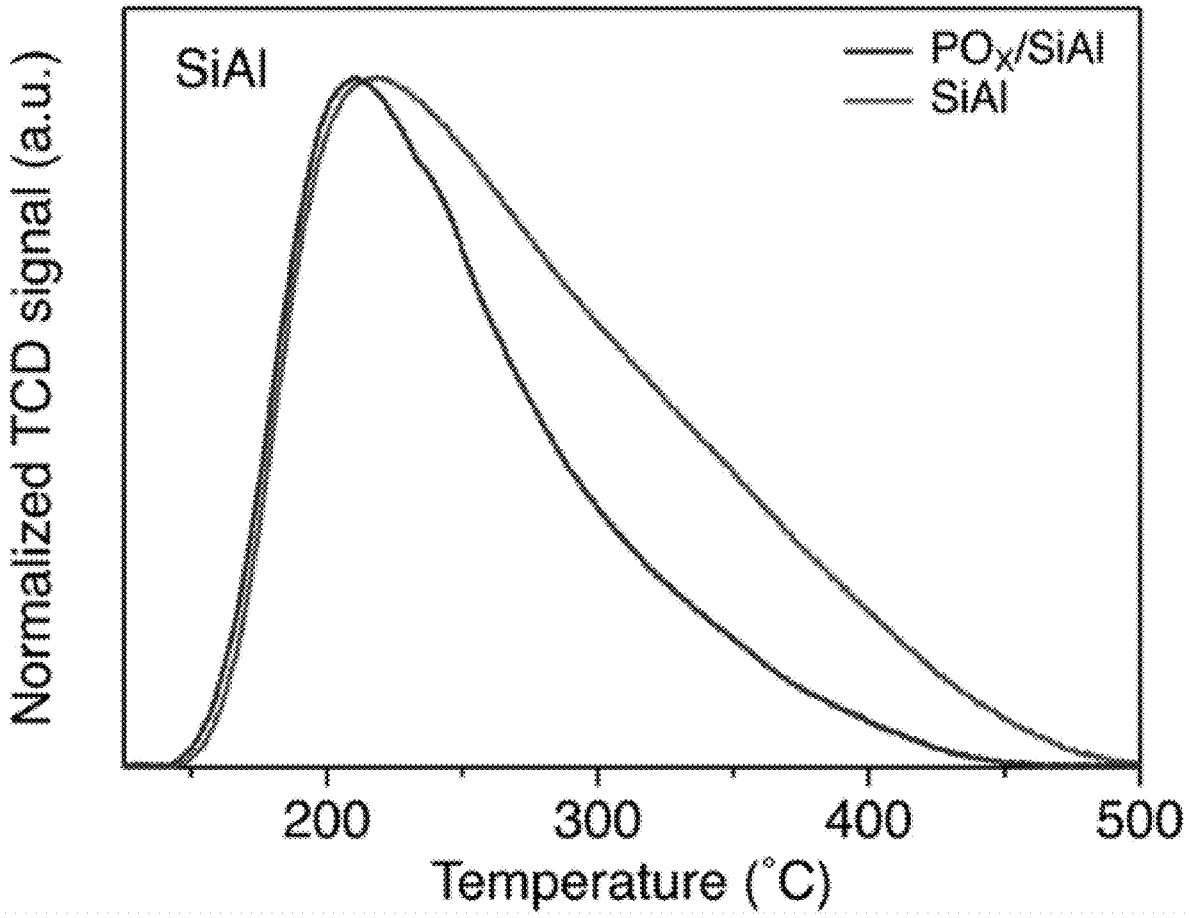
Figure 9C:
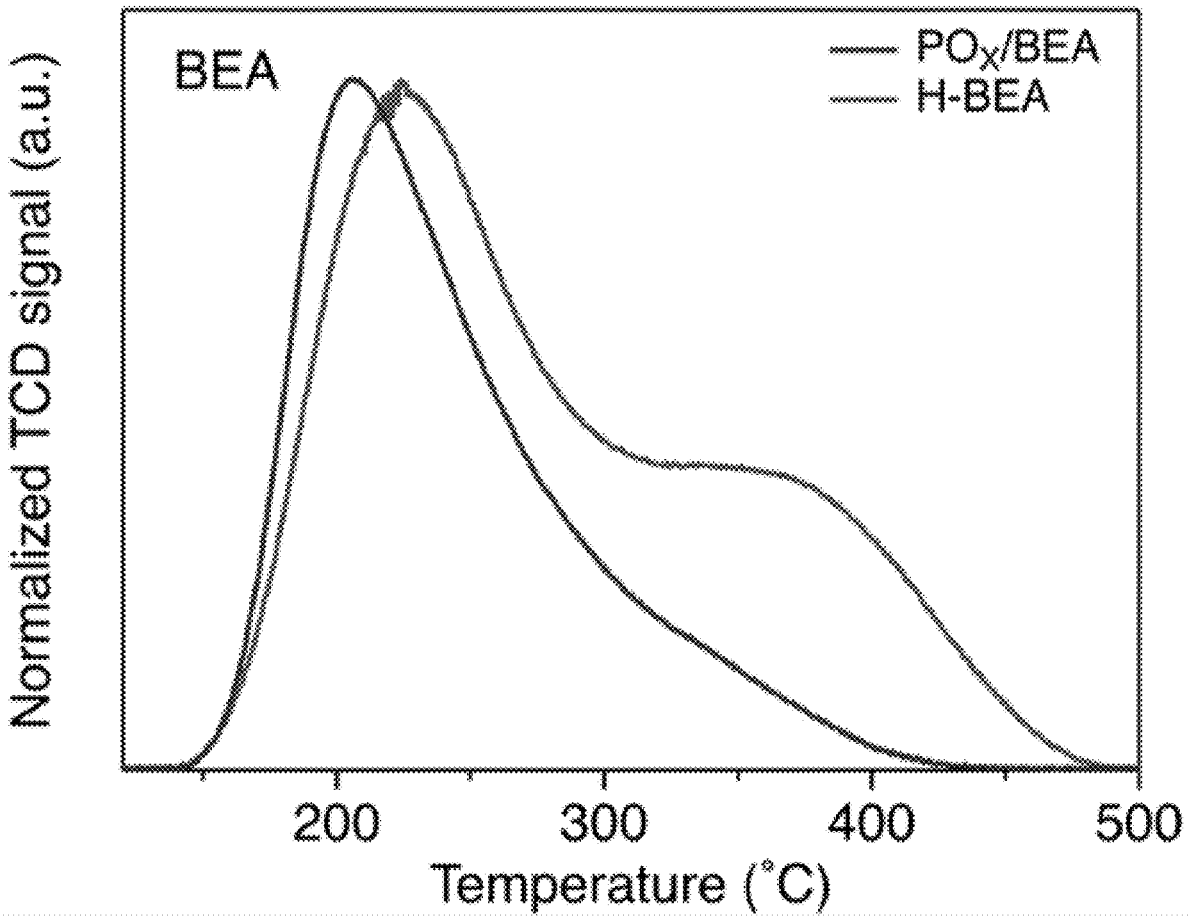
Figure 9D:
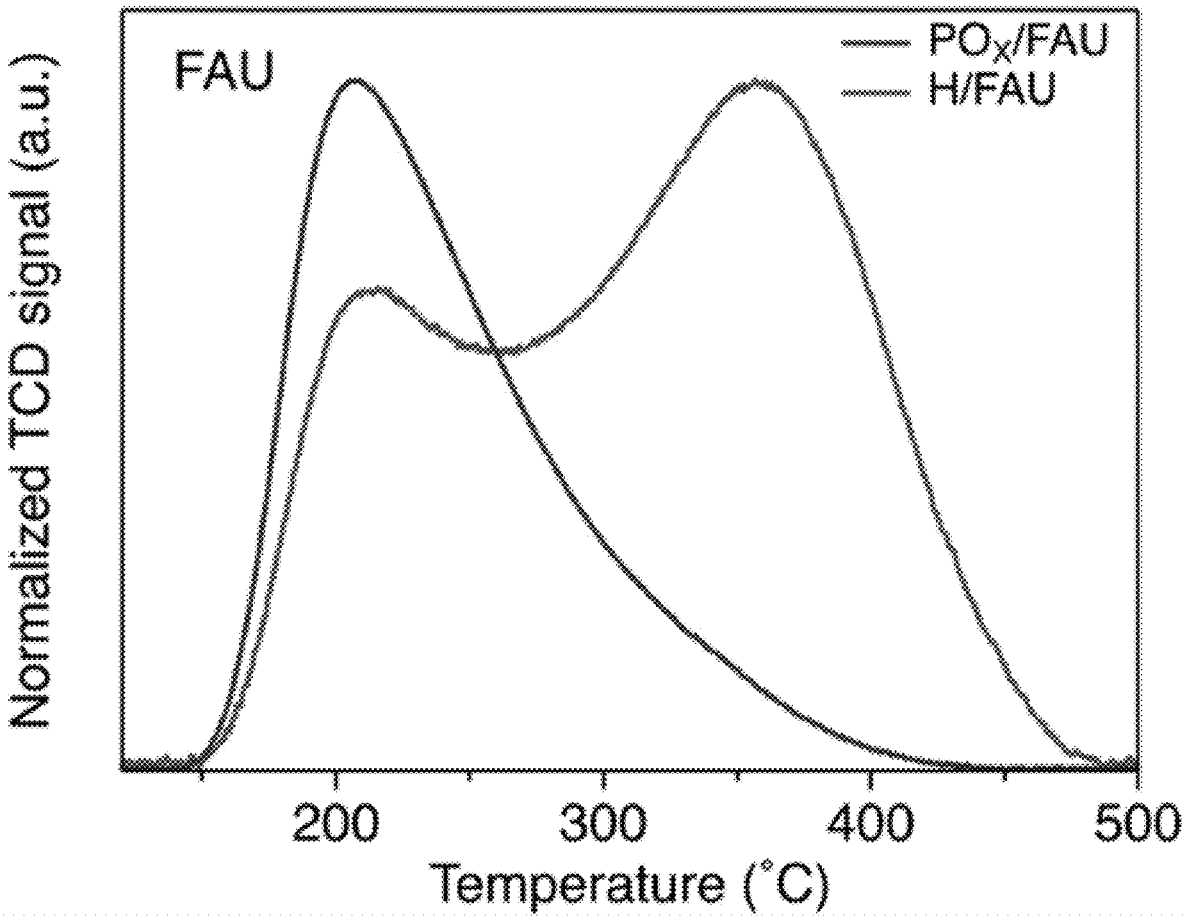

In some embodiments, a Zn/BEA catalyst with a higher SAR (lower acid site density) may facilitate coupling while preventing cracking. To this end, Zn/BEA-150 was prepared and evaluated, where the parent BEA zeolite has a SAR of approximately 150. Similar trends in conversion and selectivity with reaction temperature and pressure were observed for Zn/BEA-150 and Zn/BEA-27 (FIGS. 3D-E). However, lower conversions were observed at all reaction temperatures for Zn/BEA-150 compared to Zn/BEA-27. This could be due to the lower availability of exchange sites on BEA-150 than BEA-27, leading to fewer active $Zn^{2+}$ sites in the catalyst (i.e., a lower Zn weight loading). The lower acid site density of Zn/BEA-150 successfully increased selectivity to $C_{8+}$ HCs. For Zn/BEA-150, the $C_{8+}$ selectivity reached approximately 22% at approximately 400° C. and approximately 95 psig, which was double the highest $C_{8+}$ selectivity observed from Zn/BEA-27. These data suggest that one pathway to optimize the $C_{8+}$ selectivity in this reaction is by controlling the SAR in Zn/BEA materials to minimize the cracking of desired $C_{8+}$ HCs, especially at higher reaction temperatures.

In some embodiment, another approach to reduce cracking selectivity and promote coupling selectivity may be taken by preparing a $Zn/SiO_2$—$Al_2O_3$ catalyst. This approach was inspired by the $SiO_2$—$Al_2O_3$ providing the greatest $C_{8+}$ selectivity when combined with the Pt—Sn/$Al_2O_3$ dehydrogenation catalyst. In the $Zn/SiO_2$—$Al_2O_3$ catalyst, a $Zn^{2+}$ dehydrogenation active site similar to that in Zn/BEA was envisioned being supported on the acidic $SiO_2$—$Al_2O_3$ having an intermediate acid site density (694 $umol_{H+}/g$). However, for $Zn/SiO_2$—$Al_2O_3$, the dehydrogenation activity was low, leading to low conversion and minimal coupling (FIG. 3B). No $C_{8+}$ HCs were observed. This low performance may be due to ineffective dehydrogenation at the $Zn^{2+}$ sites, suggesting that there is a role of pore size, pore geometry, and/or pore confinement to activate $Zn^{2+}$ sites for the uniquely high dehydrogenation activity demonstrated by Zn/BEA.

The role of pressure was investigated when the reactor temperature was held constant at approximately 400° C., where the highest conversion was observed (See FIGS. 4A-D). Increasing reactor pressure led to increasing conversion. Higher pressures also led to a slight increase in the selectivity to $C_{8+}$ HCs, accompanied by a decrease in $C_3$. HC formation. These results are consistent with carbon coupling being promoted at higher reaction pressures.

Under the reaction conditions explored herein, the thermodynamic equilibrium limit for isobutane conversion is approximately 7% at approximately 300° C. and approximately 18% at approximately 400° C. (see Table 1). Catalyst systems employing a coupling catalyst with the Pt—Sn/$Al_2O_3$ catalyst resulted in conversions near or slightly exceeding the thermodynamic limit. However, conversions up to approximately 33% were observed at approximately 400° C. over Zn/BEA (SAR 27), indicating that the alternative approach of using two reactors in series would enable control of the reaction conditions for each step (dehydrogenation and coupling) independently, but the thermodynamic equilibrium of isobutane dehydrogenation would limit the concentration of isobutene available for subsequent conversion, leading to a limited per-pass yield of jet fuel-range HCs (i.e., $C_{8+}$ HCs).

The results for the catalyst systems containing the Pt—Sn/$Al_2O_3$ dehydrogenation component demonstrated that increased reaction pressure is required to selectively promote $C_{8+}$ HC formation. The current experimental reactor system cannot feed this isobutane mixture at pressures greater than 100 psig. Reactor modification to explore higher pressure reaction conditions are expected to improve $C_{8+}$ selectivity.

It is expected that improved $C_{8+}$ selectivity can be obtained by increasing the concentration of isobutane in the feed stream. However, isobutane is a liquid at standard temperatures and pressures (STP). The current experimental reactor systems cannot flow liquid at the high pressures required for this reaction. Attempts were made to apply the headspace gas from approximately 100% isobutane, but the gas pressure at STP is limited to approximately 24 psig. A high-pressure liquid feed stream consisting of approximately 100% isobutane will enable us to reliably control the feed stream concentration using $N_2$ as a diluent. With reactor modifications, it is expected that higher partial pressures of isobutane, achieved by increasing reaction pressure or the isobutane concentration in the feed stream, will improve the dehydrogenative coupling performance and promote increased $C_{8+}$ selectivity.

The results from the catalyst systems containing Zn/BEA indicate that acidity is an important catalyst property that will lead to improved catalyst performance. For the Zn/BEA materials, an increase in the SAR led to a decrease in cracking activity. This suggests that although the acid sites of the BEA materials are active for coupling performance, a high concentration of acid sites lead to cracking of desired products to smaller, undesired HCs.

Two SAR values for BEA zeolite were compared, but another approach to control the acid character is to change the zeolite morphology. For example, faujasite (FAU) is another large-pore zeolite that has recently been investigated for the coupling of ethylene, and this zeolite is of interest in the next-generation of catalysts developed here.

The data examined herein was collected using mixed-bed configurations containing a similar ratio of dehydrogenation and coupling components (approximately 2:1) or a single component with both dehydrogenation and coupling active sites. Another approach to improve $C_{8+}$ selectivity is by controlling the ratio of each component in the bed. Modifications to the current mixed bed configuration can be made by loading a larger concentration of the coupling component to promote the conversion of $C_4$ olefin isomers to higher molecular weight products.

FIGS. 7-8 illustrate comparing the conversion and product selectivity over PSA and Zn/BEA catalyst systems at reaction conditions that yield lower $C_{8+}$ HC selectivity, according to some aspects of the present disclosure.

The SiAl and H/BEA (SAR 27) catalysts studied above, in addition to a faujasite (FAU) catalyst, were chemically modified to alter acid site characteristics. This was done to identify the effects of tuned acid site density and strength on improved $C_{8+}$ HC selectivity in dehydrogenative coupling. Phosphate ($PO_x$) modification was performed on the aforementioned catalysts to represent methods for chemically altering acid sites. Three modified catalysts were produced: $PO_x$/SiAl, $PO_x$/BEA, and $PO_x$/FAU, with approximate phosphorus weight loadings of 4 wt %.

Characterization of acid sites, on the unmodified and $PO_x$-modified catalysts is shown in FIGS. 9A-D. $NH_3$-TPD experiments were used to quantify total acid site density and pyridine DRIFTS experiments were used to quantify Brønsted: Lewis acid site ratios (B:L). Total acid site density and B:L ratio decreased upon acid site modification. As highlighted in FIGS. 9C-D, $PO_x$-modification shifted the peak $NH_3$ desorption temperature to lower values and removed high temperature (greater than approximately 300° C.) features from $NH_3$-TPD profiles. These results are consistent with previously published observations of decreased acid strength and abundance, that arise from chemical modification. This data is also summarized in Table 3.

TABLE 3

Summary of acid site properties on unmodified and $PO_x$-modified coupling catalysts.

| | H—BEA | $PO_x$/BEA | SiAl | $PO_x$/SiAl | H—FAU | $PO_x$/FAU |
|---|---|---|---|---|---|---|
| Total acid site density (μmol/g) | 1085 | 642 | 774 | 606 | 691 | 547 |
| Brønsted acid site density (μmol/g) | 1020 | 413 | 574 | 330 | 588 | 370 |
| Lewis acid site density (μmol/g) | 65 | 229 | 200 | 276 | 103 | 177 |
| Brønsted:Lewis ratio | 15.7 | 1.8 | 2.87 | 1.2 | 5.7 | 2.1 |

The effects of chemical modification on suppressed HC cracking were studied using a probe isobutane ($iC_4$) cracking light off experiment. In some embodiment of these cracking experiments, approximately 50 mg of unmodified and $PO_x$-modified SiAl, H/BEA, and H/FAU were loaded into a ¼ inch diameter quartz reactor applying approximately 1% isobutane, approximately 1% argon, and approximately 98% nitrogen at temperatures in the range of approximately 200° C. to approximately 500° C. at a pressure of approximately 29 psig.

Figure 10A:
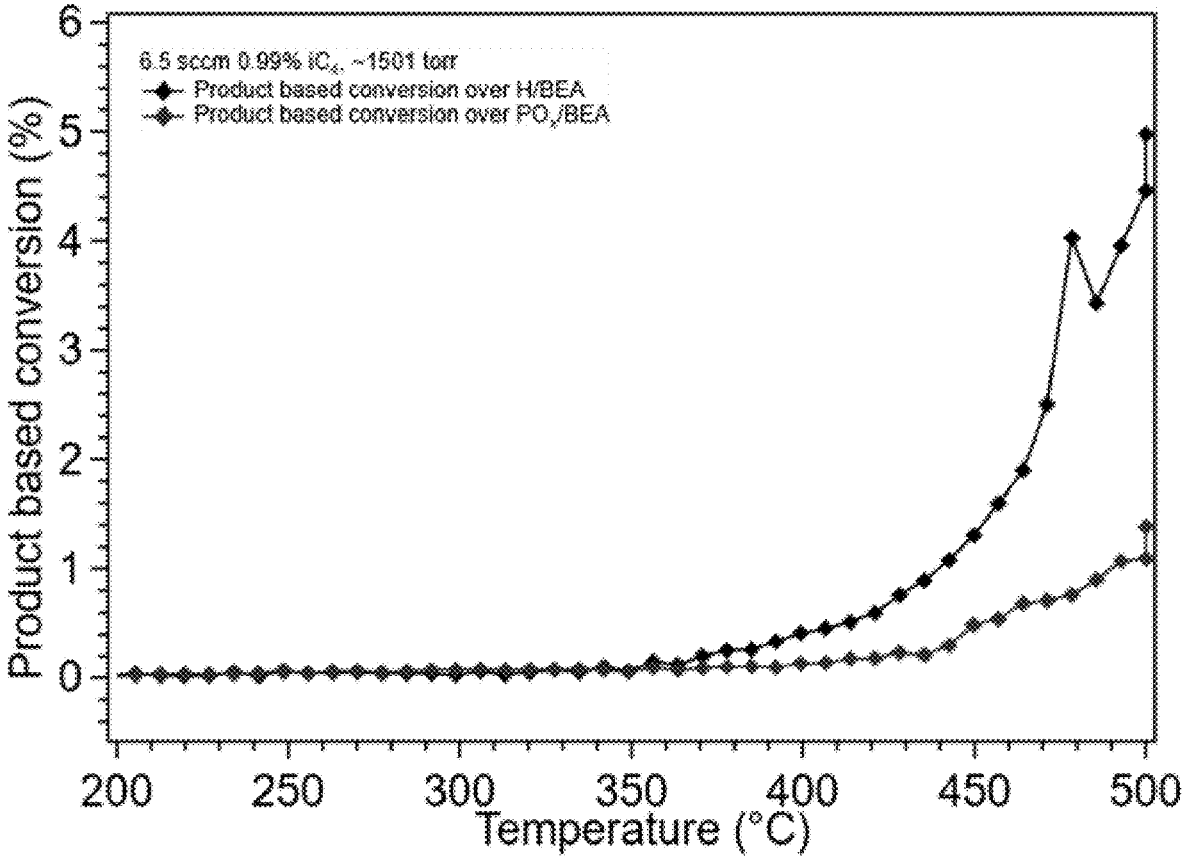
FIGS. 10A-C illustrate cracking light off experiments performed over catalyst systems comprising a silicoaluminophosphate zeotype (SAPO) in addition to unmodified and $PO_x$-modified SiAl, H/BEA, and H/FAU catalysts in approximately 1% isobutane in $Ar/N_2$ where conversion to cracked hydrocarbons was observed over a temperature range of approximately 200° C. to approximately 500° C. and a pressure of approximately 29 psig, to represent the effects of $PO_X$ modification on cracking chemistry, according to some aspects of the present disclosure.
Figure 10B:
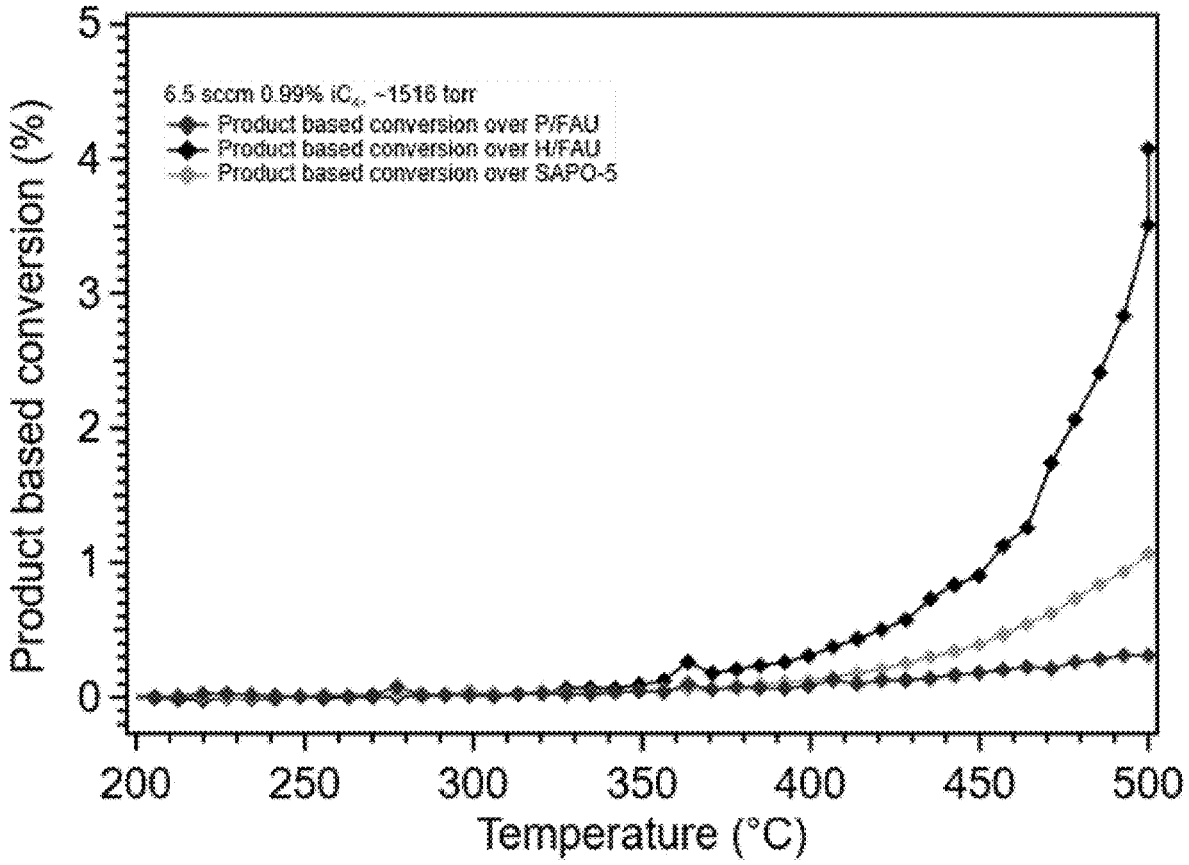
Figure 10C:
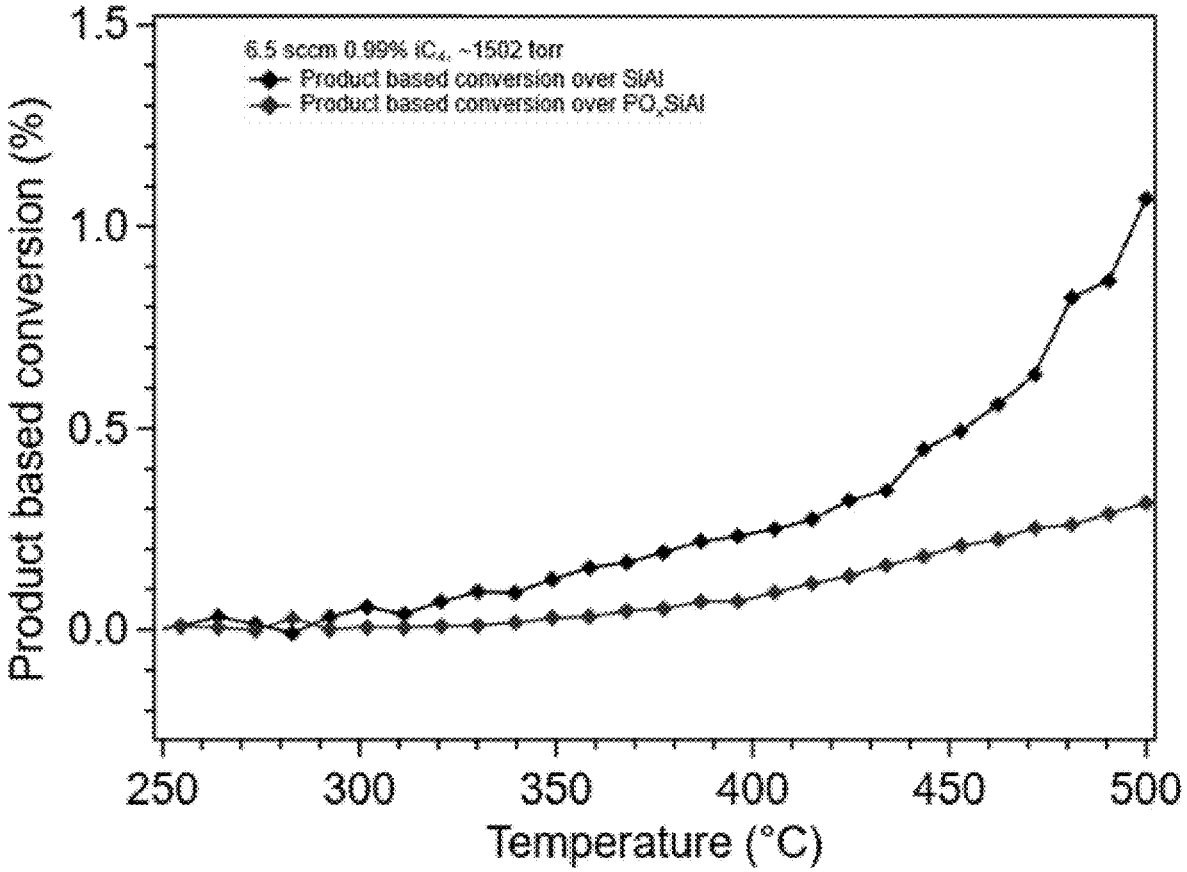

FIGS. 10A-C summarizes $iC_4$ cracking light-off experiment data. All catalysts exhibited cracking light-off (defined herein as the temperature that results in a visually noticeable increase in conversion of reactant from the baseline) in the range of approximately 300° C. to approximately 350° C. As shown in FIGS. 10A-C, conversion of $iC_4$ to cracked products was lower on all $PO_x$-modified catalysts when compared to their corresponding unmodified counterpart. These data demonstrate that chemical modification of acid sites can suppress cracking in temperatures that are relevant to dehydrogenation.

SiAl and $PO_x$/SiAl were chosen to represent an unmodified and chemically-modified pair of coupling catalysts. Theses catalysts were combined with the Pt—Sn/$Al_2O_3$ dehydrogenation catalyst at a mass ratio of 0.5 coupling:1 dehydrogenation catalyst. These catalysts were studied in various embodiments of the dehydrogenative coupling process to examine the effects of chemical modification on $C_{8+}$ HC selectivity. Prior to each reaction, the catalyst bed was pretreated at approximately 350° C. in approximately 75 sccm of hydrogen and the reactor was allowed to cool to the desired operating temperature before flowing the isobutane gas mixture.

Figure 11A:
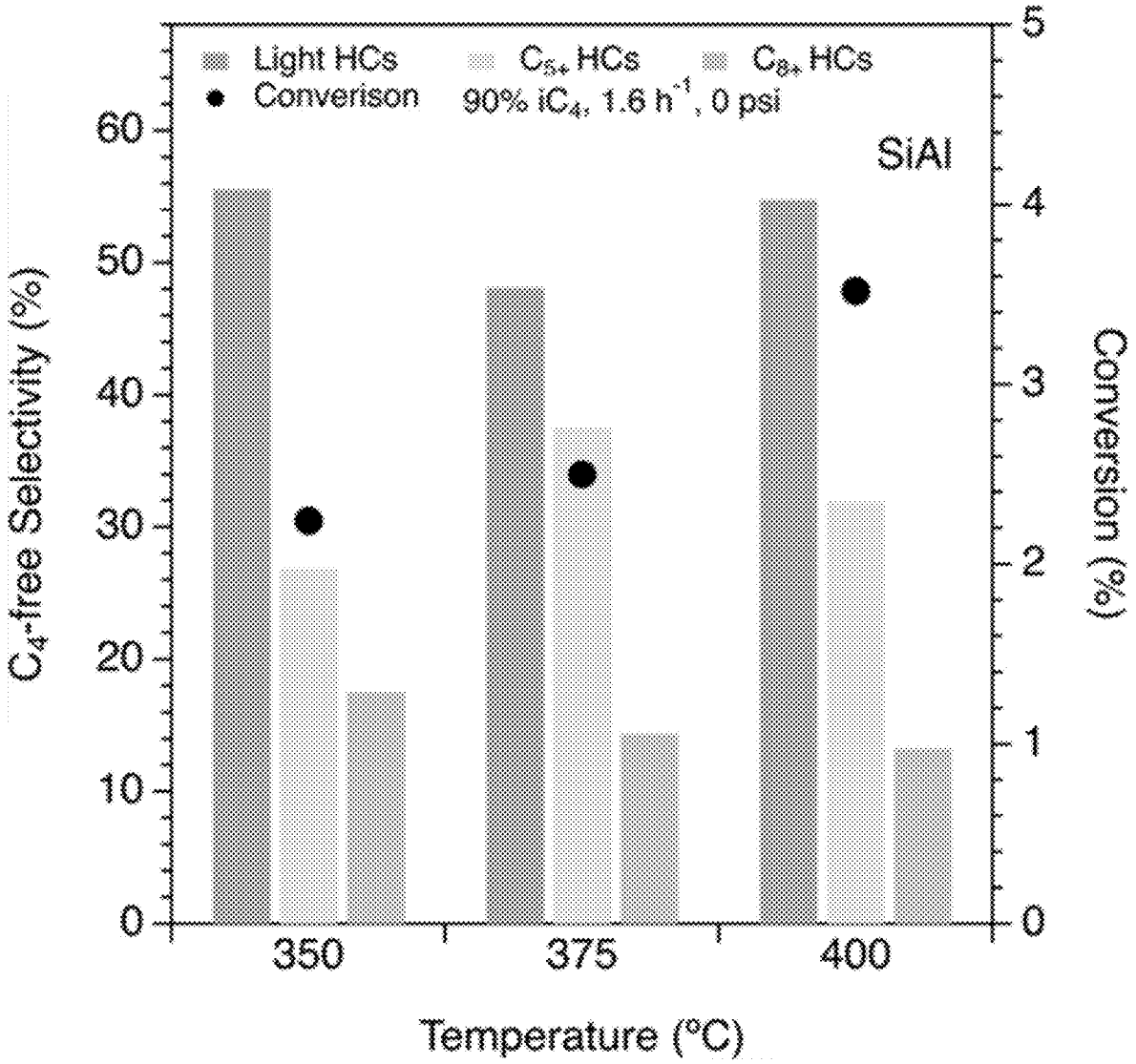
FIGS. 11A-B illustrate dehydrogenative coupling reaction performed over catalyst systems comprising PSA+SiAl and PSA+$PO_x$/SiAl in approximately 90% isobutane in $Ar/N_2$ where i) conversion ii) $C_{4-}$ free $C_{3-}$ selectivity iii) $C_{4-}$ free $C_{5+}$ selectivity and iv) $C_{4-}$ free $C_{8+}$ selectivity was compared over a range of reactor temperatures at approximately 0 psig and 1.6 $h^{-1}$ $iC_4$, according to some aspects of the present disclosure, to represent the effects of modifying the acid properties of the coupling catalyst used, according to some aspects of the present disclosure.
Figure 11B:
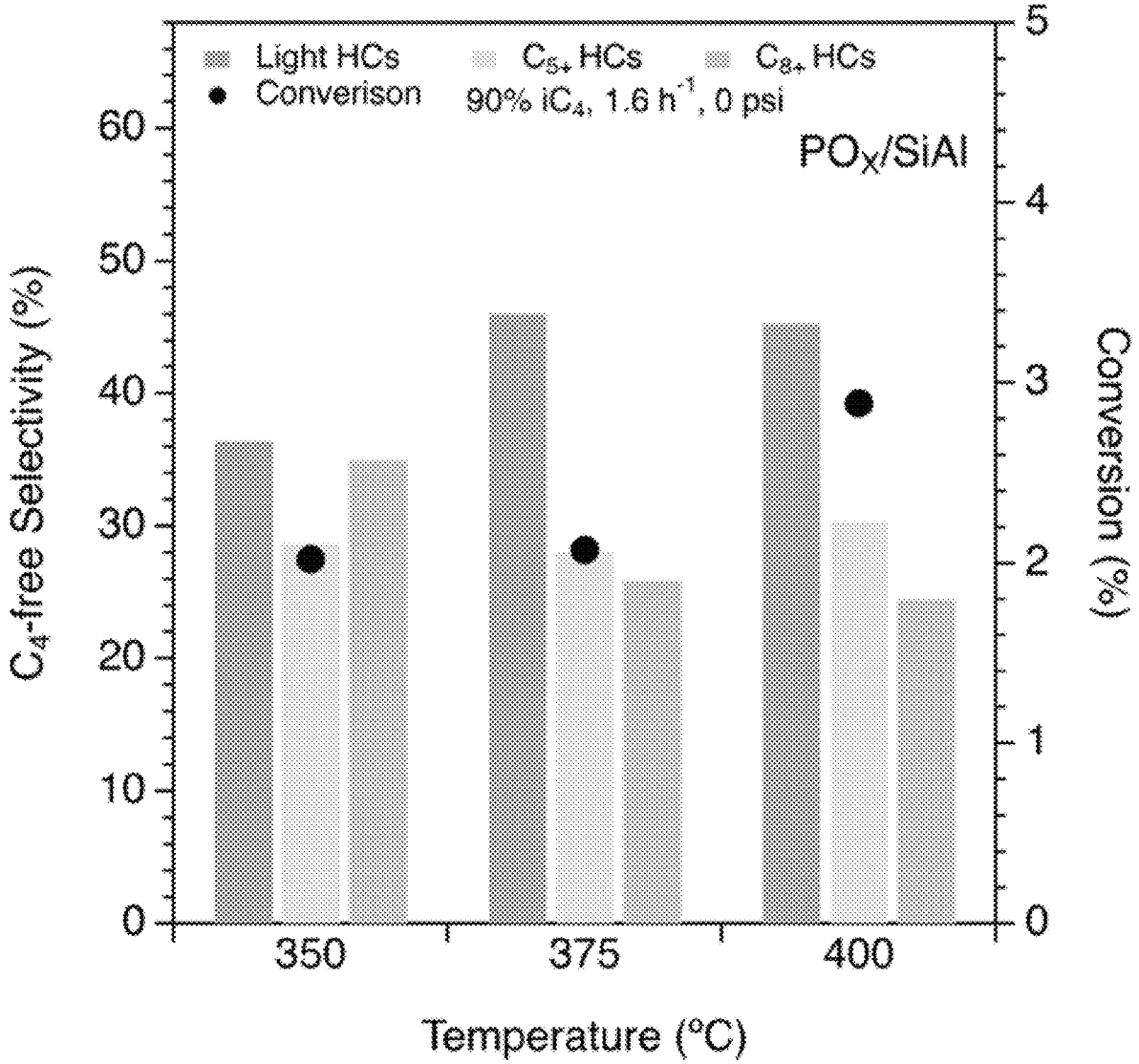

Temperature sweep experiments shown in FIGS. 11A-B demonstrated that $iC_4$ conversion is generally inversely correlated with $C_{8+}$ HC selectivity. $C_{8+}$ HC selectivity decreased with increasing temperatures, which is consistent with increased cracking chemistry. The increase in total conversion with temperature suggests may arise from improved dehydrogenation on the PSA, which is known to scale with temperature. Mixed-beds of PSA+SiAl demonstrated $C_{8+}$ HC selectivity values of 17, 14, and 8% at 350, 375, and 400° C., respectively. PSA+$PO_x$/SiAl showed comparatively higher $C_{8+}$ HC selectivity, with values of 35, 26, and 24% at 350, 375, and 400° C., respectively. This increase in $C_{8+}$ HC selectivity coincided with a marked decrease in the selectivity towards Light HC and $C_{5+}$ HC cracking products. These results show that chemically modifying acid properties on coupling catalysts can decrease cracking chemistry. This in turn allows for greater $C_{8+}$ yields in the temperatures that are more favorable for light alkane dehydrogenation.

Figure 12A:
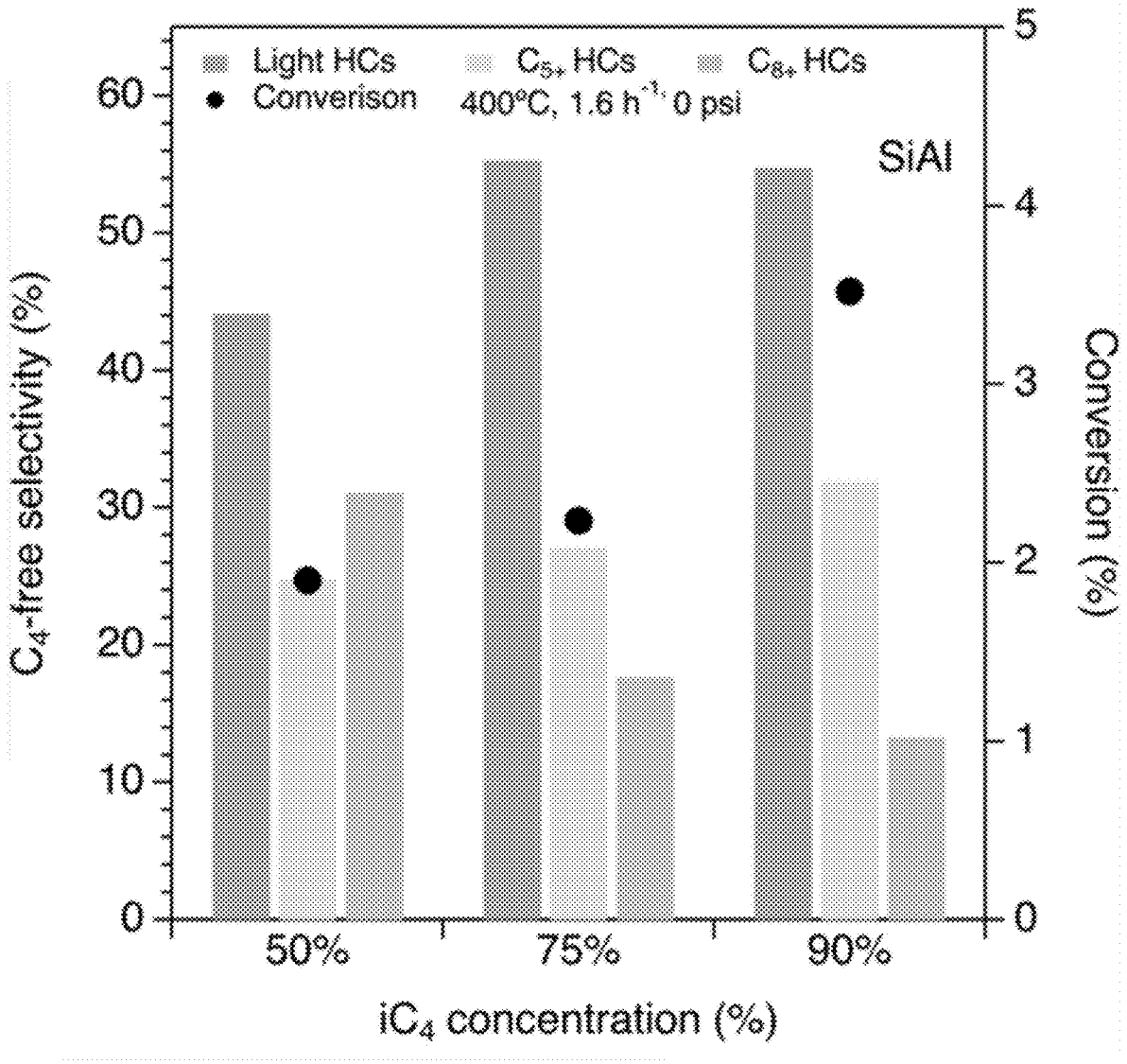
FIG. 12A-B illustrate dehydrogenative coupling reaction performed over catalyst systems comprising PSA+SiAl and PSA+$PO_x$/SiAl in gas mixtures of varied isobutane concentration in $Ar/N_2$ where i) conversion ii) $C_{3-}$ selectivity iii) $C_{4-}$ free $C_{5+}$ selectivity and iv) $C_{4-}$ free $C_{8+}$ selectivity was compared at approximately 400° C., 0 psig, and 1.6 $h^{-1}$ $iC_4$ according to some aspects of the present disclosure, to represent the effects of changing the inlet concentration of branched alkanes, according to some aspects of the present disclosure.
Figure 12B:
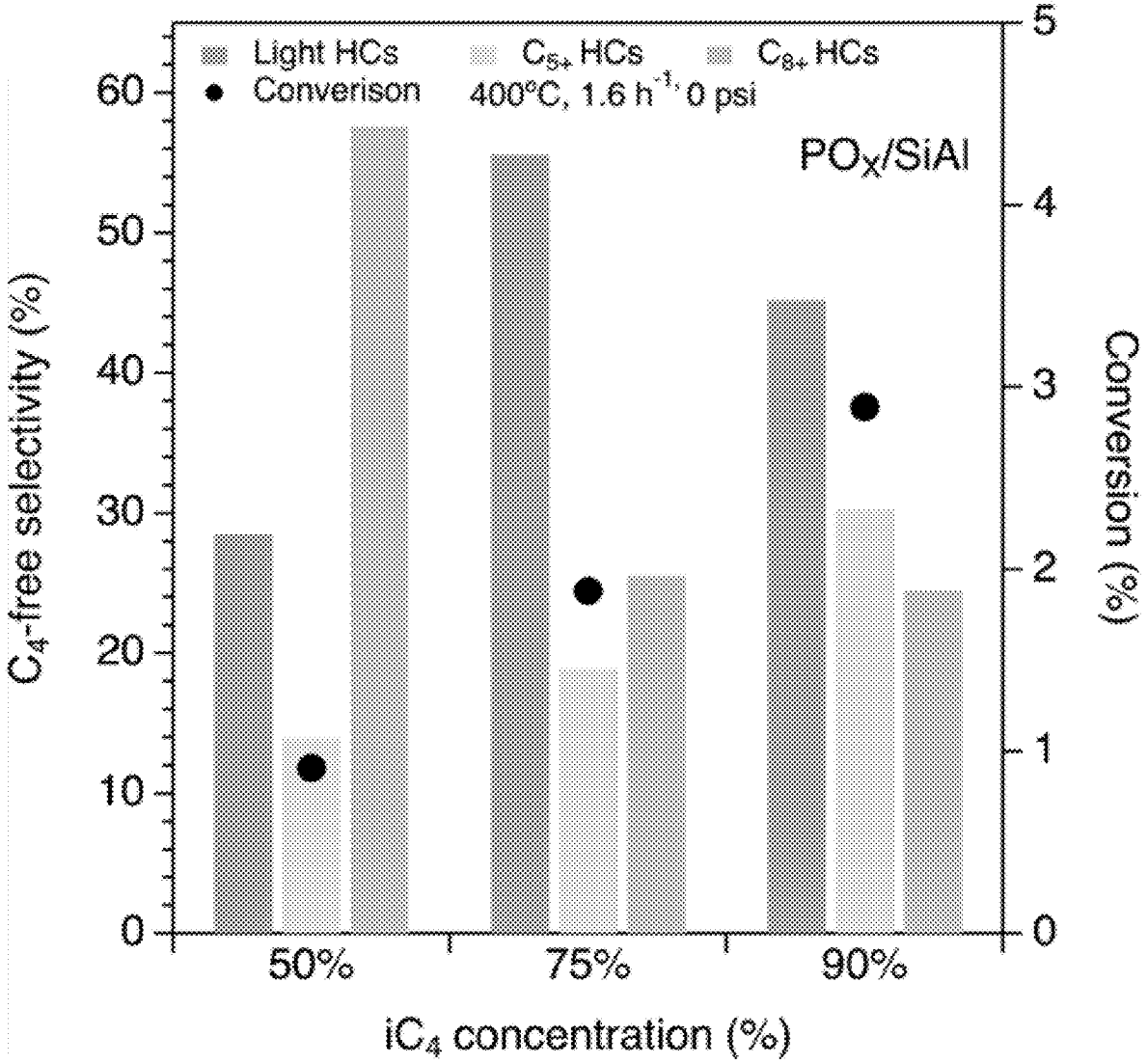
Figure 13A:
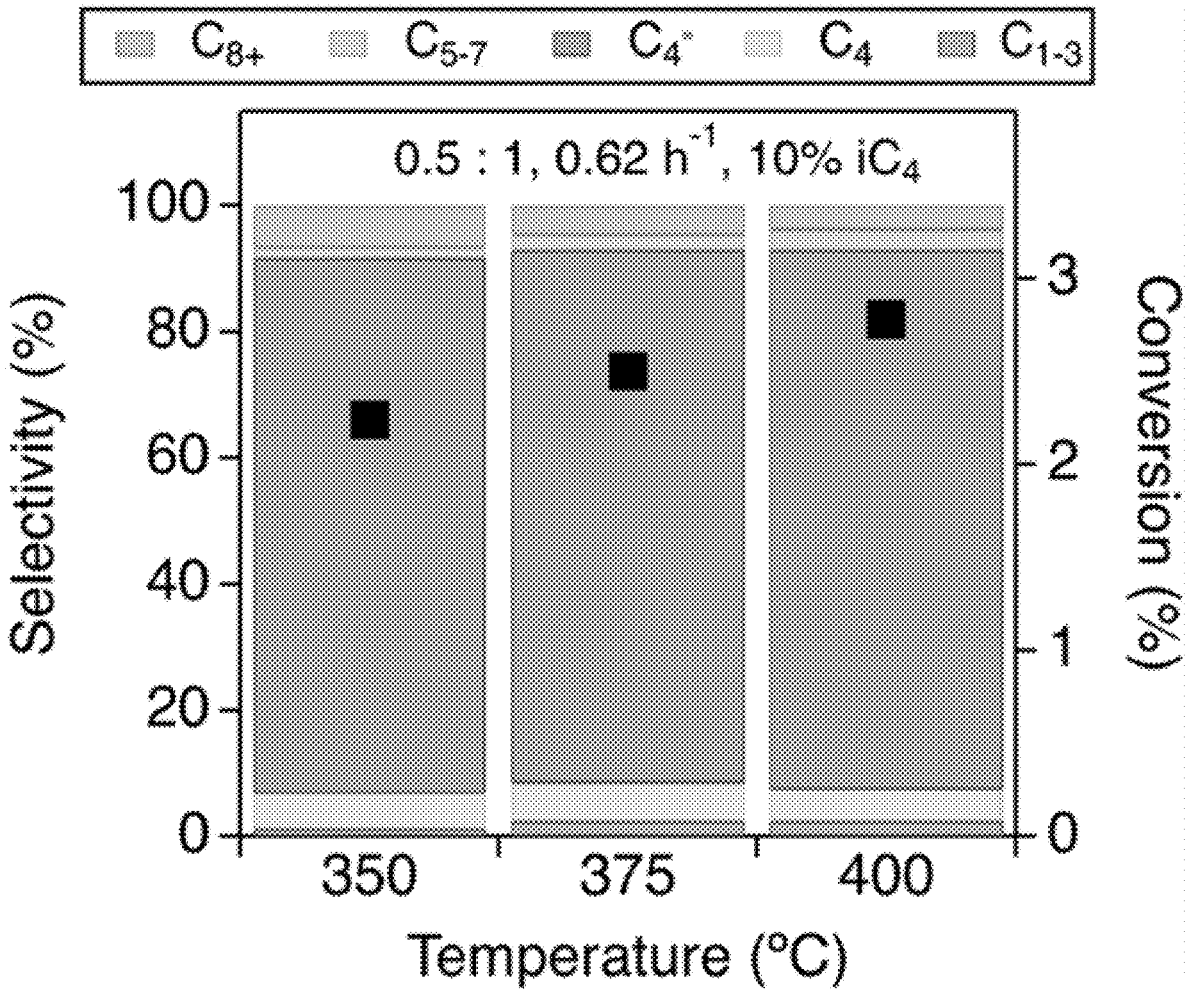
FIGS. 13A-F illustrate dehydrogenative coupling reaction performed over catalyst systems comprising PSA+$PO_X$/SiAl in varying mass ratios in approximately 10% isobutane in $Ar/N_2$ where a) conversion b) $C_{1-3}$ selectivity c) $C_{5-7}$ selectivity and d) $C_{8+}$ selectivity was compared over a range of reactor temperatures at a pressure of approximately 5 psig, to represent the effects of changing the relative abundance of dehydrogenation and coupling catalysts, according to some aspects of the present disclosure.
Figure 13B:
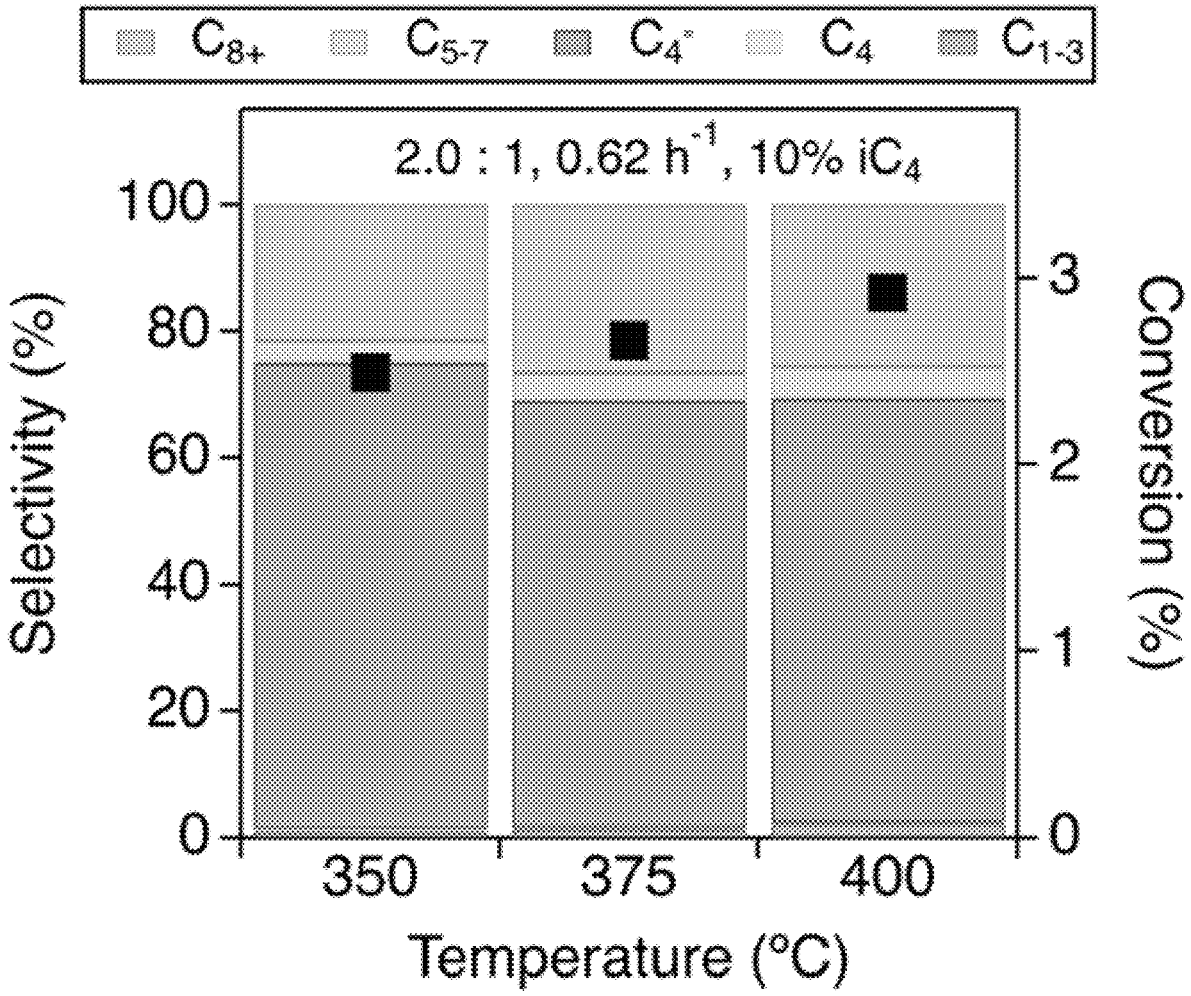
Figure 13C:
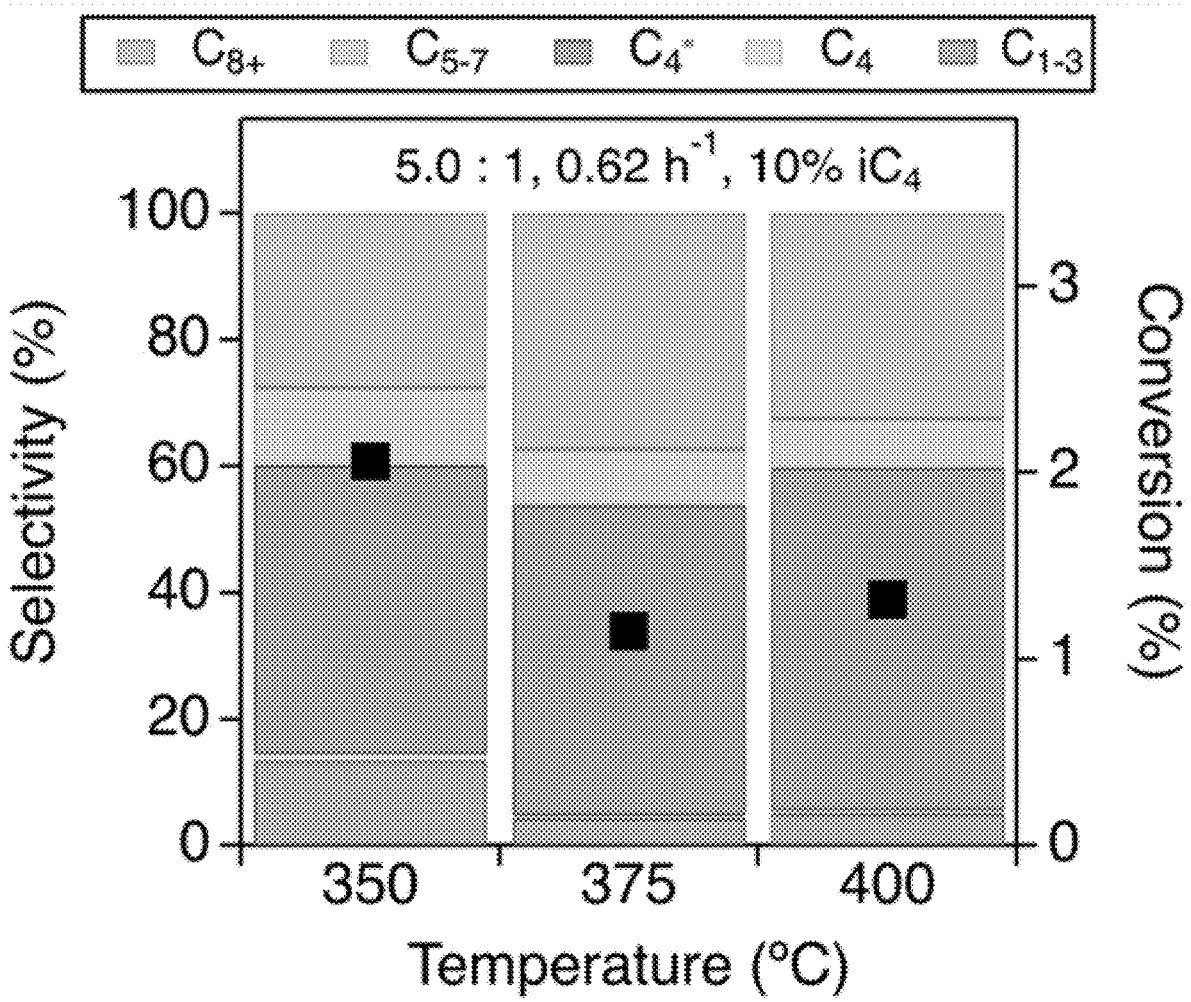
Figure 13D:
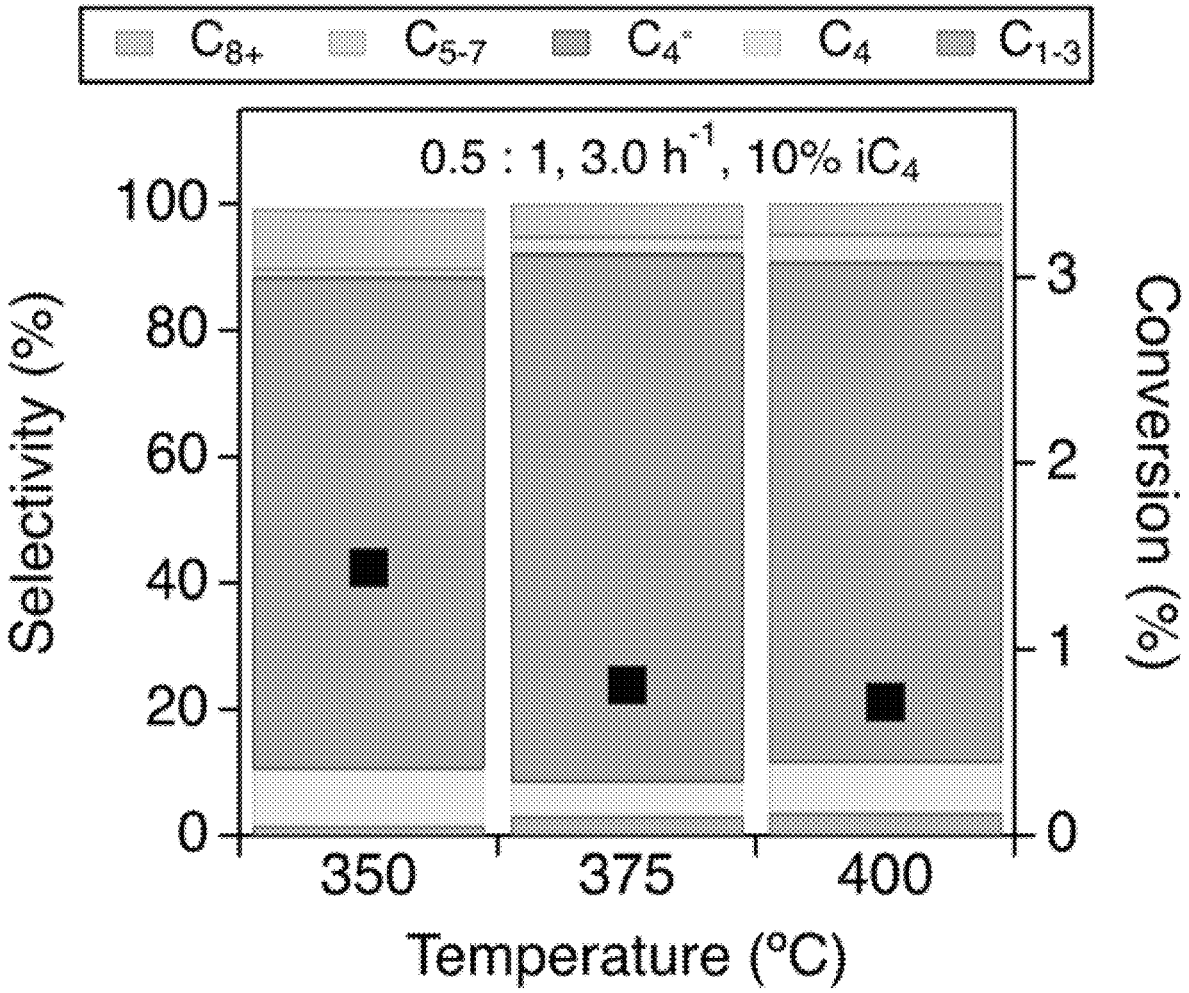
Figure 13E:
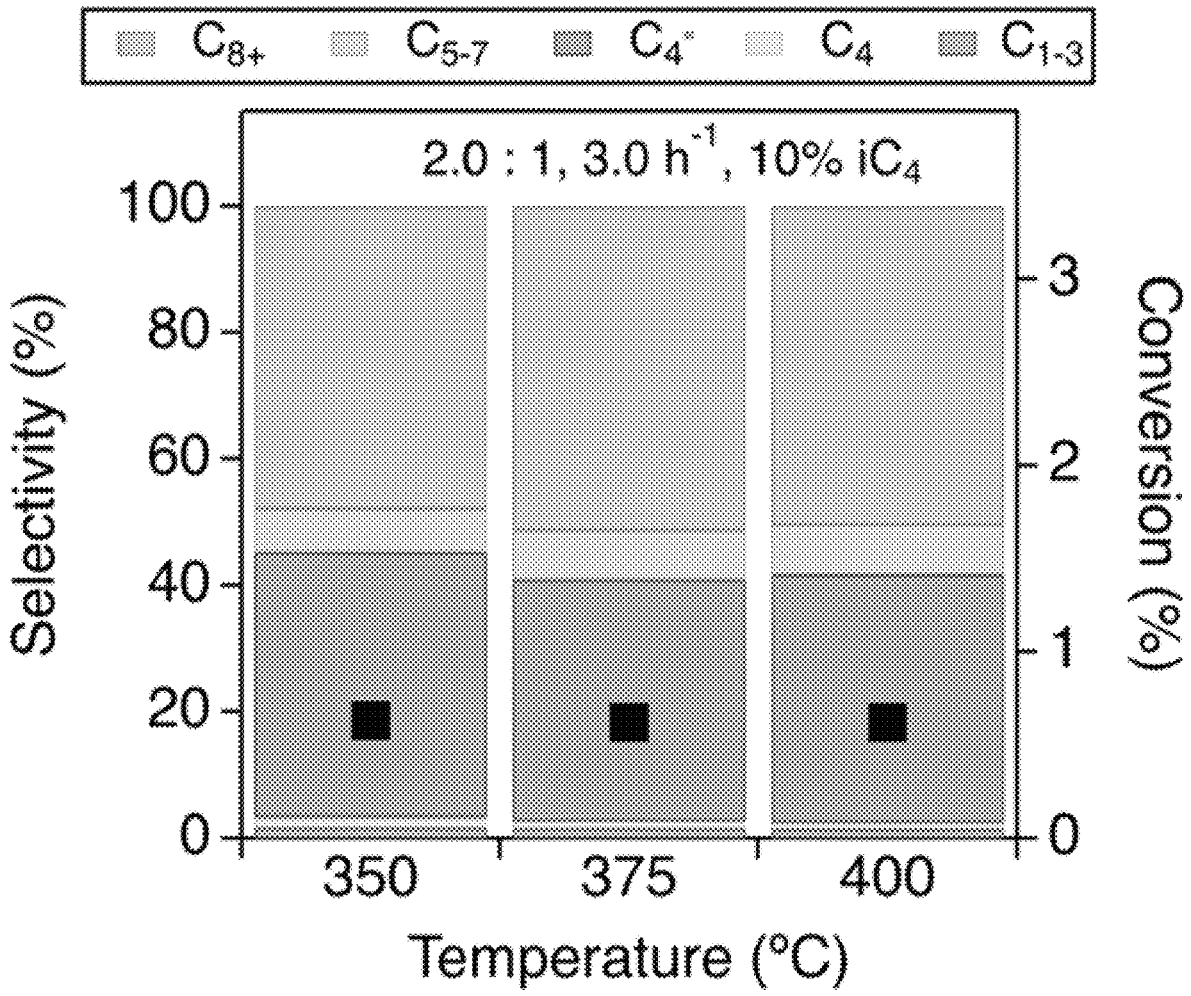
Figure 13F:
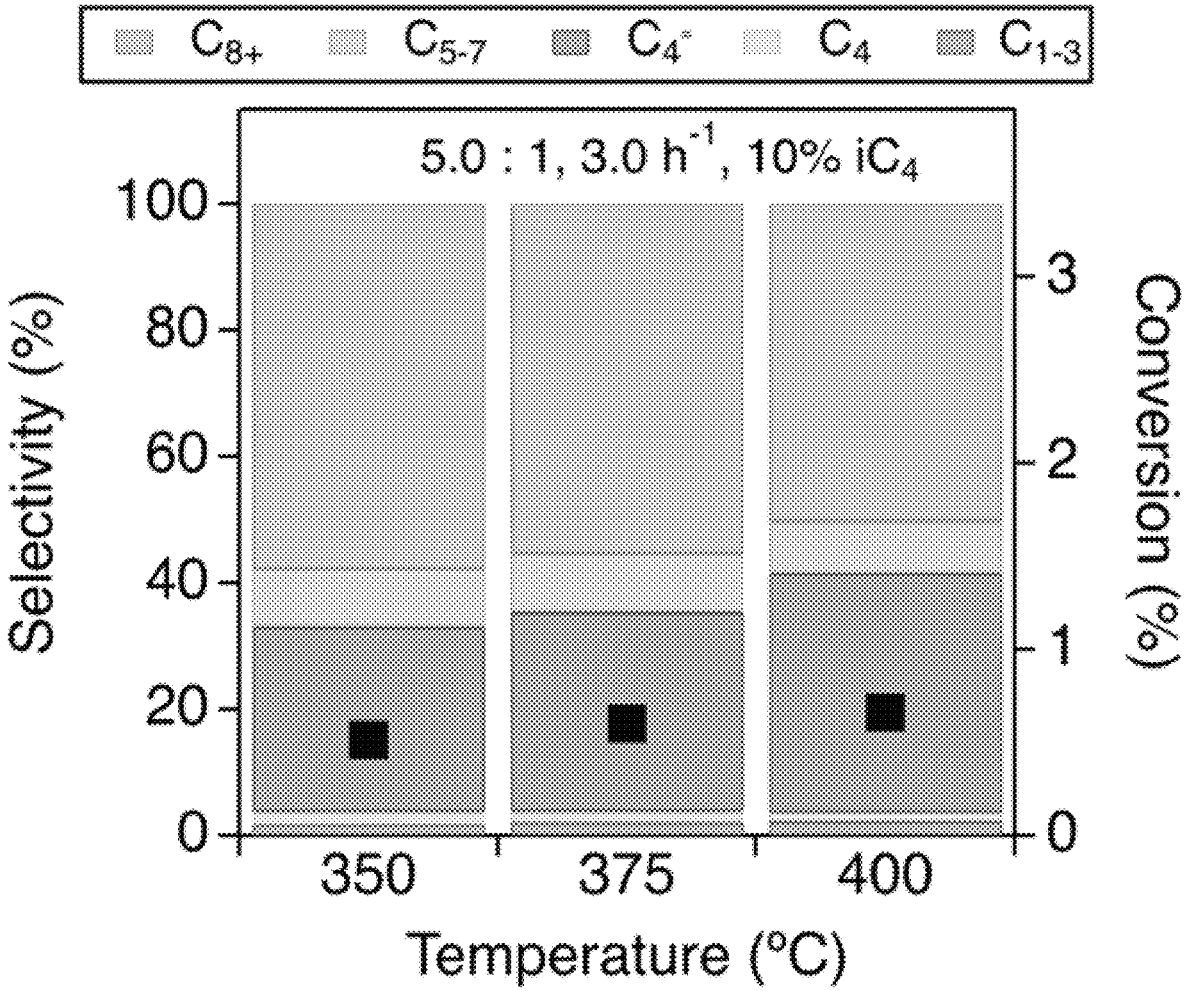

$iC_4$ concentration sweep experiments were performed on the same mixed-beds of PSA+ SiAl and PSA+$PO_x$/SiAl. These experiments used a liquid tank of pure isobutane, with a gas head space pressure of approximately 24 psig. This head space pressure was used to deliver isobutane at the various concentrations, achieved by mixing with $N_2$ gas. Increasing $iC_4$ concentration decreased $C_{8+}$ selectivity, increased cracking product selectivity and increased the conversion of $iC_4$ to olefin products, as summarized in FIGS. 12A-B.

PSA and $PO_x$/SiAl were combined at varying mass ratios to demonstrate the effects of changing ratio of coupling and dehydrogenation catalyst in a mixed bed. Three mass ratios of $PO_x$/SiAl:PSA were selected: 0.5:1, 2:1, and 5:1 to represent coupling-lean and coupling-rich bed compositions. These mixed-beds were studied in various embodiments of the dehydrogenative coupling process to understand the effects of changing mass ratio, changing pressure, changing temperature, changing weight hourly space velocity, and the presence of cofed $H_2$ on $C_{8+}$ HC selectivity. Prior to each reaction, the catalyst bed was pretreated at approximately 350° C. in approximately 75 sccm of hydrogen and the reactor was allowed to cool to the desired operating temperature before flowing the isobutane gas mixture. The conversion, $C_{8+}$ HC productivity (prod), and selectivity (sel) to all HC products, grouped as light HCs ($C_{1-3}$), $C_4$ paraffins excluding isobutane ($C_4$), $C_4$ olefins ($C_4$=), intermediate HCs ($C_{5-7}$) and target HC products ($C_{8+}$), is summarized in Tables 4-6, for $PO_x$/SiAl:PSA mass ratios of 0.5:1, 2:1, and 5:1, respectively. As changing bed compositions altered the total mass of both PSA and $PO_x$/SiAl present, the $C_{8+}$ HC productivity has been normalized by the mass of PSA. All varied mass ratio loadings of catalyst were diluted with SiC to ensure uniform heat transfer effects and bed volumes. This ensured uniform gas hourly space velocity (GHSV) of $iC_4$ through the mixed catalyst bed.

TABLE 4

Catalytic reaction data for the dehydrogenative coupling of isobutane over a mixed-bed comprising a mass ratio of 0.5 $PO_x$/SiAl:1 PSA at varied temperature and WHSV. Unless otherwise noted, the inlet feed stream was fixed at 10% $iC_4$, 1% Ar, and 89% $N_2$, and the pressure was fixed at 5 psig.

| Condition | Temp (° C.) | WHSV ($h^{-1}$) | Conversion (%) | $C_{8+}$ prod. (mmol/ $g_{PSA}$/h) | $C_{1-3}$ sel. (%) | $C_4$ sel. (%) | $C_4^=$ sel. (%) | $C_{5-7}$ sel. (%) | $C_{8+}$ sel. (%) |
|---|---|---|---|---|---|---|---|---|---|
| 1 | 350 | 0.62 | 2.24 | 0.0025 | 1.20 | 5.60 | 84.8 | 1.80 | 6.5 |
| 2 | 350 | 1.6 | 1.80 | 0.0039 | 2.00 | 5.40 | 81.9 | 2.10 | 8.60 |
| 3 | 350 | 3.0 | 1.44 | 0.0057 | 1.50 | 9.0 | 78.0 | 1.20 | 9.60 |
| 4 | 375 | 0.62 | 2.50 | 0.0030 | 2.40 | 6.00 | 84.5 | 2.50 | 4.50 |
| 5 | 375 | 3.0 | 0.81 | 0.0069 | 3.10 | 5.40 | 83.6 | 2.60 | 5.30 |
| 6 | 400 | 0.62 | 2.78 | 0.0041 | 2.40 | 5.00 | 85.5 | 3.20 | 3.90 |
| 7 | 400 | 3.0 | 0.72 | 0.0113 | 3.50 | 8.00 | 79.3 | 4.30 | 5.00 |

TABLE 5

Catalytic reaction data for the dehydrogenative coupling of isobutane over a mixed-bed comprising a mass ratio of 2 $PO_x$/SiAl:1 PSA at varied temperature and WHSV. Unless otherwise noted, the inlet feed stream was fixed at 10% $iC_4$, 1% Ar, and 89% $N_2$, and the pressure was fixed at 5 psig.

| Condition | Temp (° C.) | WHSV ($h^{-1}$) | Conversion (%) | $C_{8+}$ prod. (mmol/ $g_{PSA}$/h) | $C_{1-3}$ sel. (%) | $C_4$ sel. (%) | $C_4^=$ sel. (%) | $C_{5-7}$ sel. (%) | $C_{8+}$ sel. (%) |
|---|---|---|---|---|---|---|---|---|---|
| 1 | 350 | 0.62 | 2.49 | 0.0180 | 0.90 | 0.50 | 73.4 | 3.6 | 21.6 |
| 2 | 350 | 1.6 | 0.93 | 0.0503 | 2.80 | 1.20 | 48.1 | 7.80 | 40.1 |
| 3 | 350 | 3.0 | 0.63 | 0.0909 | 1.70 | 1.60 | 41.9 | 6.90 | 47.9 |
| 4[a] | 350 | 0.62 | 3.14 | 0.0244 | 7.40 | 20.5 | 43.7 | 10.5 | 17.9 |
| 5[b] | 350 | 0.62 | 2.44 | 0.0216 | 8.10 | 15.5 | 42.8 | 13.0 | 20.6 |
| 6 | 375 | 0.62 | 2.66 | 0.0196 | 1.30 | 0.30 | 67.3 | 4.40 | 26.7 |
| 7 | 375 | 3.0 | 0.62 | 0.0943 | 1.60 | 1.10 | 38.2 | 7.70 | 51.4 |
| 8 | 400 | 0.62 | 2.92 | 0.0200 | 2.10 | 0.30 | 66.8 | 5.10 | 25.7 |
| 9 | 400 | 3.0 | 0.62 | 0.0957 | 1.50 | 1.0 | 39.2 | 7.9 | 50.4 |

[a]Pressure for this condition was held at 100 psig.
[b]Pressure for this condition was held at 150 psig.

TABLE 6

Catalytic reaction data for the dehydrogenative coupling of isobutane over a mixed-bed comprising a mass ratio of 5 $PO_x$/SiAl:1 PSA at varied temperature and WHSV. Unless otherwise noted, the inlet feed stream was fixed at 10% $iC_4$, 1% Ar, and 89% $N_2$, and the pressure was fixed at 5 psig.

| Condition | Temp (° C.) | WHSV ($h^{-1}$) | Conversion (%) | $C_{8+}$ prod. (mmol/ $g_{PSA}$/h) | $C_{1-3}$ sel. (%) | $C_4$ sel. (%) | $C_4^=$ sel. (%) | $C_{5-7}$ sel. (%) | $C_{8+}$ sel. (%) |
|---|---|---|---|---|---|---|---|---|---|
| 1 | 350 | 0.62 | 2.06 | 0.0225 | 13.3 | 1.20 | 45.5 | 12.4 | 27.6 |
| 2 | 350 | 1.6 | 0.86 | 0.0447 | 1.40 | 0.8 | 46.2 | 7.40 | 44.2 |
| 3 | 350 | 3.0 | 0.51 | 0.0904 | 1.60 | 2.10 | 29.3 | 9.30 | 57.7 |
| 4[a] | 350 | 0.62 | 2.10 | 0.0207 | 4.80 | 31.7 | 33.2 | 9.30 | 21.0 |
| 5[b] | 350 | 0.62 | 1.60 | 0.0260 | 2.18 | 33.2 | 21.8 | 7.62 | 35.2 |
| 6 | 375 | 0.62 | 1.15 | 0.0194 | 4.20 | 0.50 | 49.0 | 9.00 | 37.3 |
| 7 | 375 | 3.0 | 0.60 | 0.0932 | 2.00 | 1.80 | 31.5 | 9.30 | 55.4 |
| 8 | 400 | 0.62 | 1.32 | 0.0196 | 5.00 | 0.60 | 54.0 | 7.90 | 32.5 |
| 9 | 400 | 3.0 | 0.66 | 0.0934 | 2.20 | 1.40 | 37.9 | 8.20 | 50.3 |

[a]Inlet gas composition for this condition was held at 8.8% $iC_4$ at a $H_2/iC_4$ molar ratio of 1.25.
[b]Inlet gas composition for this condition was held at 7.6% $iC_4$ at a $H_2/iC_4$ molar ratio of 3.0.

FIGS. 13A-F illustrates the effects of changing mixed-bed catalyst mass ratios on dehydrogenative coupling product distribution at temperatures of approximately 350° C. 375° C. and 400° C. Fixed parameters during this process embodiment were 10% $iC_4$, 0.62 $h^{-1}$ $iC_4$. and 5 psig. Increasing the mixed-bed catalyst ratio to favor the coupling catalyst improved $C_{8+}$ HC selectivity from 6.5% in the 0.5 $PO_x$/SiAl: 1 PSA to 21.6% and 27.6% in the 2.0 $PO_x$/SiAl: 1 PSA and 5.0 $PO_x$/SiAl: 1 PSA beds, respectively. Total conversion of $iC_4$ decreased as the mixed-bed became coupling-catalyst rich. Conversion increased from 2.24% to 2.49% between the 0.5:1 and 2:1 mixed-beds, but decreased to 2.06% on the 5:1 bed. The initial increase may be due to improved consumption of $C_4$ intermediates on the more abundant $PO_x$/SiAl. This would accelerate dehydrogenation, and thus conversion, of fed $iC_4$. It is possible that the increased cracking product ($C_{1-3}$, $C_{5-7}$) selectivity seen on the 5:1 mixed-bed slows conversion. The combination of improved conversion and $C_{8+}$ HC selectivity benefitted $C_{8+}$ productivity-defined here as the molar formation rate of $C_{8+}$ products per hour normalized to the mass of PSA catalyst. Productivity increased from 0.0025 mmol/$g_{PSA}$/h on the 0.5:1 mixed-bed to 0.0180 mmol/$g_{PSA}$/h (7.2× improvement) and 0.0225 mmol/$g_{PSA}$/h (9× improvement) on the 2:1 and 5:1 beds, respectively. This demonstrates that changing the mixed-bed composition to favor coupling catalysts can increase the production rate of desired $C_{8+}$ HCs in a dehydrogenative coupling process.

Increasing temperature on these mixed-beds generally increased $iC_4$ conversion. Conversion increased from 2.24% to 2.78% on the 0.5:1 bed, from 2.49% to 2.92% on the 2:1 bed, and decreased from 2.06% to 1.32% on the 5:1 bed between 350° C. and 400° C., respectively. Increasing the temperature is expected to benefit dehydrogenation activity, at the expense of coupling performance. For the 0.5:1 catalyst bed, $C_{8+}$ HC selectivity decreased with increasing temperature. The $C_{8+}$ HC selectivity increased on the 2:1 catalyst bed with increasing temperature and decreased on the 5:1 catalyst beds with increasing temperature. These data suggest that a combined effort of tuning temperature and catalyst bed composition can improve both isoalkane conversion and $C_{8+}$ HC selectivity in a dehydrogenative coupling process.

Figure 14A:
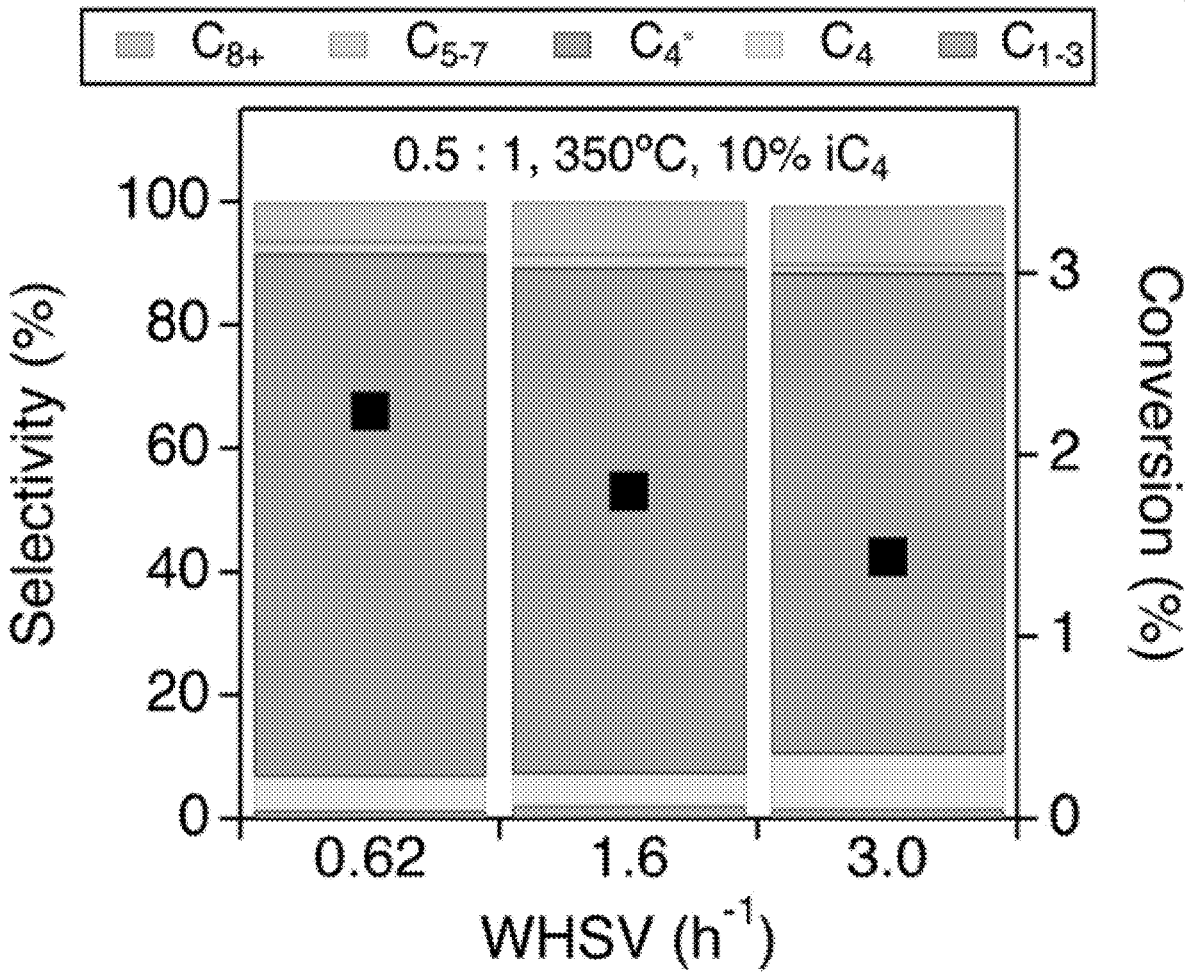
FIGS. 14A-C illustrate dehydrogenative coupling reaction performed over catalyst systems comprising PSA+$PO_X$/SiAl in varying mass ratios in approximately 10% isobutane in $Ar/N_2$ where i) conversion ii) $C_{1-3}$ selectivity iii) $C_{5-7}$ selectivity and iv) $C_{8+}$ selectivity was compared over a range of weight hourly space velocities (WHSV) at a temperature approximately 350° C., according to some aspects of the present disclosure, to represent the effects of changing operating WHSV, according to some aspects of the present disclosure.
Figure 14B:
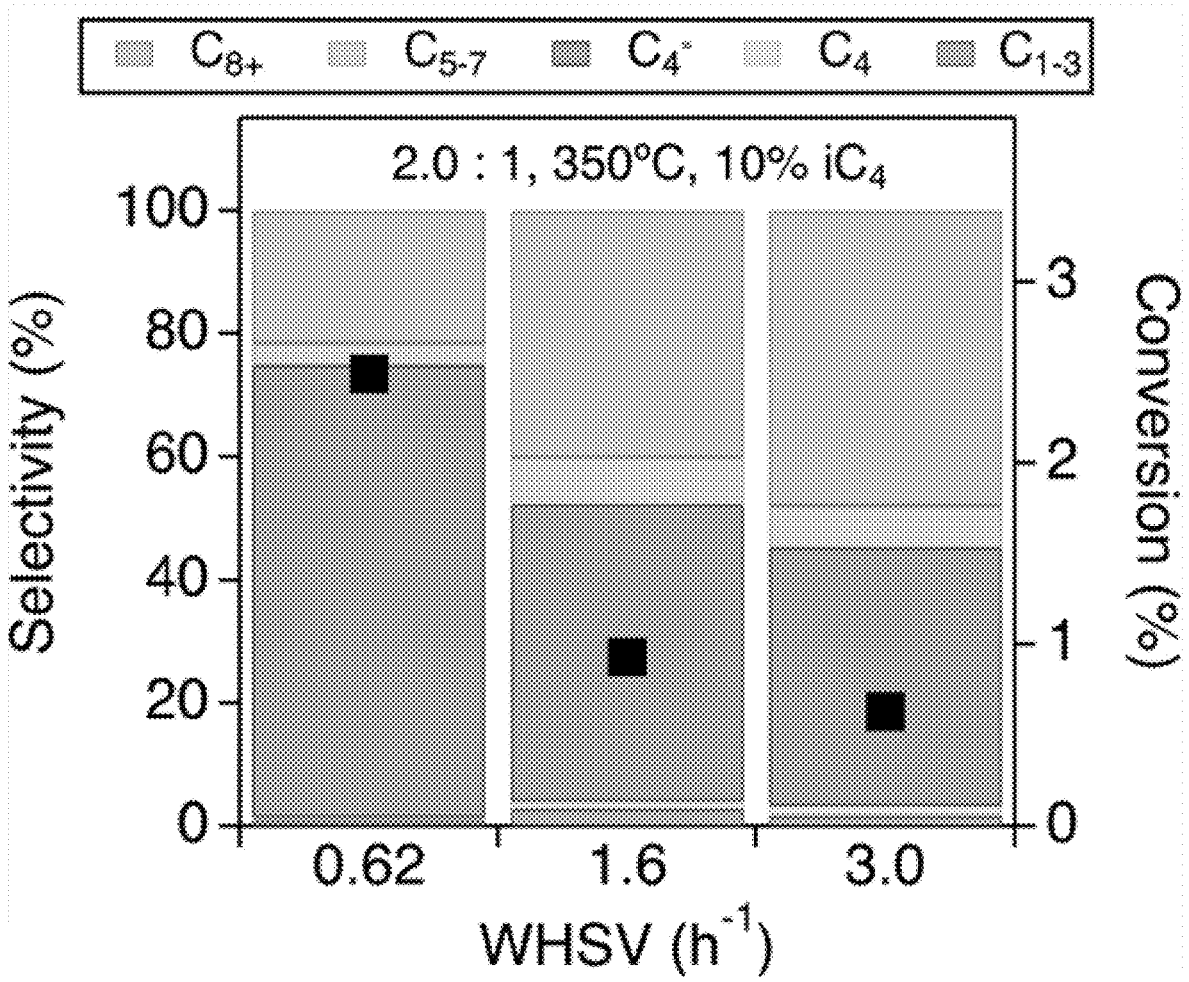
Figure 14C:
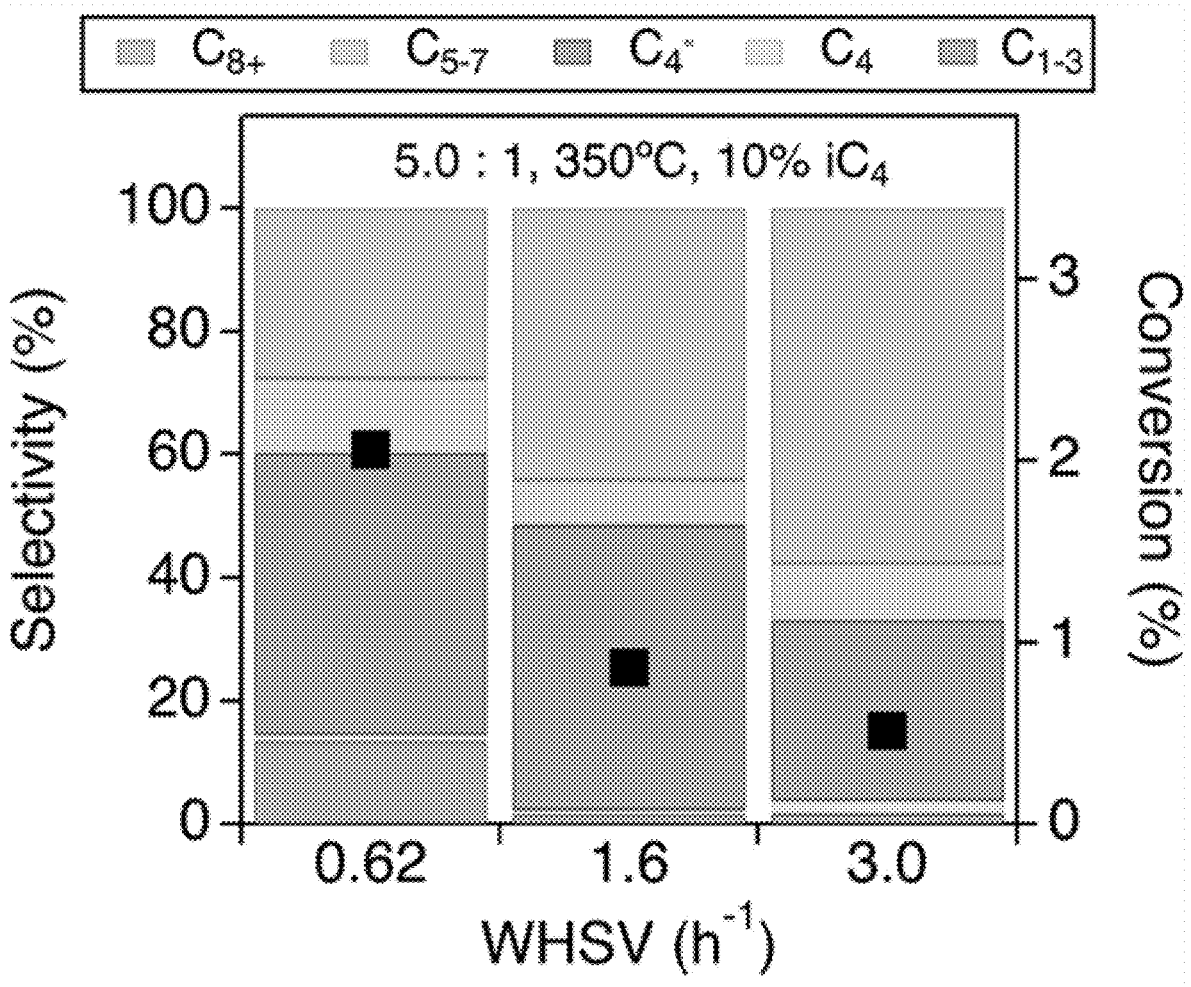

FIGS. 14A-C illustrates the effects of changing WHSV on dehydrogenative coupling product distribution for mixed-beds comprising mass ratios of 0.5, 2, and 5 $PO_x$/SiAl: 1 PSA. $C_{8+}$ HC selectivity benefitted from increased WHSV, regardless of mixed-bed composition. Total conversion decreased with increasing WHSV, regardless of mixed-bed composition. It is expected that a lower WHSV increases the residence time of $iC_4$ in the reactor bed, thereby improving conversion, but also allows greater time for $C_{8+}$ HC cracking. In addition, a higher WHSV may decrease the residence time of $iC_4$ and subsequently hinder conversion, but allows a greater fraction of $C_{8+}$ HC products to exit the reactor without cracking. The net effect of WHSV on $C_{8+}$ production is shown by $C_{8+}$ HC productivity values, which increased with increasing WHSV over all mixed-bed compositions. The largest increase in $C_{8+}$ HC productivity with changing WHSV was between 0.62 and 3.0 $h^{-1}$ at 400° C. on the 2:1 mixed catalyst bed, with values of 0.0200 and 0.0957 mmol $C_{8+}$/$g_{PSA}$/h (see Table 5). This corresponds to a nearly 5-fold increase in production rate. These data suggest that a combined effort of controlling temperature, WHSV, and catalyst bed composition can substantially improve $C_{8+}$ HC production in a dehydrogenative coupling process.

Figure 15:
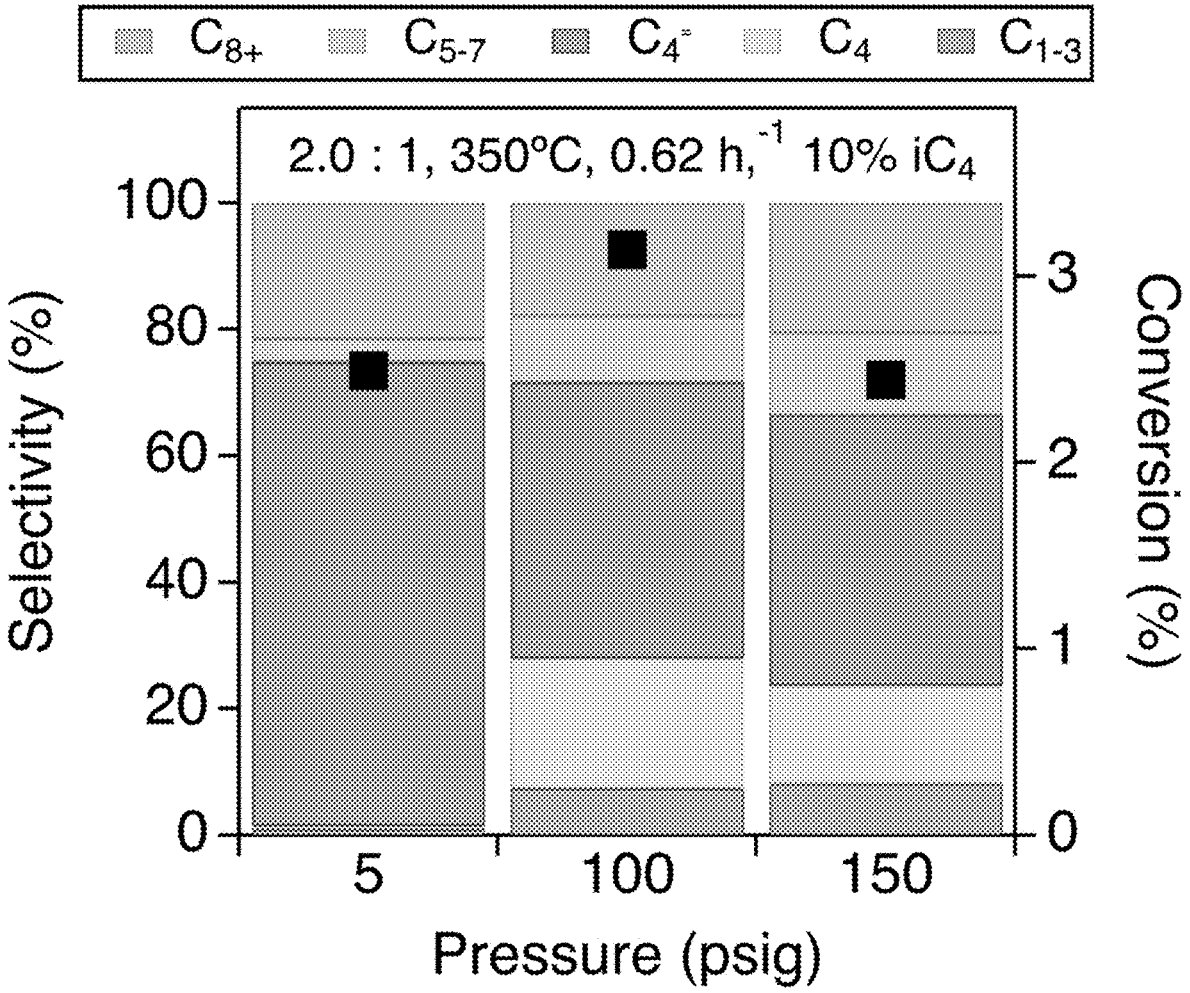
FIG. 15 illustrates dehydrogenative coupling reaction performed over catalyst systems comprising PSA+$PO_X$/SiAl in varying mass ratios in approximately 10% isobutane in $Ar/N_2$ where a) conversion b) $C_{1-3}$ selectivity c) $C_{5-7}$ selectivity and d) $C_{8+}$ selectivity was compared over a range of pressures at a temperature of approximately 350° C. and 0.62 $h^{-1}$ $iC_4$, according to some aspects of the present disclosure, to represent the effects of changing operating pressure, according to some aspects of the present disclosure.

FIG. 15 illustrates the effects of changing operating pressure on dehydrogenative coupling product distribution for a mixed-bed containing a mass ratio of 2:1 for $PO_x$/SiAl: PSA. $C_{8+}$ HC selectivity was generally seen to decrease at higher pressures, from 21.6% at approximately 5 psig, to 17.9% and 20.6% at approximately 100 and 150 psig, respectively. The total conversion was seen to first increase from 2.49% at 5 psig to 3.14% at 100 psig, before decreasing to 2.44% at 150 psig. $C_{8+}$ HC productivity was found to generally increase as pressure increased, from 0.0180 mmol $C_{8+}$/$g_{PSA}$/h at 5 psig, to 0.0244 and 0.0216 mmol $C_{8+}$/$g_{PSA}$/h at 100 and 150 psig, respectively. While current reactor limitations inhibit operating pressures greater than approximately 150 psig, the results presented herein showed that increasing pressures can improve $C_{8+}$ HC productivity in a dehydrogenative coupling process.

Previous reports have demonstrated that coapplying $H_2$ with isoalkanes can improve dehydrogenation conversion and catalyst stability through the $H_2$-driven removal of coke species. As such, some embodiments of dehydrogenative coupling testing included the coapplying of $H_2$ alongside $iC_4$ over the mixed catalyst bed comprising 5.0 $PO_x$/SiAl: 1 PSA at 350° C. Two molar ratios of $H_2$:$IC_4$ were selected to represent the effects of cofed $H_2$. These were 1.25:1 and 3:1, as summarized in Table 6. Adding $H_2$ in a $H_2$:$IC_4$ ratio of 1.25 had minimal effect on total conversion (2.06% vs 2.10%), decreased selectivity to $C_{1-3}$, $C_4$, $C_{5-7}$, and $C_{8+}$ HCs, and increased selectivity $C_4$ HCs. Increasing the $H_2$:$IC_4$ ratio to 3.0 decreased total conversion to 1.60%, continued to decrease selectivity to $C_{1-3}$, $C_4^{=}$, and $C_{5-7}$ HCs, and increased selectivity to both $C_4$ and $C_{8+}$ HCs. $C_{8+}$ HC productivity was found to first decrease from 0.0225 mmol/$g_{PSA}$/h without cofed $H_2$ to 0.0207 mmol/$g_{PSA}$/h at a $H_2$/$iC_4$ ratio of 1.25. The productivity then increased to 0.0260 mmol/$g_{PSA}$/h when the $H_2$/$iC_4$ ratio was increased to 3.0. This data suggests that $H_2$ cofed in the feed stream can be used to benefit $C_{8+}$ HC selectivity and $C_{8+}$ HC productivity, with minor effects on conversion.

Figure 16:
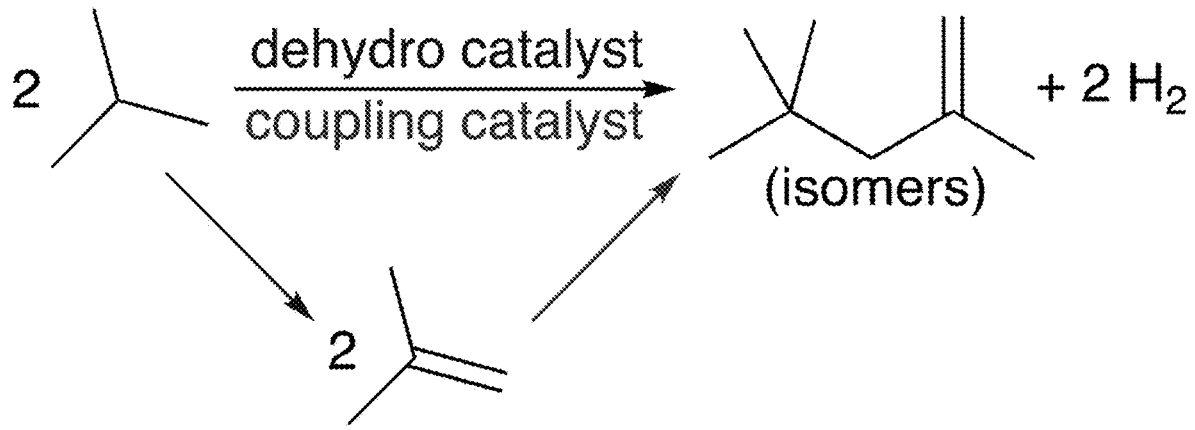
FIG. 16 illustrates the desired cascade chemistry, according to some aspects of the present disclosure.

FIG. 16 illustrates the desired cascade chemistry, according to some aspects of the present disclosure. An alkane, when reacted with a dehydrogenative catalyst and a coupling catalyst produces various jet-fuel grade HCs (i.e., $C_{8+}$ HCs), with hydrogen being an additional product. An alkene is an intermediary.

The foregoing discussion and examples have been presented for purposes of illustration and description. The foregoing is not intended to limit the aspects, embodiments, or configurations to the form or forms disclosed herein. In the foregoing Detailed Description for example, various features of the aspects, embodiments, or configurations are grouped together in one or more embodiments, configurations, or aspects for the purpose of streamlining the disclosure. The features of the aspects, embodiments, or configurations, may be combined in alternate aspects, embodiments, or configurations other than those discussed above. This method of disclosure is not to be interpreted as reflecting an intention that the aspects, embodiments, or configurations require more features than are expressly recited in each claim. Rather, as the following claims reflect, inventive aspects lie in less than all features of a single foregoing disclosed embodiment, configuration, or aspect. While certain aspects of conventional technology have been discussed to facilitate disclosure of some embodiments of the present invention, the Applicants in no way disclaim these technical aspects, and it is contemplated that the claimed invention may encompass one or more of the conventional technical aspects discussed herein. Thus, the following claims are hereby incorporated into this Detailed Description, with each claim standing on its own as a separate aspect, embodiment, or configuration.

What is claimed is:

1. A method comprising:

forming a mixed bed comprising a dehydrogenation catalyst and a coupling catalyst in a ratio comprising at least 1:2; and providing a feed stream to the mixed bed causing a reaction; wherein:

the forming and the providing are performed in a reactor, the reactor has a temperature of approximately 400° C. and a pressure of approximately 95 psig, and the reaction results in a higher molecular weight hydrocarbon.

2. The method of claim 1, wherein:

the dehydrogenation catalyst comprises:

at least one of Pt—Sn/$Al_2O_3$ or a zeolite material, wherein:

the Pt—Sn/$Al_2O_3$ or the zeolite material is modified with at least one of vanadium (V), zinc (Zn), copper (Cu), gallium (Ga), nickel (Ni), or platinum (Pt).

3. The method of claim 1, wherein:

the dehydrogenation catalyst comprises an amorphous silica-alumina material modified with at least one of V, Zn, Cu, Ga, Ni, or Pt.

4. The method of claim 1, wherein:

the coupling catalyst comprises a BEA zeolite.

5. The method of claim 4, wherein:

the BEA zeolite has a silica-alumina ratio (SAR) in the range of 10 to 300.

6. The method of claim 4, wherein:

the BEA zeolite has a silicoaluminophosphate zeotype (SAPO).

7. The method of claim 4, wherein:

the BEA zeolite comprises a mixed oxide of at least one of $WO_3$—$ZrO_2$, $SiO_2$—$AlO_3$, or phosphated-$SiO_2$—$AlO_3$.

8. The method of claim 1, wherein:

the coupling catalyst comprises a faujasite (FAU) zeolite.

9. The method of claim 8, wherein:

the FAU zeolite has a silica-alumina ratio (SAR) in the range of 10 to 300.

10. The method of claim 8, wherein:

the FAU zeolite has a silicoaluminophosphate zeotype (SAPO).

11. The method of claim 8, wherein:

the FAU zeolite comprises a mixed oxide of at least one of $WO_3$—$ZrO_2$, $SiO_2$—$AlO_3$, or phosphated-$SiO_2$—$AlO_3$.

12. The method of claim 1, wherein:

the feed stream comprises at least one C4-C8 branched hydrocarbon.

13. The method of claim 1, wherein:

the feed stream comprises isobutane, argon, and nitrogen.

14. The method of claim 13, wherein:

the feed stream further comprises a hydrogen gas ($H_2$).

15. The method of claim 1, wherein:

the higher molecular weight hydrocarbon comprises a $C_{8+}$ hydrocarbon.

16. The method of claim 15, wherein:

the $C_{8+}$ hydrocarbon comprises octane, nonane, decane, undecane, dodecane, octene, nonene, decene, undecene, dodecene, octyne, nonyne, decyne, undecyne, dodecyne, cyclooctane, cyclononane, cyclodecane, cycloundecane, cyclododecane, octadiene, nonadiene, decadiene, undecadiene, or dodecadiene.

* * * * *